US010119368B2

(12) United States Patent
Tunget

(10) Patent No.: US 10,119,368 B2
(45) Date of Patent: Nov. 6, 2018

(54) APPARATUS AND METHOD FOR CULTIVATING A DOWNHOLE SURFACE

(71) Applicant: Bruce A. Tunget, Aberdeen (GB)

(72) Inventor: Bruce A. Tunget, Aberdeen (GB)

( * ) Notice: Subject to any disclaimer, the term of this patent is extended or adjusted under 35 U.S.C. 154(b) by 212 days.

(21) Appl. No.: 14/903,028

(22) PCT Filed: Jul. 7, 2014

(86) PCT No.: PCT/US2014/045614
§ 371 (c)(1),
(2) Date: Jan. 5, 2016

(87) PCT Pub. No.: WO2015/003188
PCT Pub. Date: Jan. 8, 2015

(65) Prior Publication Data

US 2016/0138369 A1 May 19, 2016

(30) Foreign Application Priority Data

Jul. 5, 2013 (GB) ..... 1312157.9
Mar. 9, 2014 (GB) ..... 1404121.4

(51) Int. Cl.
*E21B 37/02* (2006.01)
*E21B 29/00* (2006.01)

(52) U.S. Cl.
CPC ..... *E21B 37/02* (2013.01); *E21B 29/00* (2013.01)

(58) Field of Classification Search
CPC ..... E21B 29/00; E21B 37/02
See application file for complete search history.

(56) References Cited

U.S. PATENT DOCUMENTS 1,402,786 A * 1/1922 Muehl ..... E21B 37/02 15/104.095
1,423,625 A * 7/1922 Rogers ..... E21B 37/02 175/276
1,618,368 A * 2/1927 Dietle ..... E21B 29/00 166/55.2
2,157,493 A * 5/1939 Miller ..... E21B 37/02 15/104.069

(Continued)

FOREIGN PATENT DOCUMENTS

EP 1416118 A1 6/2004
EP 1840325 A1 3/2007

(Continued)

*Primary Examiner* — James G Sayre

(57) ABSTRACT

Methods and apparatus for cultivating a surface of a wall of a subterranean well bore, conduit or cable by scraping and furrowing the surface using a string hoistable shaft carrying a flexible arrangement of a laterally extendable and retractable arcuate engagement linkage dragging a cutter and scraper member, wherein said engagement linkage arcuately engages and aligns the cutter and scraper member during one or more scraping engagements: along said surface and longitudinal to a well axis to form and use said furrow, across said surface and transverse to said well axis using a filament linkage to form and use said furrow, or along and across said surface and longitudinal and transverse to said well axis to form and use a lattice of said furrows, separating a plane of the surface into a plurality of planes that comprise separate surface regions, usable by an ancillary apparatus or a spreadable substance.

44 Claims, 21 Drawing Sheets

(56) References Cited

U.S. PATENT DOCUMENTS

| | | | | | |
|---|---|---|---|---|---|
| 2,362,198 | A | * | 11/1944 | Gibson | E21B 37/02 15/104.09 |
| 2,407,991 | A | | 9/1946 | McCullough | |
| 2,482,985 | A | * | 9/1949 | Lockwood | E21B 37/02 166/173 |
| 2,685,931 | A | * | 8/1954 | Baker | E21B 37/02 166/173 |
| 2,708,355 | A | | 5/1955 | Newton | |
| 2,728,398 | A | * | 12/1955 | Taylor | E21B 37/02 166/153 |
| 2,998,074 | A | * | 8/1961 | Casady | E21B 37/02 166/172 |
| 3,749,187 | A | | 7/1973 | Leathers | |
| 4,396,065 | A | | 8/1983 | McKenney | |
| 4,762,179 | A | | 8/1988 | Wesson et al. | |
| 4,926,557 | A | | 5/1990 | Haupt | |
| 4,942,664 | A | | 7/1990 | Zatulovsky | |
| 5,098,225 | A | * | 3/1992 | Rockower | B23D 21/02 138/97 |
| 5,127,473 | A | | 7/1992 | Harris et al. | |
| 5,127,477 | A | | 7/1992 | Schultz | |
| 5,335,723 | A | * | 8/1994 | Mouton | E21B 17/1014 166/173 |
| 5,575,333 | A | | 11/1996 | Lirette et al. | |
| 5,720,344 | A | | 2/1998 | Newman | |
| 5,752,454 | A | | 5/1998 | Barton | |
| 5,785,125 | A | | 7/1998 | Royer | |
| 5,924,489 | A | | 7/1999 | Hatcher | |
| 6,052,907 | A | | 4/2000 | Wang | |
| 6,116,344 | A | | 9/2000 | Longbottom et al. | |
| 6,148,918 | A | | 11/2000 | Alexander | |
| 6,478,903 | B1 | | 11/2002 | Hilts et al. | |
| 6,494,272 | B1 | | 12/2002 | Eppink et al. | |
| 6,615,933 | B1 | | 9/2003 | Eddison | |
| 7,040,395 | B2 | | 5/2006 | Booth | |
| 7,090,007 | B2 | | 8/2006 | Stuart-Bruges et al. | |
| 7,325,603 | B2 | | 2/2008 | Kotlar et al. | |
| 7,559,374 | B2 | | 7/2009 | Telfer | |
| 7,575,056 | B2 | | 8/2009 | Fuhst et al. | |
| 7,588,101 | B2 | | 9/2009 | Lynde et al. | |
| 7,631,702 | B2 | | 12/2009 | Hansen | |
| 7,726,028 | B2 | | 6/2010 | Koch et al. | |
| 7,757,769 | B2 | | 7/2010 | Hill et al. | |
| 7,861,787 | B2 | | 1/2011 | Russell | |
| 7,866,384 | B2 | | 1/2011 | Hall | |
| 7,966,736 | B2 | | 6/2011 | Arnetoli | |
| 7,979,991 | B2 | | 7/2011 | Pfaltzgraff | |
| 7,997,354 | B2 | | 8/2011 | Radford et al. | |
| 8,147,293 | B2 | | 4/2012 | Hashish | |
| 8,210,251 | B2 | | 7/2012 | Lynde et al. | |
| 8,322,422 | B2 | | 12/2012 | Freyer | |
| 8,356,662 | B2 | | 1/2013 | Winn | |
| 8,376,043 | B2 | | 2/2013 | Knobloch et al. | |
| 8,387,693 | B2 | | 3/2013 | Tunget | |
| 8,418,755 | B2 | | 4/2013 | Howard et al. | |
| 2004/0134687 | A1 | | 7/2004 | Radford et al. | |
| 2005/0205266 | A1 | | 9/2005 | Todd et al. | |
| 2008/0190623 | A1 | | 8/2008 | Mailand et al. | |
| 2008/0277118 | A1 | | 11/2008 | McAfee | |
| 2009/0266544 | A1 | | 10/2009 | Redlinger et al. | |
| 2009/0308605 | A1 | | 12/2009 | McAfee | |
| 2010/0258289 | A1 | | 10/2010 | Lynde et al. | |
| 2011/0000668 | A1 | | 1/2011 | Tunget | |
| 2011/0005185 | A1 | | 1/2011 | Kato et al. | |
| 2011/0053458 | A1 | | 3/2011 | Miller et al. | |
| 2011/0232969 | A1 | | 9/2011 | Laird et al. | |
| 2012/0193152 | A1 | | 8/2012 | Russell et al. | |
| 2012/0266705 | A1 | | 10/2012 | Little et al. | |
| 2012/0285696 | A1 | | 11/2012 | Richard et al. | |
| 2013/0014957 | A1 | | 1/2013 | Hallundbaek et al. | |
| 2013/0048271 | A1 | | 2/2013 | VanLue | |
| 2013/0092372 | A1 | | 4/2013 | Clapp et al. | |
| 2013/0241742 | A1 | | 9/2013 | Contant et al. | |
| 2013/0299248 | A1 | | 11/2013 | Rives | |
| 2014/0138083 | A1 | * | 5/2014 | Fanini | E21B 29/002 166/250.01 |

FOREIGN PATENT DOCUMENTS

| | | | |
|---|---|---|---|
| EP | 2071003 | A1 | 6/2009 |
| EP | 1790779 | B1 | 7/2009 |
| EP | 2497602 | A1 | 9/2012 |
| GB | 2471760 | A | 1/2011 |
| GB | 2484166 | A | 4/2012 |
| GB | 2486591 | A | 6/2012 |
| GB | 2492663 | A | 1/2013 |
| WO | WO199319281 | A1 | 9/1993 |
| WO | WO199628635 | A1 | 9/1996 |
| WO | WO199110675 | A1 | 3/1999 |
| WO | WO200235055 | A1 | 5/2002 |
| WO | WO2004092532 | A1 | 10/2004 |
| WO | WO2005052311 | A1 | 6/2005 |
| WO | WO2006048210 | A1 | 5/2006 |
| WO | WO2007101444 | A2 | 9/2007 |
| WO | WO2009121882 | A1 | 10/2009 |
| WO | WO2012071636 | A1 | 6/2012 |

* cited by examiner

Fig.18
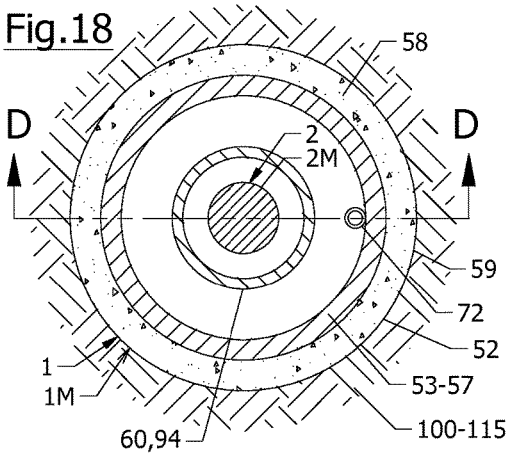
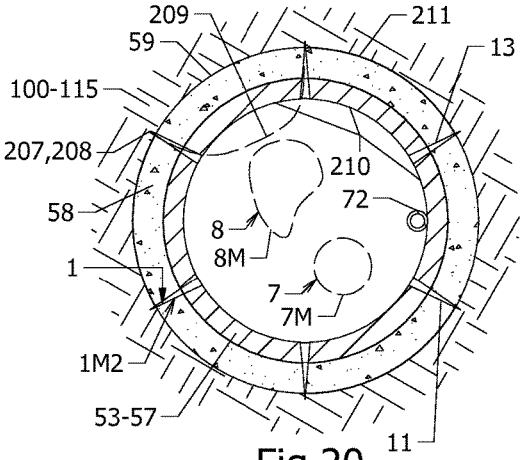
Fig.20
SECTION E-E
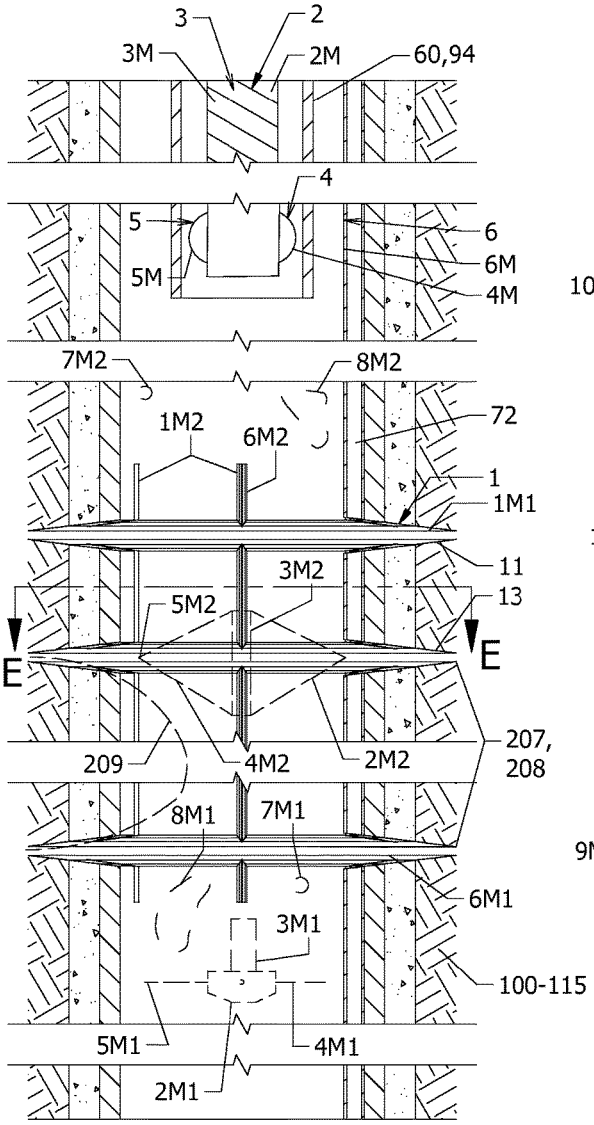
Fig.19
SECTION D-D
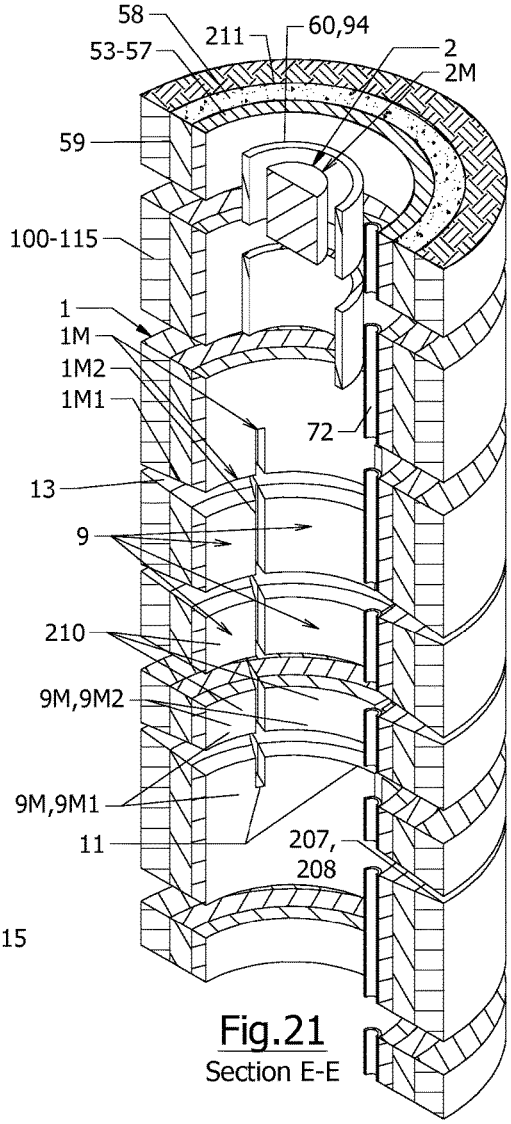
Fig.21
Section E-E Fig.22
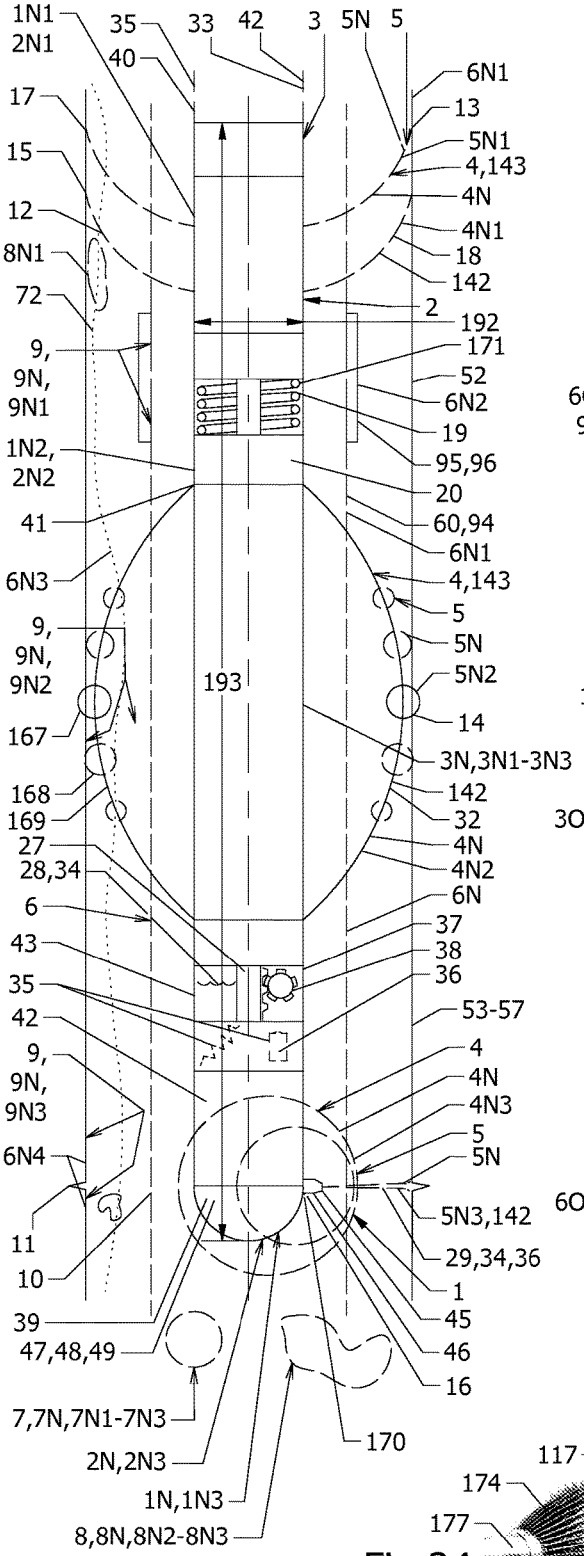
Fig.23
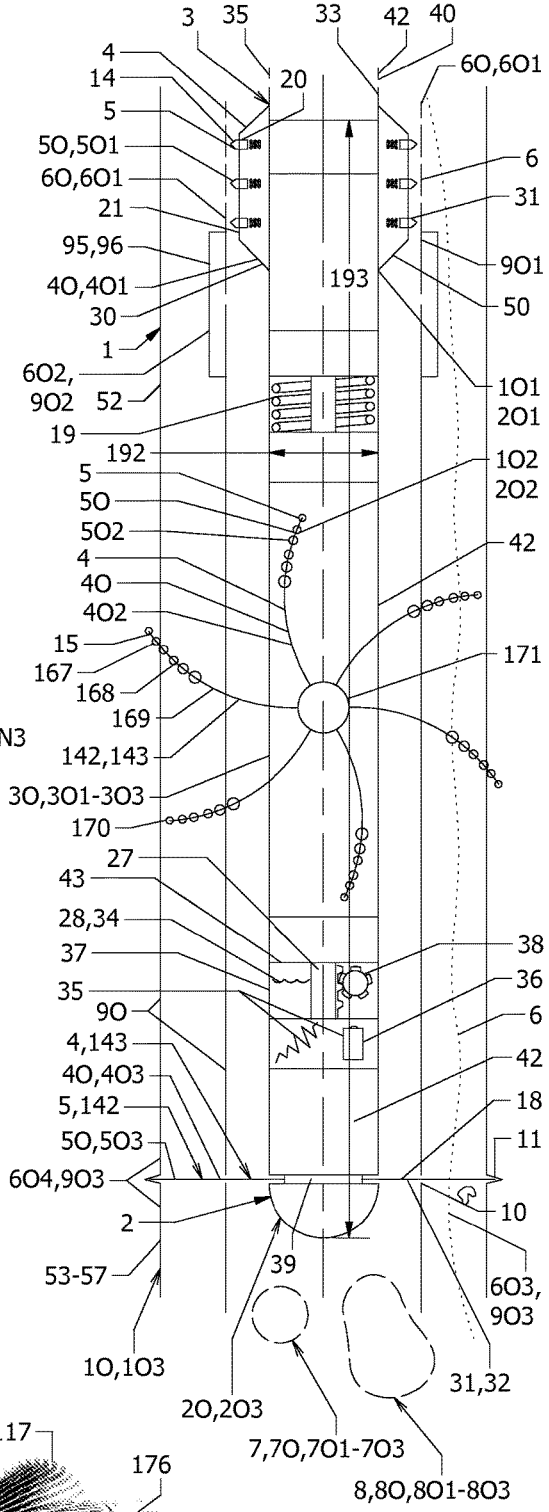
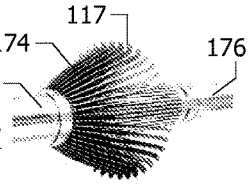
Fig.24
Prior Art Fig.25
Prior Art
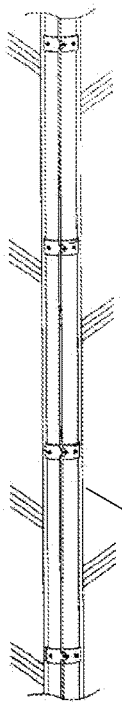
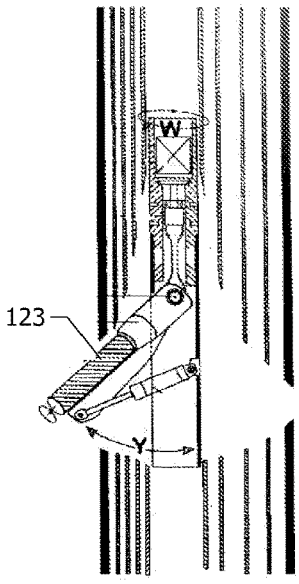
Fig.30
Prior Art
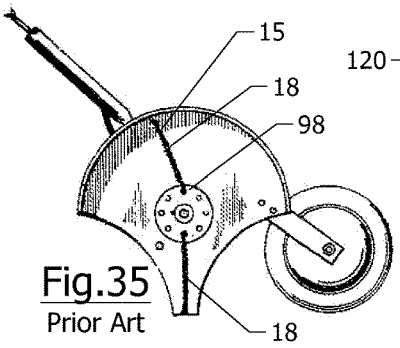
Fig.35
Prior Art
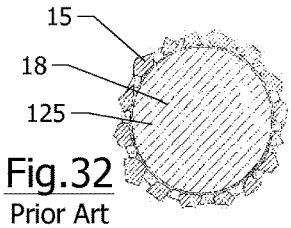
Fig.32
Prior Art
Fig.27
Prior Art
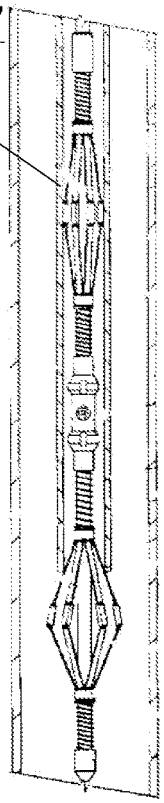
Fig.31
Prior Art
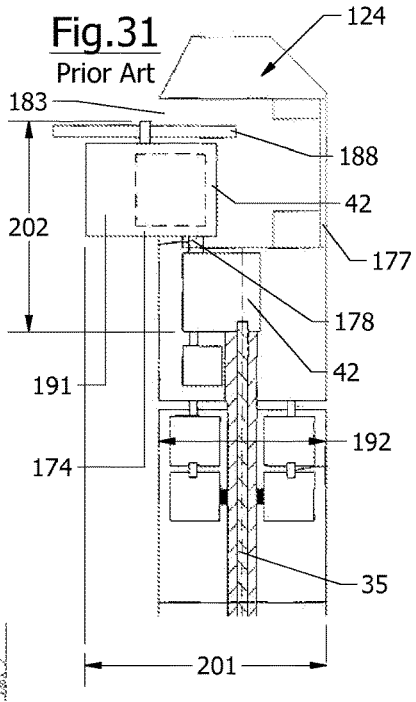
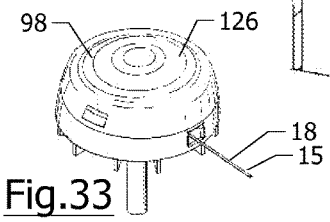
Fig.33
Prior Art
Fig.28
Prior Art
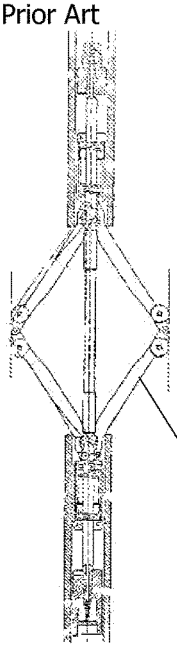
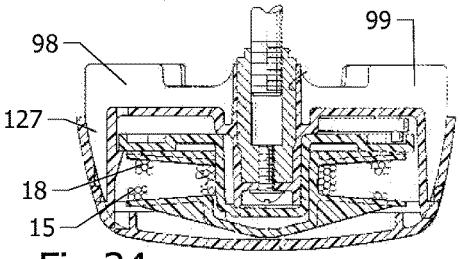
Fig.34
Prior Art
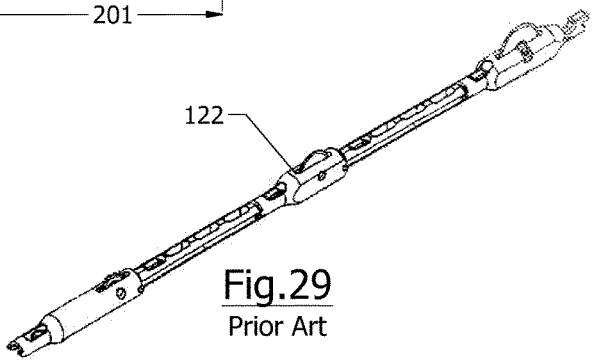
Fig.29
Prior Art
Fig.26
Prior Art
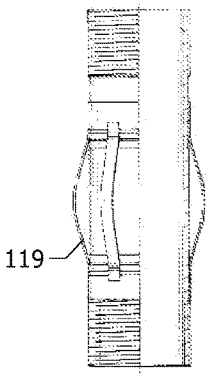

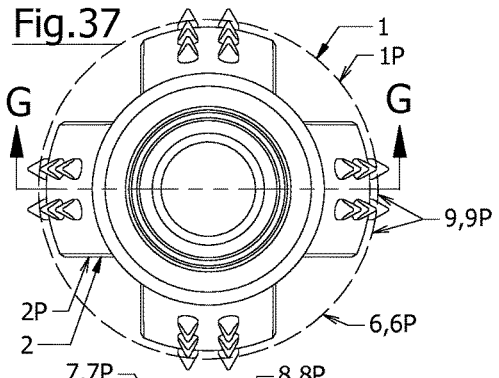
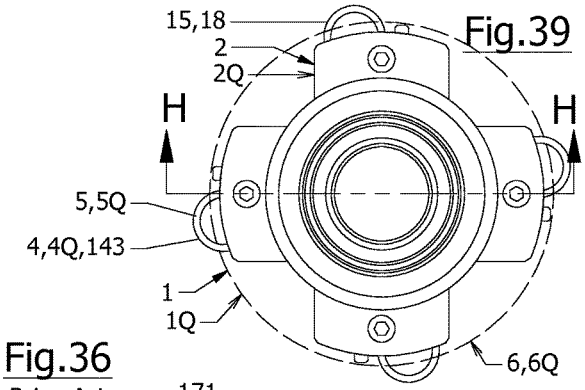
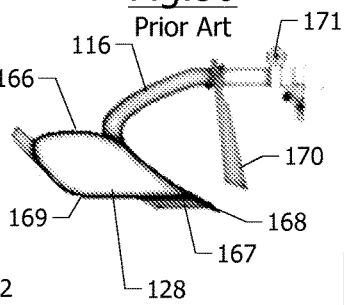
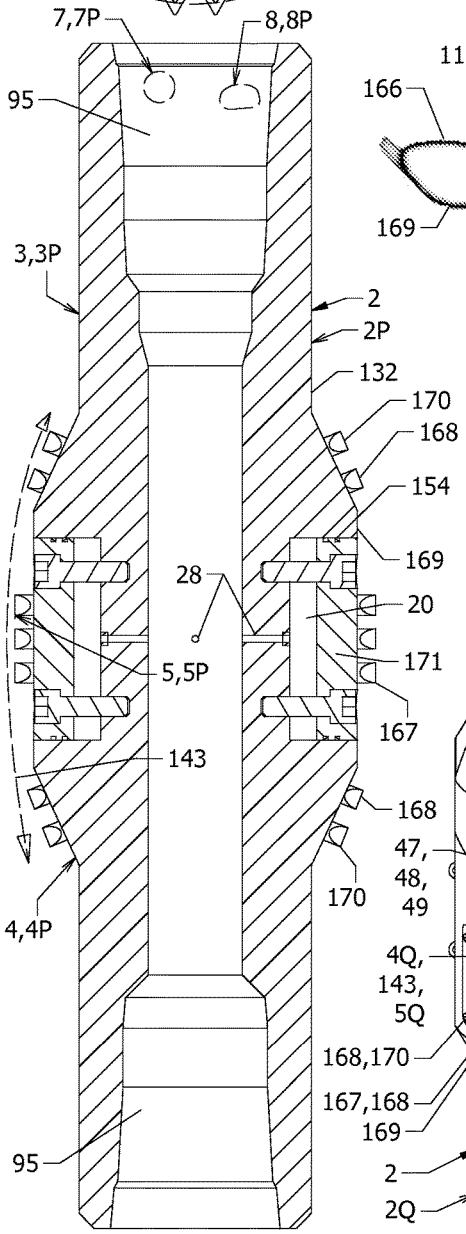
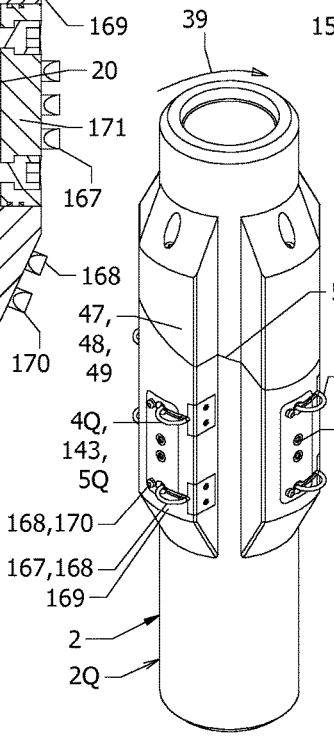
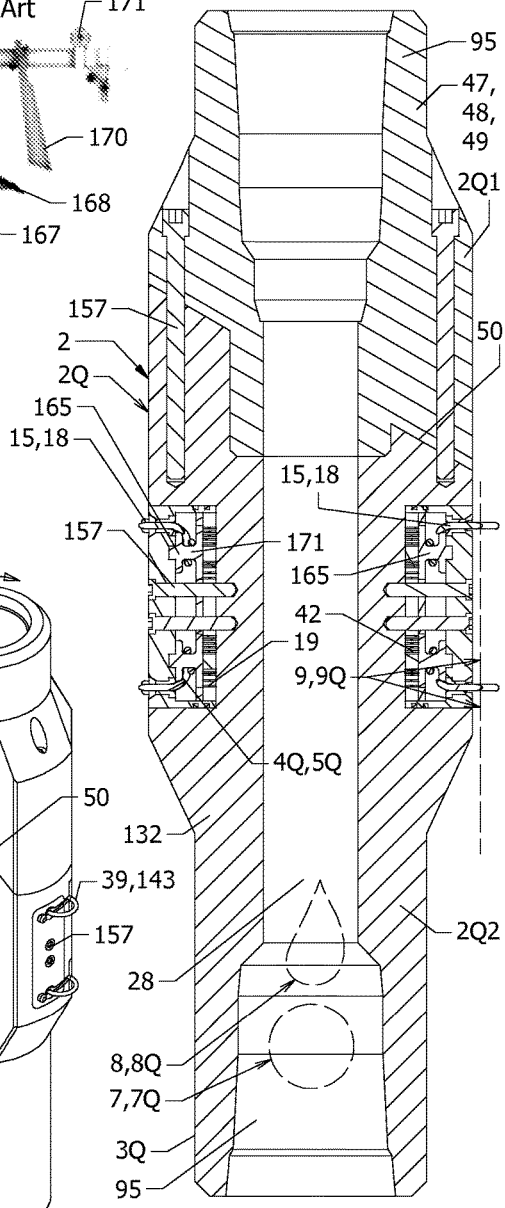
Fig.38
SECTION G-G
Fig.41
Fig.40
SECTION H-H

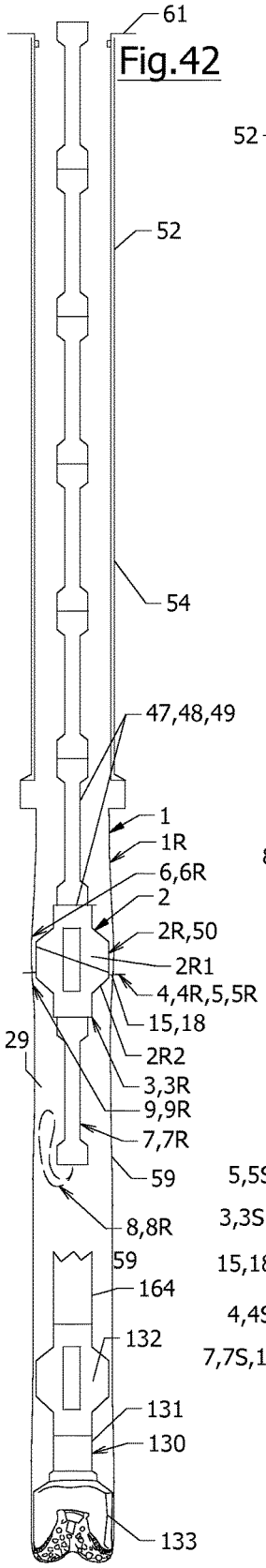
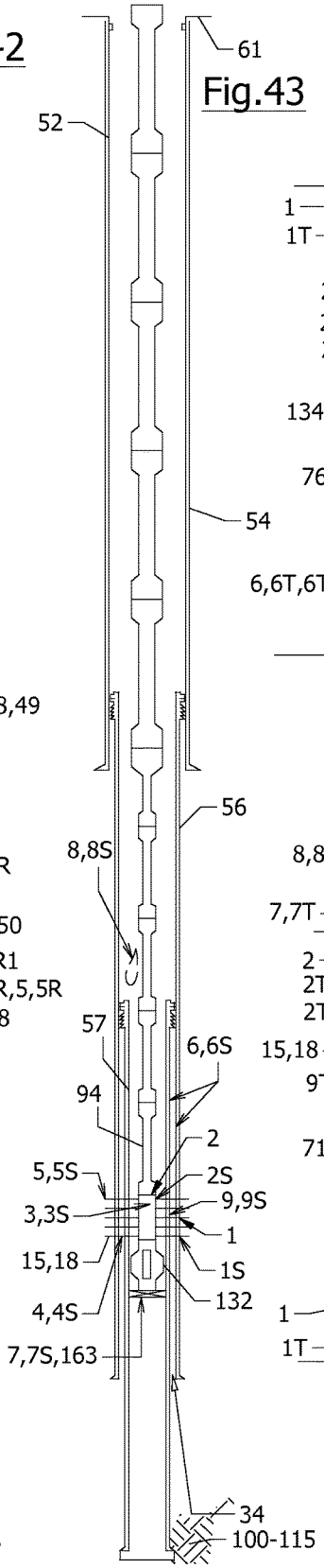
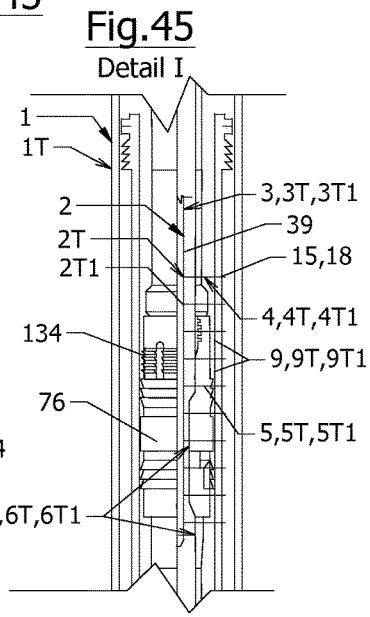
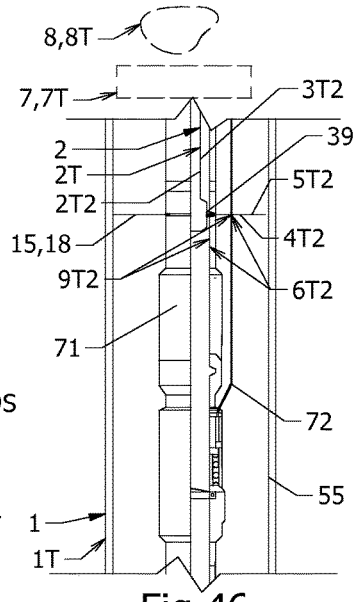
Fig.46
Detail J
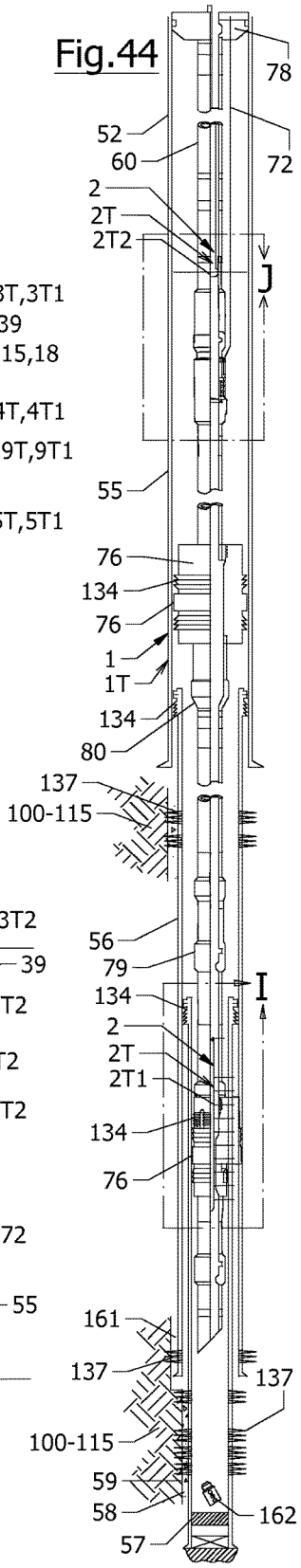

DETAIL K

DETAIL L

DETAIL M

SECTION N-N

SECTION O-O
M
N
O
159
3X1
3,3X
2
2X
3X2
143
4,4X
19
3X3
3X
1
1X
3X
6,6X
9,9X
4X
157
158
5,5X
7,7X
8,8X
6X
4,4Y
1Y
6,6Y
9,9Y
151
14
5,5Y
7,7Y
2Y
8,8Y
3,3Y
9,9Z
6,6Z
1Z
2Z
1AA
2AA
5AA3
5AA2
6AA
5AA1
5AA4
5AA5
144
3,3AA
4,4AA,
5
10
5AA
9,9AA
6,6AA
7,7AA
8,8AA
3Z1
4Z4
4Z1
44
3Z2
3Z3
3,3Z
154
156
28
155
34
20
4,4Z
3Z4
4Z5
5,5Z
9,9Z
6,6Z
4Z2
7,7Z
8,8Z 2
2AB
152
3,3AB
2
2AB
153
4,4AB
4AB1
4AB2
2
2AB
6AB
1
1AB
5,5AB
9,9AB
153
5AB
153
7,7AB
8,8AB
152
3AB

60
P
P
2
2AC
6,6AC
2
2AC
5,5AC
1
1AC
6AC
14
9,9AC
4,4AC
3,3AC

SECTION P-P
7,7AC
8,8AC 2
2AD
2AD1
1
1AD
1AD2
15
5,5AD
1
1AD
1AD1

3,3AD
3AD1
2
2AD
2AD2
9,9AD
6,6AD
4,4AD
143
3AD2
7,7AD
8,8AD 1
1AE
19
4
2
2AE
59
3
3AE
58
60
Q
9,9AE
7,7AE
8,8AE
4
57
100-115

DETAIL Q
2
2AE
4AE
5AE
11
143
1
1AE
6AE 2
2AF
2AF1
3AF
3AF3

3AF1
2
2AF
2AF2
3,3AF
3AF2
151
5,5AF
9,9AF
142
1
1AF
6,6AF
4,4AF
8,8AF
7,7AF
151
3AF3

2
2AG
3AG2
3AG
3AG1
3
4AG1
4AG
4
4AG2
6AG
1
1AG
9AG
150
3AG3
5AG
4AG3
6
5
3AG4
4AG4
7
7AG
8AG
8

2
2AH
3AH2
3AH1
4AH
3AH
4AH1
143
4AH2
3AH3
6AH
1
1AH
143
5AH
9AH
6AH
4AH3
3AH4
143
7AH
8AH
4AH4

DETAIL R

DETAIL S
2
2AI
2AI1
3AI
4AI
143
4
141
3AI5
142
38AI1
38AI2
3AI6
3AI7
3AI7
3
2
2AI
2AI2
1
1AI
5,5AI
6,6AI
11
9,9AI
143
7,7AI
8,8AI
3AI7
144
147
148
3AI2
144
2
2AI
3AI1
145
145
144
144
3AI2
3AI3
S
146
4AI1
3AI4
3AI5
149
5AI1
4AI2
3AI8
5AI2
149
3AI7
3AI6
4AI3
R

T
T 2
2AU

SECTION T-T
22
129
144
2
2AU
2AU1
145
3AU1
139
3AU2
138
3AU3
4AU1
4AU
4
140
3
3AU
3AU4
19

SECTION T-T
3AU2
3AU6
3AU5
146
3AU7
2
2AU
2AU1
3AU8
3AU9
144
145
3AU10
3AU11
3AU12
149
4AU1
4AU
4
3AU
5AU1
4AU2
3AU13
5
5AU
5AU2
4AU3
141
3AU14
149
3AU15
3AU5
3AU17
3AU16
3AU17
146
3AU19
144
145
2
2AU
2AU1
3AU20
3AU18
3AU21
144
3AU22
192
149
4
4AU
4AU4
5
5AU
5AU3
3AU23
4AU5
3AU
5AU4
4AU6
141
3AU24
3AU25
3AU26
3AU27

11
5AJ
192
1
1AJ
142
6AJ
2
2AJ

SECTION T-T
192
3AU27
3AU28
2
2AU
2AU1
19
3AU29
3AU30
3AU31
3AU

SECTION T-T 185
22
3,3AJ
2AJ1
1
1AJ
2AJ
4
5
2AJ2
2
2AJ3
6,6AJ
4AJ
9AJ
5AJ
2AJ4
7,7AJ
8,8AJ
2AJ5
5
2AJ6
4,142
193
192
5,142
4
2AJ7
5
4,142
2AJ8
4
5,142
2AJ9
5,142
4
2AJ10
5
4,142
2AJ11
5
4,142
5
4,142
2AJ12

Fig.85
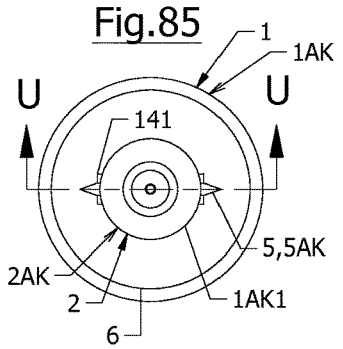
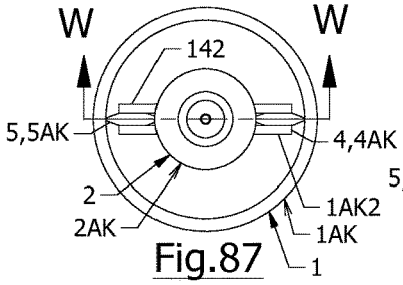
Fig.87
Fig.89
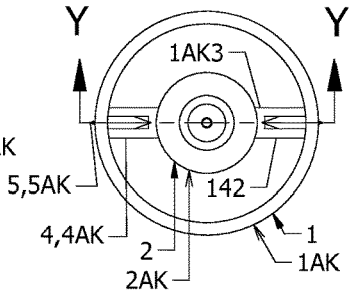
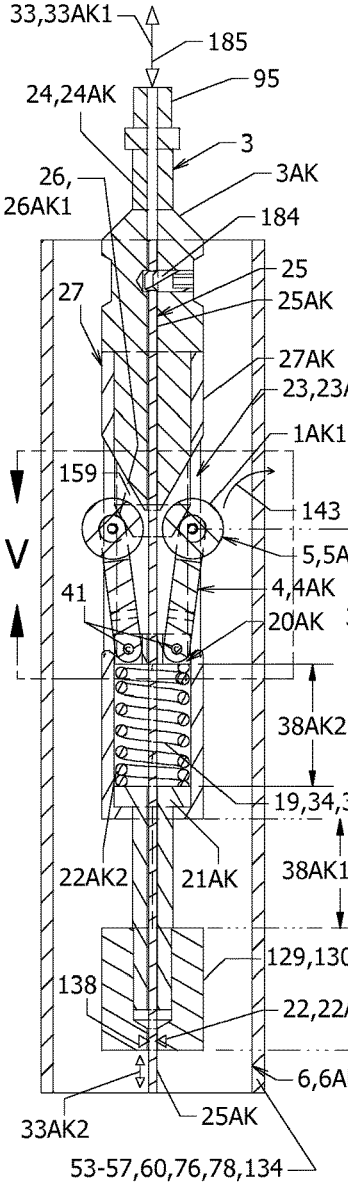
Fig.86
SECTION U-U
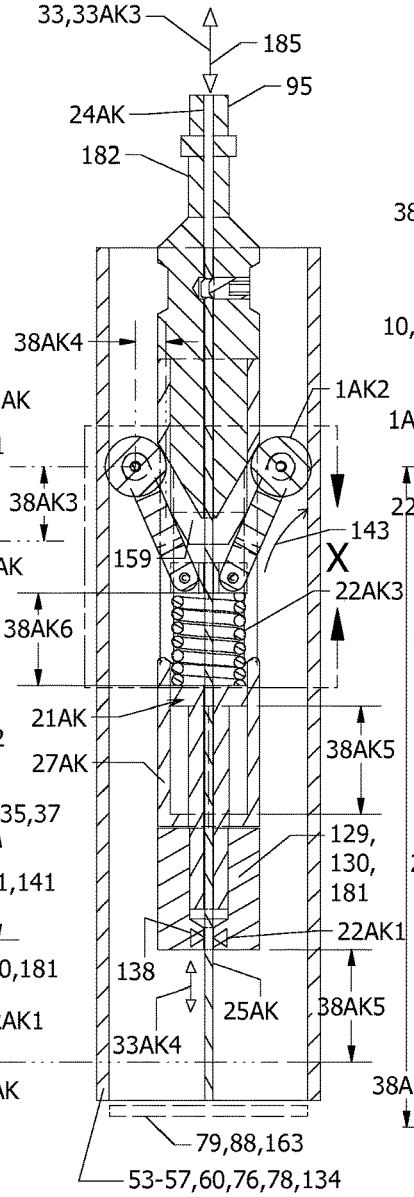
Fig.88
SECTION W-W
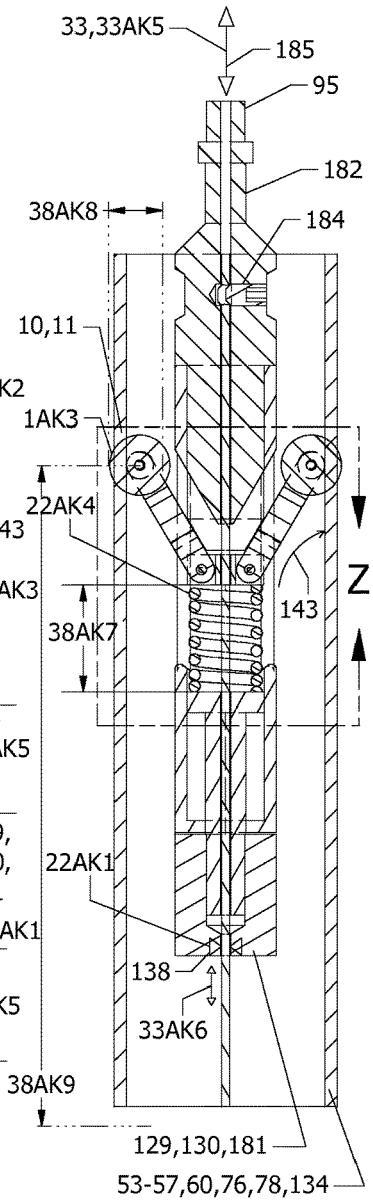
Fig.90
SECTION Y-Y

DETAIL V

DETAIL X

DETAIL Z

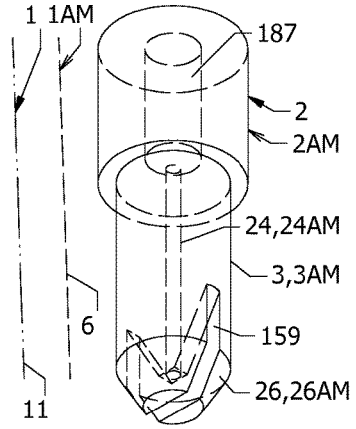
Fig.95
Fig.96
Prior Art
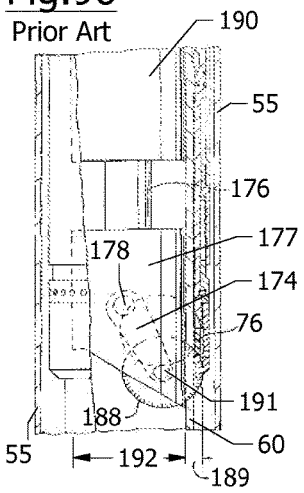
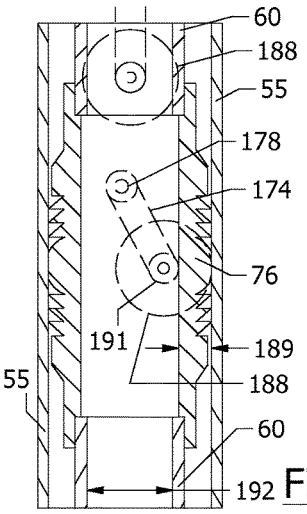
Fig.97
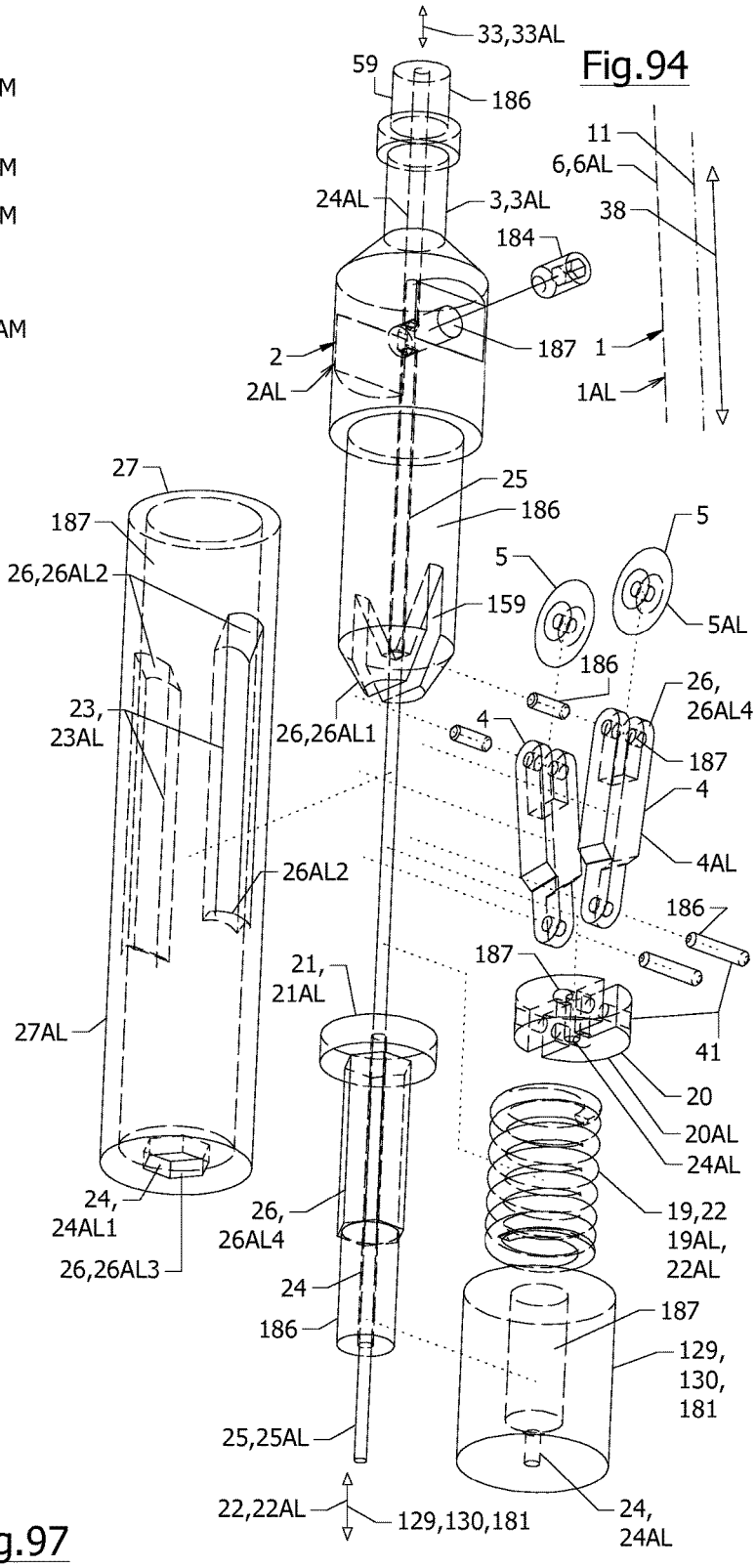
Fig.94

2
2AN
142
1
1AN
130

192,192AN1
192,192AN2
Ø 192, 192AN3
3, 3AN1
5AN1
5
4AN1
4
195
195
Ø 192, 192AN4
27, 27AN1
2AN1
5AN2
3, 3AN2
4AN2
1
1AN
19, 19AN2
2AN2
2
23, 23AN2
2AN
130
27, 27AN3
3, 3AN3
142
5AN3
4AN3
23, 23AN3
6,6AN1
6AN2
2AN3
6AN3
21, 21AN3
25, 25AN
193

33,33AN1
24, 24AN
95
185
3AN1
184
5AN, 5AN1
4AN, 4AN1
142
195
195
1
1AN
19, 19AN1
23AN1
2
2AN
27AN1
5AN, 5AN2
3AN2
4AN, 4AN2
23AN2
130
27, 27AN2
3AN3
5AN, 5AN3
4AN, 4AN3
19AN3
27AN3
23AN3
21AN3
53-57,60, 76,78,134
33,33AN2 22,22AN
25AN 3
2
2AU
2AU1
141

185
194
129
193
Ø 192
4AU, 195
3AU, 198
4, 197
5, 5AU, 196
2
2AU
2AU2
6,6AU
1
1AU
142
9,9AU
7AU
7
8
8AU

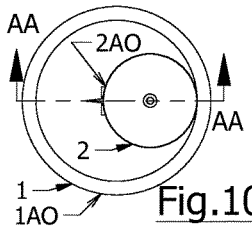
Fig.103
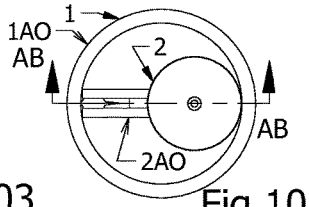
Fig.105
Fig.107
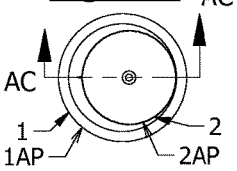
Fig.109
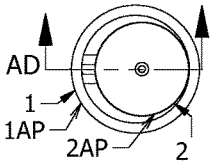
Fig.104
SECTION AA-AA
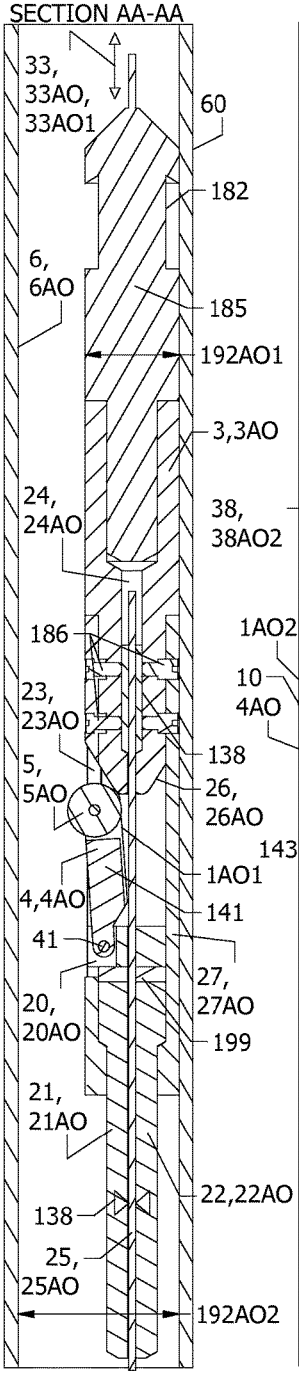
Fig.106
SECTION AB-AB
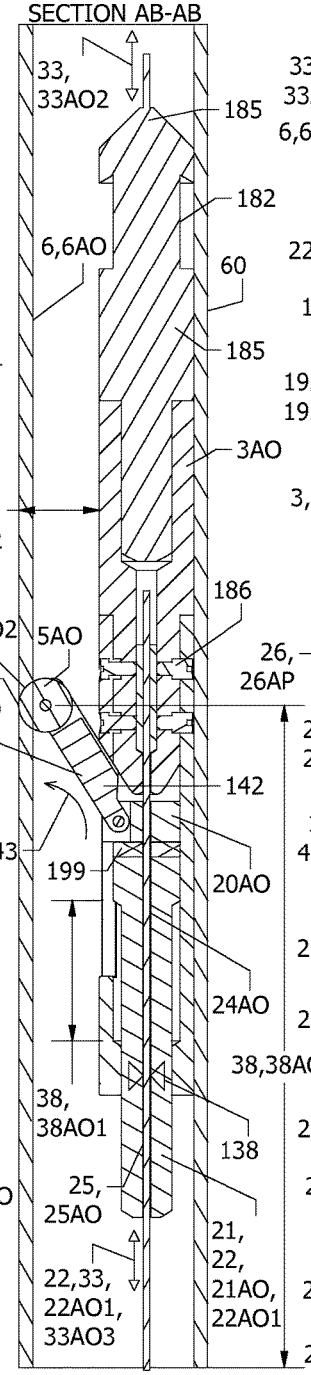
Fig.108
SECTION AC-AC
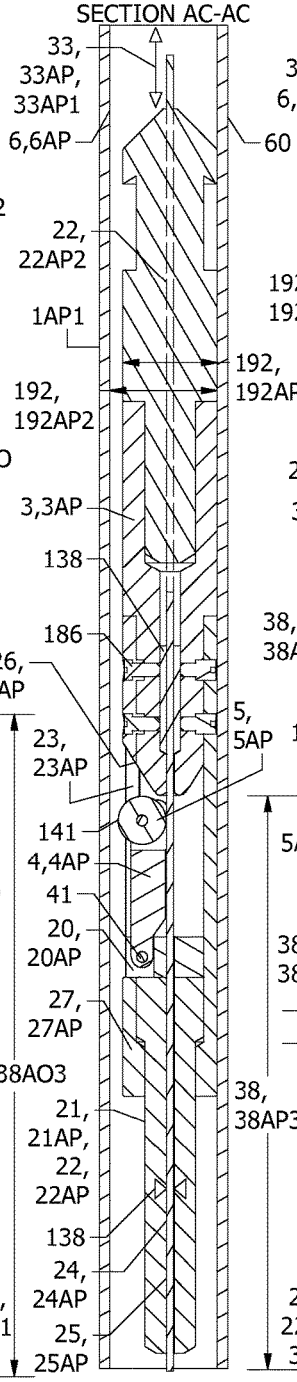
Fig.110
SECTION AD-AD
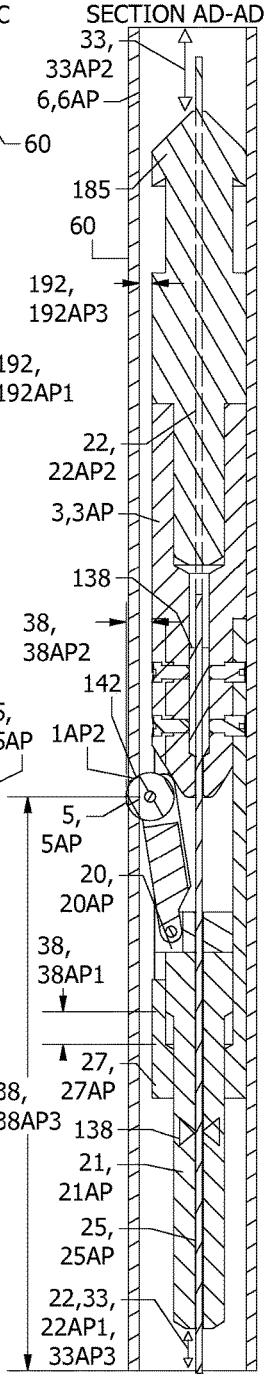

Fig.113
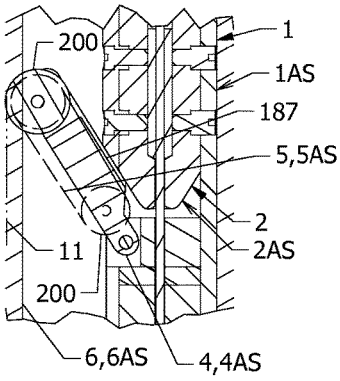
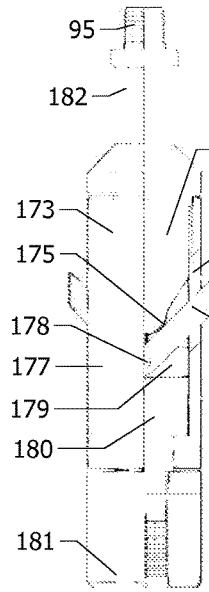
Fig.114
Prior Art
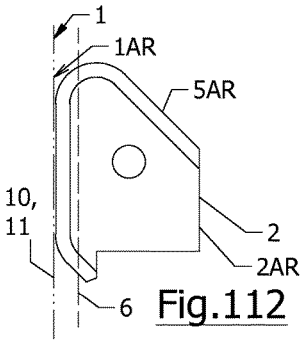
Fig.112
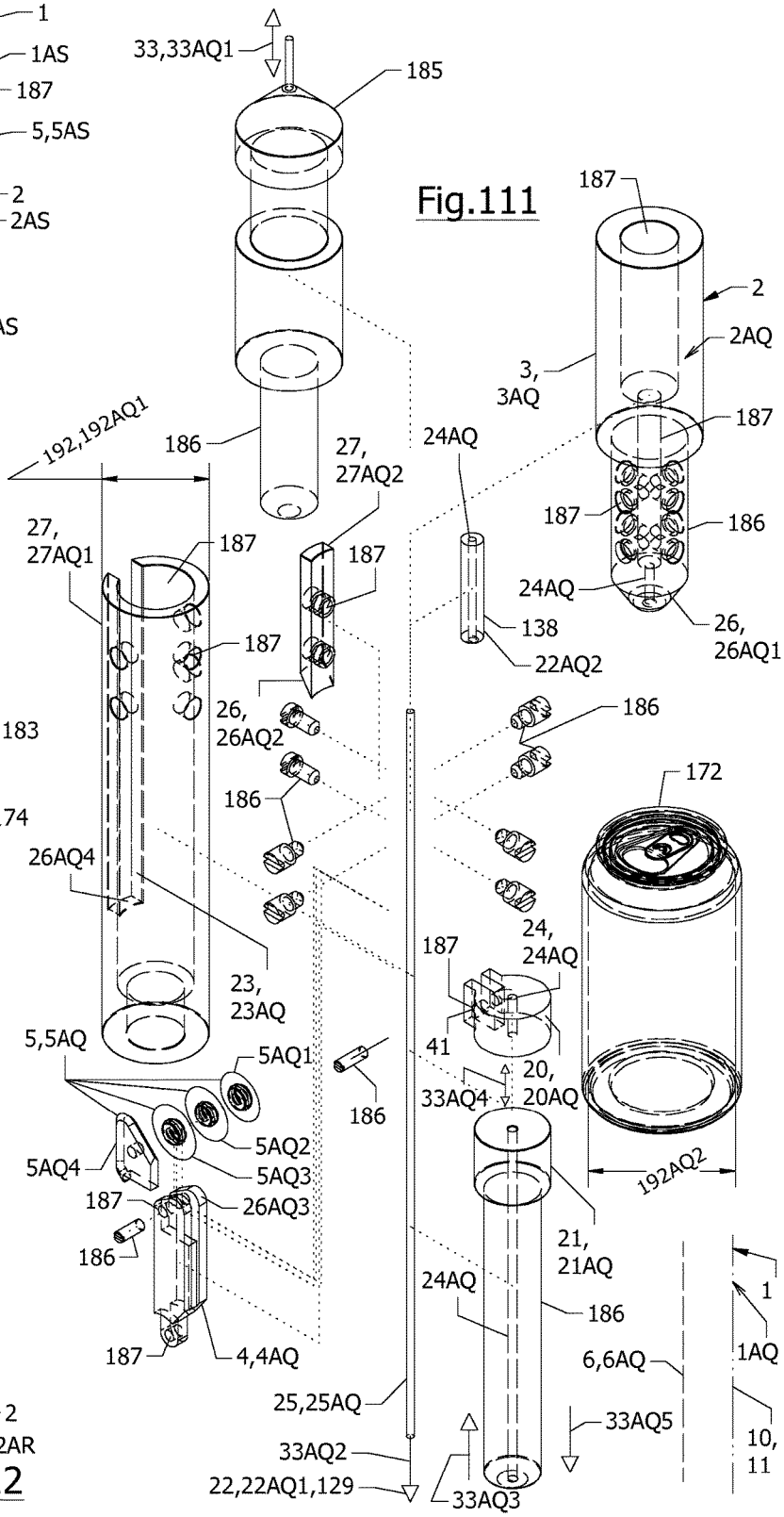

SECTION AE-AE

DETAIL AF

SECTION AG-AG

DETAIL AH
AE
AG
AF
AH

APPARATUS AND METHOD FOR CULTIVATING A DOWNHOLE SURFACE

CROSS REFERENCE TO RELATED APPLICATIONS

The present application is a U.S. national application that claims the benefit of patent cooperation treaty (PCT) application having International Application No. PCT/US2014/045614, entitled "Apparatus And Method For Cultivating A Downhole Surface" and filed on 7 Jul. 2014, which is a continuation-in-part that claims priority to United Kingdom Patent Application Serial Number GB 1312157.9, filed on 5 Jul. 2013, first published under GB 2506235 A on the 26th of March 2014 and entitled "Apparatus And Method For Cultivating A Downhole Surface," and a continuation-in-part that claims priority to United Kingdom Patent Application Serial Number GB 1404121.4, which is a continuation-in-part of GB1312157.9, filed on 9 Mar. 2014, and entitled "A Simple Axial Longitudinal Well Surface Cutting Apparatus," all of which are incorporated herein in their entireties by reference.

FIELD

The present invention relates, generally, to methods and apparatus for cutting at least one longitudinal and/or transverse furrow that cultivates the surface of the wall of a subterranean well bore, conduit or cable for use with an ancillary apparatus or a spreadable substance. More specifically, the embodiments of the present invention include apparatus and methods usable for the preparation and cultivation of a surface of a wall of a subterranean well bore, a conduit or a cable using an arcuately shaped or arcuately engaged cutter and scraper linkage arrangement that can be dragged along or across said surface by selectively string hoisting said apparatus, which can be used to separate a plane of said surface into longitudinally and/or transversely arranged wall surface regions, convexly protruding from the deepest point of a concave furrow that is cut into said surface's plane. Further, the embodiments of the present invention include an arcuate cutter and scraper linkage arrangement that can be engaged to a subterranean surface to cultivate longitudinal and/or transverse furrows that can be usable to separate a subterranean surface into a plurality of planes and associated separate surface regions in preparation for use by ancillary equipment comprising, for example (e.g.), milling tools and scab liners, hangers or packers using metal or fibrous components, and/or a spreadable substance comprising, e.g. downhole acid treatments, cements or resins.

BACKGROUND

The art of subterranean wall surface preparation is, in general, silent to the cultivation of a wall surface, whereby it is conventional to use a precise cutting treatment comprising the use of, e.g., knives and chemically corrosive jets, or to use a non-intrusive scraping treatment that attempts to remove debris without damaging a wall surface with, e.g., lightly brushing, jetting or scraping with downhole well clean-up tools, or the convention can comprise the complete destruction of a wall surface using, e.g., explosives or milling. The present invention can, like the arts of agriculture and horticulture, use primary and secondary cultivation means that can be considered less precise and which do not attempt to destroy a wall surface within a subterranean well, though they may be used to weaken a wall surface in preparation for subsequent destruction.

Agriculture and horticulture use various arcuate engagement arrangements, e.g. ploughs, harrows, tillers and filament-like weed trimmers that can flexibly drag a member to scrape a surface and, e.g., spread substances, or form furrows or perform relatively rough but selectively limited cuts using a kinetic drag force focused by an arcuate path, arcuate shape and/or the concave sides of the furrow as it is deepened.

In a manner comparable to the agricultural or horticultural arts, subterranean wells and any debris therein can be cut, dug or tilled to remove or bury said debris or other debris or cables within a well like rocks are removed from soil or like weeds are cut and buried in soil. Cultivation can further comprise surface preparation other than cutting, digging or tillage. For example, like cultivation of a garden's soil surface, subterranean cultivation can comprise the application of a spreadable substance with a scraper member to dissolve, repair, grout and/or line a subterranean wall surface.

Like conventional cultivation, subterranean cultivation can comprise primary and/or secondary categories, wherein the primary category can comprise digging or furrowing into a wall surface, which itself can comprise various cutting, ploughing, harrowing or tillage means oriented longitudinally and/or transversely to the axis of a well or to a cultivating apparatus's hoistable shaft's axis. The second category can comprise, e.g., the placement of substances, chemicals or incendiaries upon a wall surface to change its structure for subsequent use.

Chemical compounds comprising, e.g., explosives, gelled fluids, acids, cements, resins and plastics or fibrous materials, can be applied to a subterranean wall surface during its cultivation, which is comparable to applying fertiliser, manure and lime during surface farming cultivation.

Cultivation of a subterranean wall surface can comprise, e.g., using acids to dissolve or fluid jets or incendiary devices, like explosives, to remove or bury debris within a well, whereas the agricultural form of cultivation may use chemical herbicides or incendiaries to "burn-down" and/or use weed trimmers to sever and kill weeds.

Cultivation of a subterranean wall surface can comprise a middle ground between the conventional propensities for precise cuts circumferentially around a wall surface that, generally, require a consistent surface material to avoid unacceptable vibration and/or burying of the cutter, or the complete destruction of the wall surface, wherein the present invention can perform the middle ground intrusive intervention into various materials comprising one or more wall surfaces simply and more cost effectively. For example, the downhole adaptation of, e.g., a weed trimmer apparatus equipped with a super abrasive filament-like scraping member to arcuately deploy and cut a dichotomy of bores', conduits' and cables' surfaces within a subterranean well using the rotated arc-shaped path of a flexible and arcuately engaged filament-like scraping member that can more effectively cut such surfaces, albeit with less precision across a selectively limited surface area focused by the concave sides of a deeper furrow with each subsequent pass of the scraping member.

Conventional and prior art downhole cutting can be divided between precision cuts and those which are not intended to be precise, wherein both are generally oriented transverse to the longitudinal axis of the well. Relatively precise downhole cuts can use, e.g., knife, explosive, chemical and/or abrasive grit cutters to, generally, target and affect a relatively narrow wall surface area for the purpose of, e.g., severance. Downhole cuts that are not precise can comprise, e.g., milling or explosives that, generally, target a single cut face and are intended to cut or abrade portions to destruct a large wall surface areas along a single cut face.

Conventional and prior art well bore cleaning can comprise cutting along the longitudinal axis to clean and remove debris from a wall surface while leaving the original wall surface relatively unaffected.

Conventional and prior art well bore cleaning and cutting can comprise, e.g., cutting and honing a polished bore receptacle (PBR) at the top of a liner for a tie-back seal stack mandrel and/or packer wherein the objective is to refurbish the original wall surface.

Conversely, cutting or scraping with a scraping member of the present invention can include: a first feature comprising, e.g., proximal axially longitudinal and/or proximal axially transverse cuts that can be comparable to furrows or, alternatively, e.g., conventionally shaped furrows that cut a surface and perforate through the opposite wall surface; and a second feature comprising, e.g., a scraper that urges or squeezes a spreadable substance into furrow cuts or perforations.

Methods and apparatus of the present invention can cultivate a subterranean wall surface, which is not conventionally practiced nor taught within prior art, to provide significant benefits. The references cited below, typical of prior art, generally pertain to surface treatment practices, that can be adapted according to the present invention, but which do not provide a system for cultivating a wall surface. The present invention can provide the additional benefit of using arcuately engaged scraper members to prepare a downhole surface for subsequent use, which can be usable with conventional wireline, slickline, coiled tubing and drill strings. Various exemplary prior art has been cited, wherein other unreferenced prior art can also be adapted by those skilled in the art of modification and/or practice who will appreciate that various modifications, additions and substitutions are possible, without departing from the scope and spirit of the invention as disclosed herein. To the extent possible, since applicable conventional practice and prior art do not exist for cultivating a subterranean wall surface, various exemplary prior art is discussed herein.

For example, prior art well surface treatment and apparatus, e.g. EP 1,416,118, U.S. Pat. No. 7,757,769, U.S. Pat. No. 7,861,787, U.S. Pat. No. 8,418,755, WO 2006/048210 and WO 2007/101444 teach the positioning of an apparatus, generally comprising a cutter, packer and/or jet nozzle, and the releasing of a substances into a region that can be cut, perforated or fractured, wherein prior art is silent to the need for arcuately extending and engaging a draggable cutter to cultivate a wall surface with kinetic drag force applied by a scraper member to prepare the wall surface for improved spreadable substance engagement, reagent operation and/or ancillary apparatus engagement.

Prior art, e.g. EP 1,790,779 B1, teaches large scale method and apparatus for trenching that are oversized for use within a well bore. Various prior art, e.g. EP 1,840,325B1 and WO 2005/052311, teach the application of a spreadable substance like cement and use agriculture terminology like "tilling the well with a metal casing" but are silent to the art of longitudinal furrowing, transverse furrowing with a filament-like cutter and/or forming a lattice of furrows to cultivate a wall surface.

Various prior art, e.g. U.S. Pat. No. 8,376,043 B2, U.S. Pat. No. 6,148,918, U.S. Pat. No. 7,559,374, U.S. Pat. No. 7,040,395, U.S. Pat. No. 7,997,354, U.S. Pat. No. 8,356,662 and WO 02/35055, can be adapted for use with the embodiments taught by the present disclosure, but said prior is generally silent to cultivation. Conventional practice and prior art has generally involved using filaments, springs, pistons and fluid jets engaged to a shaft or imbedded within a stabilizer blade that can be used to scrape a wall surface by cutting or jetting and removing engaged debris to "clean" the wall surface, but which are silent to cutting into and cultivating a wall surface and using the sides of a resulting furrow to further focus subsequent cutting to further deepen said furrow until it is a substantial concave cut. Other prior art, e.g. U.S. Pat. No. 6,494,272, use pistons with eccentric stabilizer blades for cutting or reaming of a wall surface to produce a substantially cylindrical wall surface plane, but which is silent to the forming, joining and/or reducing amplitude differences in a wall surface resulting from longitudinal and/or transverse cultivation of furrows.

Exemplary prior art cutters, e.g. US 2009/0308605, U.S. Pat. No. 7,631,702, US 2012/0193152 A1, U.S. Pat. No. 5,752,454, WO 96/28635, U.S. Pat. No. 7,575,056, U.S. Pat. No. 8,210,251, U.S. Pat. No. 7,588,101, U.S. Pat. No. 8,147,293, US 2008/0277118, US 2011/0053458 and WO 2004/092532, teach various milling arrangements, "harrowing" disks, "ploughing" cutters or casing shoes, "no-till" disk opening systems, cutting discs and/or jet cutting tools that seek to cut and destroy a portion of a surface and/or sever one wall surface from another to separate a wall completely, but these cutters do not use a furrow to further focus a cut using its concave sides or using a furrow to separate said wall into regions, wherein such prior art is silent to the need for less precise furrow concave shape guidance of longitudinal and/or transverse cultivating preparation of a wall surface to improve its subsequent use by an ancillary apparatus or spreadable substance.

Various prior art, e.g. U.S. Pat. No. 7,726,028 and WO 99/10675, teach the longitudinal cutting of a conduit or surface but are silent to arcuate downhole engagement of cutters to a wall surface so that said cutters can be flexibly engaged and be flexibly deflected from a wall surface to prevent, e.g., burying the cutters within the wall surface.

Other prior art, e.g. WO 93/19281 and WO 2009/121882, teaches the use of pivotal members for centralizing and stabilizing a milling or sealing assembly but are silent as to how a bascule-like pivotal arrangement can be deployed with scraping cutters within a relatively small diameter passageway and expanded into a significantly larger passageway, and wherein such prior art is also silent also to how a subterranean wall surface can be cultivated such that subsequent milling and/or sealing may become more effective.

Various exemplary prior art, e.g. EP 2,497,602 A1, describes super abrasive filaments that can be adapted for use with, e.g. U.S. Pat. No. 2,708,335, U.S. Pat. No. 4,926,557, U.S. Pat. No. 4,942,664, U.S. Pat. No. 7,966,736, U.S. Pat. No. 7,979,991, US 2011/0005185 and US 2012/0266705, and alternatively, other prior art, e.g. U.S. Pat. No. 6,052,907 and WO 2012/071636, includes the use of more rigid cutters in place of, e.g., flexible filament cutters; however, this prior art does not teach or disclose cutting or furrowing into a surface of a wall of a subterranean well bore, conduit and/or cable to form longitudinally aligned, overlapping and/or crossing furrows therein, which can be used to further separate a plane of said surface into a plurality of planes and associated separate surface regions for use by an ancillary apparatus or a spreadable substance engaged thereto.

Scraper member embodiments of the present invention may also be deployed using various arcuate linkages and devices described in the existing art, e.g. U.S. Pat. No. 5,575,333, U.S. Pat. No. 5,785,125, U.S. Pat. No. 7,090,007, U.S. Pat. No. 7,866,384 and U.S. Pat. No. D662,942, which can be adapted for use with the embodiments of the present invention.

Existing actuating devices that are suitable for downhole use, e.g. U.S. Pat. No. 4,762,179, U.S. Pat. No. 5,127,477 and US 2011/0232969, could be adapted for actuating and deactivating various embodiments of the present invention.

Various existing spreadable substances, e.g. EP 2,071,003 A1, U.S. Pat. No. 5,127,473, U.S. Pat. No. 7,325,603, can be adapted for use within the disclosed scope and spirit of the present invention. Various other prior art related to the application of a spreadable substance, e.g. US 2012/0285696, teaches an adaptable diameter deployable through conventional diameter changes that is silent to deployment through a very narrow passage with expansion to a substantially larger passage that can be adapted for use with various scraper member applications; whereby, these patents and applications do not teach or disclose the methods and apparatus of the present invention.

Other prior art, e.g. U.S. Pat. No. 6,116,344 and US 2013/0014957, teach side-tracking and make reference to a "harrow" application or provide means for re-entry into a side-track, but this prior art is silent to wall surface preparation prior to milling a side-track window and/or subsequent entry or re-entry into the side-track using a portion of a cultivating apparatus selectively arranged to be left downhole.

Prior art also teaches the use of filament wound material, fiberglass cloth wound material and composite plastics, e.g. US 2013/0048271, but is silent to the use of such materials within methods and apparatus of downhole cultivation to, e.g., provide a means of boring through a tool purposely disposed of downhole after initially being used to cultivate and/or scrap a spreadable substance across a wall surface to ensure its engagement.

Various component member parts of the present invention can include the use of such devices as disclosed in, e.g. US 2005/0205264, US 2007/0227735, US 2012/0061098 and WO 2005/027615, which can be adapted for use within methods and apparatus to provide benefit according to the scope and spirit of the present invention.

Prior art disclosures in, e.g., U.S. Pat. No. 6,478,093 B1 are silent to a species of longitudinal downhole cutters having a low complexity and low diameter to length ratio that falls within the larger genus of longitudinal cutting. In addition, the prior art is silent to axial string force driven downhole furrow cutting with long longitudinal cuts not generally practiced, albeit various disclosures of coupling and packer cutting lessons applicable to limited axial distances or disclosed drawings that can be superficially compared by those unskilled in cutting within the small dimensions of a downhole space or the need to provide member part thicknesses sufficient to withstand downhole forces.

Prior art addresses the splitting of a relatively short axial length of a conduit coupling and/or packer within larger well bore diameters, but is generally silent to a low complexity means of splitting long tubing lengths from within diameters smaller than a soft drink can.

Prior art U.S. Pat. No. 6,478,093 B1 teaches an apparatus and method for installing and removing packer assemblies from a subterranean well that primarily uses a chemically reactive longitudinal cutter device that is lowered into the well and activated by use of conventional wire line equipment. Alternatively, U.S. Pat. No. 8,322,422 B2 teaches a jetting tool, inside a tubular element, which effects a high-pressure fluid flow from the jetting tool to produce a longitudinal cut. Furthermore, U.S. Pat. No. 5,924,489 discloses a sloped cut line midway between a axial transverse and axial cut, while U.S. Pat. No. 2,407,991 and U.S. Pat. No. 5,720,344 disclose longitudinal explosive cutting apparatus and methods, and U.S. Pat. No. 4,396,065 teaches an electrical arc that is usable to provide an axial longitudinal cut. While the prior art may be applicable to short longitudinal cuts within large conduit diameters, they are generally too complex, if usable, to efficiently cut long lengths of small diameter tubing.

While drawings for a downhole tool usable in larger well bore diameters can be theoretically scaled down, in practice intricate components become too small to effectively machine and too weak to withstand the forces of cutting the quality of steel that can be used to contain the pressures of a subterranean well.

Generally, prior art is silent to the working space required by a cutter, whereby the body of commonly used American Petroleum Institute (API) specification 8.63 kilogram per meter (kg/m) or 5.8 pounds per foot (ppf) tubing has a 77.8-mm (3.063-in) radially outward upset coupling engaging a 60.33 millimeters (mm) or 2⅜ inch (in.) outside diameter and 47.4-mm (1.867-in) inside diameter tube body, which is smaller than the inside diameter of a common soft drink can.

The difficulty level of working within common production tubing is readily visualized using a United States (US) standard sized soft drink can, which is similar to soft drink cans worldwide, wherein a US soft drink can is 122.68-mm (4.83-in) in height, with a 54.1-mm (2.13-in) diameter at the lid, and a 66-mm (2.60-in) diameter at the widest part of the soft drink can body, wherein said soft drink can will not pass through API 73.03-mm (2.875-in), or smaller, tubing.

Rapidly rotating cutting wheel dimensions are taught in the U.S. Pat. No. 7,575,056 B2 lessons for a transverse tubing cutter, which is scaled to fit within, e.g., a conventional soft drink can's 54.1-mm (2.13-in.) diameter at its smallest longitudinally transverse dimension. Such lessons are, however, silent as to how such a transverse cutter could be turned to cut longitudinally because the diameter of the cutting wheel is marginally less than the diameter of cutting tool, whereby the diameter of a driven hinge arrangement would preclude disposing the cutting wheel longitudinally. The arrangement of U.S. Pat. No. 7,575,056 B2 can only just accommodate the motor and cutting wheel without including the drive hinge.

Due to limited downhole space, prior art generally favours the use of chemicals and explosives within smaller diameter tubing, while electrical motors and rotational cutters are favoured in larger diameters, wherein almost all prior art focuses on cutting transversely to the well's axis or transversely severing a conduit or transversely separating a conduit using a short longitudinal cut across a coupling or hanger/production packer to split the connect and release the conduit from its lower end engagement. For example, EP 2 530 238 B1 and WO 2012/164023 A1 teach a motor/pump actuated and motor rotated pivot arm that is used to provide a transverse axial cut that cannot be easily oriented to a longitudinal rotation or arranged to effectively use a filament cutter. Similar downwardly and laterally orientated and transversely rotated arrangements for an under reamer pivot arm are taught in U.S. Pat. No. 2,749,187 and US2013/0299248, A1 which are similar in configuration and orientation and, thus, similarly unsuitable.

The lessons in US 2010/0258289 A1 and US 2013/0241742 teach similar pivotal arm arrangements, but the applications are silent to the use of transversely rotated filaments and the provision of a pivot arm of sufficient strength to efficiently cut steel while fitting within, e.g., the transverse dimensions of a soft drink can sized tubing that can laterally expand to larger diameter surface casing surfaces.

For example, to cut the 6.45-mm (0.254-in) wall thickness of API 8.63-kg/m (5.8-ppf) tubing with a 60.33-mm (2⅜ in) outside diameter and 47.4-mm (1.867-in) inside diameter, all of the arrangements described in U.S. Pat. No. 6,478,093 B1 must fit through the tubing's inside diameter, which is 72% of the diameter of a soft drink can (47.4-mm/66-mm). The disclosed rapidly rotating cutting wheel would require a minimum diameter of 25.6-mm (1.008-in) if an axle diameter of 6.35-mm (0.25-in) is added to twice the pivot arm journal radius of 3.175-mm (0.125-in) and twice the cut wheel radius of 6.45-mm (0.254-in), which is necessary to secure the cutting wheel with sufficient cutting wheel depth to just cut through the tubing wall. Subtracting the cutting wheel diameter of 25.6-mm (1.008-in) from the tubing inside diameter of 47.4-mm (1.867-in) leaves 21.8-mm (0.86-in), which is 33% of the diameter of a soft drink can (21.8-mm/66-mm). Obviously, it is impractical to fit a carrier, mechanical gears or belts and an electrical power system, of sufficient strength and durability to drive a rapidly rotating cutting wheel, within 33% of the diameter of a soft drink can. Accordingly, U.S. Pat. No. 6,478,093 B1 is silent to a viable means of longitudinally cutting a common API 2⅜" tubing conduit with anything other than the disclosed chemically reactive longitudinal cutter.

Additionally, e.g., U.S. Pat. No. 3,749,187, U.S. Pat. No. 6,615,933 B1, US 2013/0299248 A1 and US 2013/0048287 teach downhole tools mountable on a drill string, which are disclosed as casing cutters, under-reamers and/or expandable stabilizers, and which can radially deploy extendable members, such as stabiliser blades or cutters that can use the relative axial movement of a drill string within a large bore hole. However, all of these patents and applications are silent to practically arranging the apparatus to form a longitudinal cut with slickline hoisting string within small diameter tubing.

Alternatively, various prior art disclosures can appear visually similar, despite having an intended purpose contrary to the present invention. For example, e.g., Huntings International provides a conventional slickline anti blow-up tool and Clapp et al. (US 2013/0092372 A1) teaches an anti-blow-up device or brake that is suitable for preventing tool strings from being blown up-hole inadvertently by fluid flow that can appear visually similar to the embodiments of the present invention, but which teach and serve a contrary purpose.

Additionally, various combinations of prior art are illogical and, therefore, are not part of a logically combinable state of the art. For example, someone skilled in the art would not consider combining a tool used to clean a surface with a tool used to destroy the surface because they serve contrary purposes. Like virtually every mechanical device of any complexity, the present invention can use wheels, springs, pistons and other common components. For example, the present invention can use a cutting wheel that can allow rotation of the cutting edge, whereby said rotation is a frictional improvement but not a requirement of a draggable cutter arrangement of the present invention that provides a greater overall benefit than the sum of the benefits associated with the parts used.

Prior art of the present inventor, e.g. U.S. Pat. No. 8,387,693, GB 2471760, GB 2484166, GB 2486591 and GB 2492663, which is silent to bascule and arcuate linkages disclosed herein, can be adapted for use within the scope and spirit of the present invention, wherein, e.g., the milling of a surface may be significantly improved or avoided through wall cultivation, and wherein various furrow like tracks produced by a reactive torque tractor of the present inventor can be adapted to furrow cut walls surrounding an innermost passageway through arcuate engagement linkage adaptations that extend the tractor's wheels to a secondary wall surface.

Conventional and prior art cementing wiper plugs can be used to urge cement through a casing, or to urge cement through perforations within a casing, provided the wiper plug is sized for the casing, but even an adjustable size wiper plug is generally unsuitable for squeezing cement through and around a non-uniform wall surface. For example, US 2012/0285696 A1 is silent to squeezing cement and making large changes in size between, e.g., 60 millimeter (mm) or 2⅜ inch (in.) tubing and large casings, such as 244.5 mm (9⅝ in.) and 339.7 mm (13⅜ in.), as the plug is pumped through the changes in internal diameter.

Conversely, a low amplitude intrusion and/or spreading scraping member of the present invention, comprising, e.g., an adapted pedal basket with secured abrasive cutters and/or flexible arcuate pedals, can be used to scrape and separate wall surface furrows and/or perforations and squeeze, e.g., cement or resin into the wall surface furrows and/or perforations to force cement behind a wall for sealing or to grout the furrows or perforation holes and/or perforation cuts into or through a wall surface to prepare the surface for use by, e.g., an open hole or cased hole inflatable packer.

Cultivation of a surface of a wall of a well bore, conduit or cable can comprise, e.g., primary cutting using a scraper member to provide cutting or tillage and/or secondary scraping cultivation to smooth resulting rough wall surfaces and/or apply or squeeze a spreadable substance across or into a wall surface in preparation for engagement of ancillary downhole equipment or other spreadable substances and/or linings to the wall surface. Conventional apparatus and prior art can be adapted to perform the first or primary and second or secondary features of cultivating a subterranean wall surface. It is important to adapt an apparatus so as to inhibit or prevent the burying of the apparatus within the wall surface during cultivation, wherein it can be selectively arranged to, e.g., form a non-binding furrow cut that can alleviate the propensity for pinching during knife blade cuts according the concave shape of said furrow.

The convention of attempting surgical precision, non-intrusive scraping and/or the complete destruction of a wall surface can cause unnecessary complexities resulting in tool sticking and/or tool failure within the downhole environment due to various contrary well elements comprising, e.g., a relatively strong circular shape formed by steel casing, cement and a surrounding non-homogeneous strata bore that can fracture or be comprised of unconsolidated minerals that are affected and decay at different rates during attempts to make precise cuts. Casing or tubing steel is purposely made to be resistant to cutting and intrusion into or severance of its wall surfaces, whereas cement and strata are significantly weaker. Additionally, downhole cables can quickly become tangled around downhole tools attempting to perform a task which can also lead to sticking and/or tool failure.

The problem of downhole intervention is further complicated by differing perspectives within the industry. For example, major service providers are positively incentivised by complexity and downhole problems because their profits are more apt to increase with increased complexity and hole problems than with simplicity and the lack of hole problems. Conversely, operators or producers must pay for complexity and hole problems and are, hence, incentivised to find simpler and more cost effective means. Prior to the consolidation of service providers initiated by the oil price crash of 1986, the service industry was very competitive and relatively efficient; unfortunately, the industry now faces an oligopolistic services industry that lacks the necessary competitive forces to be truly efficient and, as a result, the search for simpler and more cost effective methods and apparatus suffers.

The art of downhole wall surface preparation was initially simple and began with the use of ropes and cables, but has since progressed to more complex rotary drill pipe operations. The present invention amalgamates the lessons of other arts comprising, e.g. a horticultural weed trimmer, with the advances within the well conduit cutting art, e.g. super abrasive filament strands, to provide method and apparatus usable to provide simpler and more cost effective downhole wall surface preparation.

Prior art discloses the genus of wall surface preparation, but it does not anticipate the species of downhole surface cultivation, which is comparable to surface cultivation, and which can be used to prepare a wall surface for engagement by ancillary equipment or substances. Prior art is silent to subterranean wall surface cultivation, which can, e.g., use a bascule or filament arrangement and/or a furrow's shape to reduce a cut's precision while limiting the necessary area of wall surface removal. Accordingly, the present invention cannot be anticipated from prior art with sufficient specificity to solve the industry problems described herein.

Serious downhole problems can relate to tangling, sealing and/or sticking during severance which can be caused by the application of tension or compression associated with axial movement, or torque associated with axial rotation, whereby the resistance of steel tubing and casing to cutting, axial movement and/or axial rotation combined with the inclusion of cables necessary for various downhole operations involving valves, gauges and/or other downhole equipment, can cause conventional and prior art to be ineffective when, e.g., tools become stuck downhole.

Other cutting, sealing and/or removal problems can relate to a dichotomy of two or more materials, wherein the strength of various well elements associated with the circular shapes, diameters, depths and the location of bores, conduits and/or cables, relative to each other, that can cause a combination of problems that can inhibit or prevent access within a well and which can be very difficult to cost effectively solve.

A need exists for a simpler and improved removal of all or portions of a surface of a wall of a well bore, a conduit, or a cable using more reliable cutting or severance methods and apparatus that can be used across a combination of one or more well bores, conduits and/or cables of varying material strength.

Problems relating to excessive vibration and equipment failure, which can occur during the milling or cutting of bore, conduit and/or cable wall surfaces can cause tool failure and stuck equipment, which can prevent rig-less milling and cause problems for drilling rigs, which must remove a well's protective barriers to perform such work.

A need exists for improved milling operations, wherein such operations can benefit from first cultivating a subterranean wall surface prior to said milling or other secondary operations. A further need exists for replacing downhole milling with a simpler and less costly means, which is reliable and usable with rig-less operations when, e.g., sealing of the lower end of the well bore is required during, e.g., suspension, side-tracking and abandonment.

Other well surface preparation problems can relate to open hole side-tracks where kicking off of a cement plug to drill a branch from a suspended or abandoned main bore can be difficult and require several costly attempts when bottom hole assemblies (BHA's) tend to migrate away from harder rock and back into softer cement within the original bore, particularly when practitioners are uncertain as to how long to wait, or standby operations are perceived to be too costly to wait, for the complete curing of settable cement.

A further need exits for reducing the costs of surface preparation by: (i) reducing the complexity of wall surface preparation; (ii) demonstrating an easier approach to operators which overcomes the service company prejudice toward the profits associated with hole problems; (iii) providing and/or adapting conventional and prior art tools, according to the scope and spirit of the present invention, for use during cultivation; and iv) providing relatively small diameter tools that can be effectively used to change from a small diameter to a larger diameter within well bores and conduits to reduce the service company's investment in tools, spares and off-the-shelf variations so as to lower the cost of downhole wall surface preparations for operators while increasing service company profits.

The question being answered by the present invention is how the presently complex operation of subterranean wall surface preparation can be made simpler. Historically, the complex problems of subterranean wall surface preparation has not prompted skilled persons to modify or adapt the closest prior art because, despite having the means to cut rock and steel, persons skilled in the art of subterranean wall surface preparation are not skilled in the art of cultivation whereby it is perceived that rock and steel are too hard and too dense to apply the art of cultivation.

A simpler means of cutting cables and/or rig-lessly milling wall surfaces within a well is needed because cables can cause serious issues comprising, e.g., leak paths and/or the tangling and sticking of tools, which is costly and can be dangerous, while the vibrations caused by milling can be equally problematic with the destruction and/or sticking of downhole tools. Combining the teachings of the art of cultivation with subterranean wall surface preparation has not, generally, been afforded a reasonable expectation or likelihood of success because longitudinal cuts along a well bore are generally not practiced and a single transverse cut across a well bore can be complex enough without undertaking numerous transverse longitudinal cuts. Surprisingly, however, once the problem is formulated and overcome using flexible arcuate engagements it becomes easy to see how the practice of primary and secondary cultivation can be applied to various complex problems to simplify and alleviate them.

It is not the practice within an oligopolistic services market, where 75% of the service market is controlled by four companies, to carry out experiments with adaptations of simple and low profit margin downhole equipment to determine alternatives to the perceived higher profit ways of overcoming the problems of a real or imagined technical obstacle. The adaptation of cultivation to a subterranean wall surface has the surprising result that, e.g., cutting furrows with a flexible arcuate scraper can cut through various materials and prevent tool sticking through a furrow like shape or by disposal of a part of a cutter, e.g. an abrasive filament, downhole while the dislodging of debris to form wall surface regions can be usable to treat and/or avoid milling entire wall surfaces.

Various embodiments are disclosed so as to be appreciated by persons in the arts of downhole tool adaptation and/or use, wherein only the details necessary for elucidating various solutions, which lay outside of conventional practice or the art of downhole wall preparation, are provided. Various aspects of the present invention lie in realizing what the problem is, e.g. using a less precise and less intrusive form of wall penetration and/or preparation that, once realized, may be obvious, and whereby the solution may, in practice, involve minimal apparatus adaptation and/or method steps. Accordingly, adaptions for the subterranean cultivation of a wall surface could not have been obvious prior to disclosure, otherwise such cultivation would have been taught within prior art and conventionally practiced.

A need exists for a means of cutting that is intermediate to conventional severance and conventional milling, wherein the controlled slicing or slot cutting in or through one or more of the surfaces of a wall of a well bore, conduit, and/or cable can be cost effectively implemented without a significant risk of becoming pinched by, or stuck within, the edges of the wall surface cut.

A need exists for cutting and/or avoiding tangling within downhole cables during the treatment of various wall surfaces, which may comprise strata, cement and/or metal and which can have either relatively thin walls or relative thick walls with a variety of surfaces and materials, wherein significant benefit is realized by using a smaller number of tools that can be used extended and retracted from a relatively small diameter to a relatively large diameter for engagement to and disengagement from a wall surface during treatment of the wall surface.

A need exits for removing the necessity of milling operations or an improvement to such milling operational procedures by first cultivating a wall surface to reduce the vibration and improve the efficiency of milling, reaming and under reaming operations and jointed and coiled string operations from drilling rigs and rig-less arrangements.

A need exists for improved preparation of wall surfaces and cementing within open hole suspension, abandonment and side-tracks. A further and related need exists for improvements in setting cement plugs, improvements in the strength of cement plugs and improvements in securing cement to strata and/or casing.

A related and significant need exists for providing improved and/or more efficient means of sealing wells by squeezing cement into perforations, fractures and/or proppant fractures formed by the proliferation of shale gas and tight sand development that purposely fracture rock formations and insert proppant to prevent the rock fracture from closing and sealing, which make the rock significantly more productive and exponentially harder to seal at the end of a well's economic life, when flow from the fractures can represent an environment and safety concern.

Small diameter well intervention and wall surface preparation tools, necessary to cost effectively access many wells, can lack sufficient metal thickness and associated strength to expand from small diameters of tubing to the large diameters of casing, whereby the variety of tool sizes and tool spare part inventories necessary for each conventional tubing and casing size are expensive to build and maintain.

A need exists for small diameter tools of sufficient metal thickness and strength to cut wall surfaces longitudinally and/or transverse to the longitudinal axis of a well by expanding from a smaller diameter commonly used for tubing to a larger diameter commonly used casing to reduce the cost of building and maintaining a tool set capable of wall surface treatment.

A related need exists for more efficient and cost effect subterranean wall surface preparation that can reduce costs for operators and provide service profit through simplicity, ease of implementation and the universal sizing and minimization of tool inventories and tool spare part inventories.

Various aspects of the present invention address these needs.

SUMMARY

Embodiments of the present invention generally relate to and provide methods (1) and apparatus (2) for cultivating a surface of a wall of a subterranean well bores, a conduit, or a cable by scraping and furrowing said surface. More specifically, the embodiments of the present invention generally relate to methods (1) and an apparatus (2) for cutting at least a longitudinal and/or transverse furrow (11) that cultivates the surface of the wall of a subterranean well bore, conduit or cable for use with ancillary apparatus (7) or a spreadable substance (8).

Embodiments include cultivating a subterranean wall surface using at least a first apparatus (2) member assembly that can be selectively hoisted across subterranean depths to urge a furrow (11) into a plane of a surface of a wall of the subterranean well bore, conduit or cable, using one or more scraping engagements to, thus, separate the plane into a plurality of planes with separate surface regions.

The embodiments include the at least one first apparatus member comprising an above subterranean surface hoistable shaft (3) member that can carry a flexible arrangement of a lateral extendable and retractable arcuate engagement linkage (4) member, which can be usable to carry and arcuately transfer a kinetic drag force from at least the shaft (3) through the arcuate engagement linkage (4) to at least a cutter and scraper (5) member, wherein the arcuate engagement linkage has a shape or movement-path of an arc flexibly extendable and retractable between said hoistable shaft and said surface of said wall to align the at least a cutter and scraper (5) member during one or more scraping engagements. Other embodiments may use an engagement mechanism (129) and/or actuator to further transfer kinetic drag force between the shaft (3) and cutter and scraper (5) through the arcuate engagement linkage (4).

The embodiments of the methods and apparatus of the present invention can cultivate, during one or more scraping engagements, along a surface of the wall and longitudinal to a well axis to form and use at least one substantial furrow, across a surface of the wall and transverse to the well axis using a filament-like arcuate engagement linkage to form and use at least one substantial furrow, or along and across a surface of the wall and longitudinal and transverse to the well axis to form and use a lattice of at least one substantial furrows formed by overlapping or crossing one or more scraping engagements, wherein these scraping engagements urge the at least one substantial furrow into said plane of the surface, and form a plurality of planes, to prepare separate surface regions for subsequent use by an ancillary apparatus (7) or a spreadable substance (8) engageable thereto. Various embodiments can use the concave shape of a furrow or the convex shape of the furrow protrusion from the deepest end of its concave shape.

Various other embodiments can use more than one apparatus member assembly to operate associated cutter and/or scraper members to further scrape the surface of the wall, a furrow and/or surface regions for subsequent use, including, for example, guiding or focusing subsequent scraping engagements toward the deepest concave point of a furrow, or engagement of an ancillary apparatus, or engagement of a spreadable substance.

Other embodiments can use an apparatus's flexible arrangement and one or more scraping engagements to apply a cutter and scraper member's kinetic drag force to form a substantial furrow across a dichotomy of separate surfaces or surface regions of well bores, conduits and/or cables to further form a plurality of planes and associated surface regions across a dichotomy of surfaces and/or surface materials.

Still other embodiments can include cutting and scraping a surface to increase the amplitude (12) of a substantial furrow's deepest concave protrusion into a plane of a surface of the wall to perforate (10) through the opposite surface plane of the associated wall to further separate surface regions and/or to reach another surface obstructed by the surface being furrow cut. Specifically, in an embodiment, the accurate engagement linkage or the at least one cutter and scraper member can be arranged to be disposed past the opposite surface of the wall to substantially penetrate and cut a furrow in a second plane of a second surface of the wall, or to perforate a furrow through a second opposite plane in a second opposite surface of a second wall.

Various related embodiments can perforate (10) through the opposite surface plane of a wall to axially sever the wall and/or circumferentially split the wall, to provide for subsequent separation or collapse of the transverse cross section of a wall of a conduit or cable.

Other embodiments can reduce the amplitude of at least a portion of a convex surface protruding from the deepest concave end of a furrow by cutting at least part of the convex protrusion and/or by scraping and removing debris circumferentially disposed between the deepest concave end of a substantial furrow.

Still other embodiments can include joining a plurality of planes into a continuous plane: by scraping the plurality of planes to cut and remove the convex protrusion from a furrow's deepest concave end until said plurality of planes meet and form a continuous plane at the point of said deepest concave end, or by scraping grout (13) into the furrow to fill the furrow's concave protrusion into the surface and, thus, bridge the furrow therebetween to form a continuous plane at the surface.

Various embodiments of the present invention can use: spring (19) force, gravity force, mechanical force (33), fluid force (34), electrical force (35), chemical reactive force (36), or combinations thereof (37), which can be transferred from the hoisting string, an actuator member (22) of the apparatus and/or the fluids within well, through an assembly member, to move one or more scraping engagements to provide a kinetic drag force.

Other related embodiments can use a mechanism of an actuator (22) member to communicate with and selectively activate or selectively deactivate at least another member of the apparatus (2), wherein said actuator member can be selectively arranged to be interoperable with other members to selectively and continuously or intermittently radially and laterally dispose a cutter and scraper member, which can be carried by an arcuate engagement linkage, to selectively provide kinetic drag force.

Various related embodiments can empirically measure the downhole parameters of a subterranean well, the surface being scraped and/or the disposition of members with a measurement (97) member which can be selectively arranged to initiate an actuator member's operation.

Still other related embodiments can comprise using: at least one of the three dimensions, time, temperature, movement and/or communication signals, which can be empirically measured within the subterranean well by a measurement member, to initiate an actuator's operation.

Various preferred embodiments can use agricultural teachings of a plough-like cutter and scraping member arranged with mainshare (167), foreshare (168), mouldboard (169) and/or coulter functionality that can also use a cut regulator (171) arcuate engagement linkage arrangement to plough (166) a surface to form a substantial furrow.

Various embodiments can use horticultural lessons of a filament-like (18) arcuate engagement linkage (4) cutter and scraper (5) member, which can be moved by an actuator (22) member to flexibly apply kinetic drag force to form a substantial furrow across a surface plane, across a plurality of planes and/or across a dichotomy of separate surface regions of a well bore, conduit and/or cable to form a plurality of planes.

Other embodiments can include arranging a coiled filament-like arcuate engagement linkage (4) cutter and scraper (5) member within a reel usable to spool the filament-like arcuate engagement linkage (4) cutter and scraper (5) member laterally.

Still other embodiments can include the use of a housing (27) with at least a piston (20, 21) disposable through an axial passageway (24) of the housing, between a first (3) and at least second shaft member (25) via an actuator (22), to urge the piston and an arcuate engagement linkage (4) member, having at least an associated pivot arm, through a lateral opening (23) in said housing via a hinge (41) between said piston and said pivot arm.

Related embodiments can include the use of a cam face with a pivot arm extension (142) or retraction (141) laterally to slide against at least one associated cam face (26) of a shafts, an axial passageway, a lateral opening and/or the subterranean surface (6), so as to arcuately urge the pivot arm carried cutter laterally into or laterally away from and axially upward or axially downward to provide the kinetic drag force of a scraping engagement along a subterranean surface longitudinally to a well's axis.

Still other preferred embodiments can include arranging a cable hoisting string and apparatus member assembly with a transverse dimension sized for passage through a well's lower end radial inward upsets associated with completion components and engaged with an American Petroleum Institute (API) specification tubing's smaller diameter, wherein the arcuate engagement linkage cutter and scraper member laterally transverse dimension is sizable for lateral extension to a larger diameter surface plane of a bore usable to place an API specification casing at the upper end of the well.

Embodiments of the present invention can include an apparatus member assembly that can be formed with a selectively: fixable, slideable, rotatable, shearable, or combinations thereof, member engagement mechanism that can be selectively usable to axially move (38) or rotationally move (39) the arcuate engagement linkage to apply said kinetic drag force.

In an embodiment of the present invention, the arcuate engagement linkage member can comprise a rigid (30) part that can be flexibly operable by a pivotal part, a flexible (31) part, or combinations thereof, which can be arranged to form a flexible linkage. The arcuate engagement linkage member can then be flexibly operable, via the pivotal part, flexible (31) part, or combinations thereof, for use, during the axial movement (38) or rotational movement (39) of the one or more scraping engagements, to apply the kinetic drag force. In an embodiment, the pivotal part or said flexible part of the arcuate engagement linkage member can comprise an elastic material (32), a bendable material (18), a hinge (41), or combinations thereof. In an embodiment, the pivotal part or flexible part can further comprise a bow or coiled filament (18), a bow or coiled spring (19), or combinations thereof.

In an embodiment of the present invention, the arcuate engagement linkage member can be axially or rotationally moved by the use of a member engagement mechanism (129), which can comprise a rotary, a mandrel and receptacle, a threaded coupling, a pinned coupling, a frictional coupling, or combinations thereof, which can be usable to further control an application of kinetic drag force. The member engagement mechanism (129) can be arranged to selectively use gravity force and the mass of the arcuate engagement linkage member to impart the axial or rotational movement of arcuate engagement linkage member. In an embodiment, the engagement mechanism (129) can be arranged to use selective changes in velocity or acceleration of a hoisting mechanical force (33), relative to said mass momentum of the arcuate engagement linkage member, to impart said movement. In an embodiment, the member engagement mechanism (129) can be arranged to be operable via a jarring force and an associated said axial movement (38), which was imparted by the mass momentum of the arcuate engagement linkage member against a tension of a hoisting string, or a diameter or planar change in the surface of the wall of the well bore, conduit or cable.

The member engagement mechanism (129) can further comprise a pressurized piston, a shear pin, a spring, a slip, or combinations thereof, for selectively operating an actuator (22) member within the downhole conditions, according to empirically measurable downhole conditions. The actuator (22) member can comprise a solenoid, a motor (42), or a pump (40) component, which can be selectively arranged to move said arcuate engagement linkage member by using the moving force to provide the kinetic drag force. In an embodiment, the actuator can be arranged to form a vibrating (46) member, which can be usable to vibrate the one or more scraping engagements to provide further kinetic drag force.

Embodiments of the present invention can include a method of forming and arranging an apparatus (2) member assembly to cultivate (1) a surface (6) of a wall of a subterranean well bore, a conduit or a cable by scraping at least one substantial furrow therein. The steps of the method include providing and selectively arranging the apparatus member assembly with an above subterranean surface string hoistable shaft (3) member for carrying a flexible arrangement of a arcuate engagement linkage (4), which can be laterally extendable and retractable and which can carry at least one cutter and scraper member (5), which can be draggable. The method can include arranging the arcuate engagement linkage to laterally transfer kinetic drag force from the shaft member through the arcuate engagement linkage, having an arcuate shape, or an arcuate engagement of the flexible arrangement and an alignment of the at least one cutter and scraper member, during one or more scraping engagements. The scraping engagements can occur along the surface of the wall and longitudinal to the well axis to form and use the at least one substantial furrow, across the surface of the wall and transverse to the well axis using a filament-like arcuate engagement linkage to form and use said at least one substantial furrow, and along and across said surface of said wall longitudinal and transverse to the well axis to form and use a lattice of the at least one substantial furrow. The steps of the method can further include arranging the apparatus member assembly for selectively hoisting the apparatus member assembly across subterranean depths to selectively operate the one or more scraping engagements and to urge the at least one substantial furrow (11) into a plane of the surface of the well, to separate the plane into a plurality of planes that can comprise separate surface regions (9), which can be usable by an ancillary apparatus (7) or a spreadable substance (8) engagable thereto.

Various other features of the present invention are further described in the claims.

BRIEF DESCRIPTION OF THE DRAWINGS

Preferred embodiments of the invention are described below by way of example only, with reference to the accompanying drawings, in which:

FIGS. 12 to 21 depict wall surface cultivation embodiments (G) to (M).

FIGS. 22 and 23 show diagrammatic embodiments (N) and (O).

FIGS. 24 to 36 illustrate prior art.

FIGS. 37 to 43 show rotary string embodiments (P) to (S).

FIGS. 44 to 46 depict completion intervention embodiment (T).

FIGS. 85 to 93 illustrate embodiment (AK) of the present invention in various actuation dispositions.

FIG. 94 and FIG. 95 depict embodiments (AL) and (AM) of the present invention in an isometric exploded view of an assembly and an interchangeable first shaft member, respectively.

FIGS. 96 and 97 show prior art disclosures of a pivot arm saw, and an associated scaled view of the saw within API specification conduits.

FIGS. 103 to 106 and FIGS. 107 to 110 depict embodiments (AO) and (AP) with a single pivot arm carried cutter within relatively large and relatively small tubing inside diameter tolerances.

FIGS. 111 and 112 illustrate embodiment (AQ) and (AR) in an isometric exploded view of an apparatus member assembly adjacent to a soft drink can and an elevation view of a knife-like cutter member usable therein.

FIG. 113 illustrates embodiment (AS) pivot arm arrangement usable with abrasive filament-like cutter.

FIGS. 114, 115 and 116 depict prior art showing: a brake tool usable to stop tools from being blown up hole, a prior concept silent to various aspects taught by the present invention and a wellhead back pressure valve.

FIGS. 117 to 122 illustrate embodiment (AT) demonstrating a diametrically opposed cutter arrangement with a hydrostatic actuator.

DETAILED DESCRIPTION OF THE EMBODIMENTS

Figures 1, 2, 3, 4, 5, 6, 7:
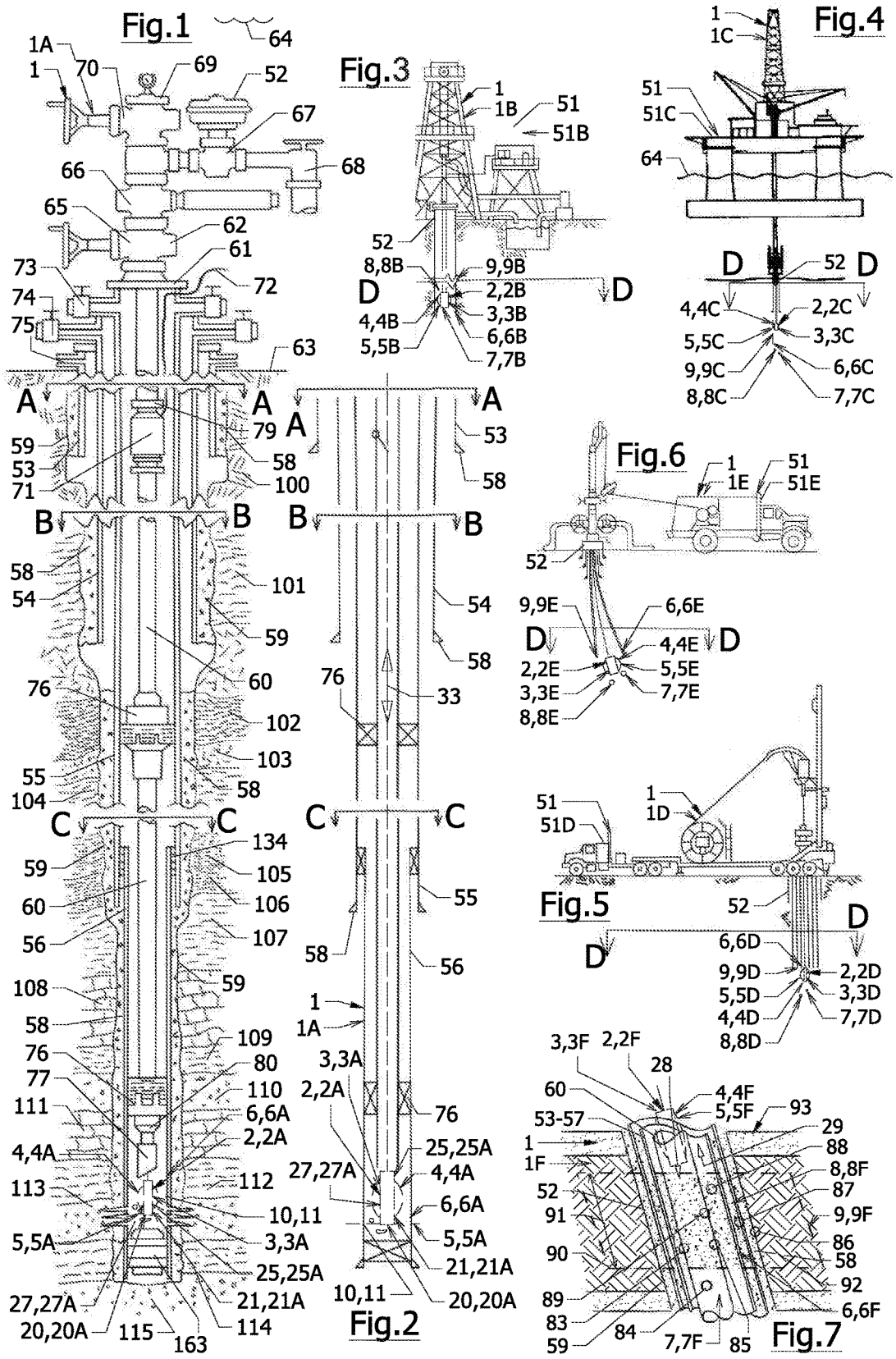
FIGS. 1 and 2 show embodiments (A) and various features of a subterranean well.
FIGS. 3 to 6 depict embodiments (B) to (E) using various rig types.
FIG. 7 illustrates an abandonment embodiment (F).

Before explaining selected embodiments of the present invention in detail, it is to be understood that the present invention is not limited to the particular embodiments described herein, and that the present invention can be practiced or carried out in various ways. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to persons of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation.

Various methods and apparatus of the present invention, generally, can use apparatus that are formed or adapted to cultivate a downhole wall surface for use by subsequent well operations, e.g. milling, in a manner comparable to, e.g., the agricultural and/or horticultural arts. Preparation of a subterranean wall surface can include separation of a wall surface into regions using a furrow cut within a well surface comprising, e.g., furrows within rock and steel, or preparations can include the cutting or burying of cables within the lower portion of a subterranean well bore that can be compared to tillage and the cutting and burying of weeds within soils. Invented apparatus and/or downhole conventional or prior art apparatus adapted according to the spirit of the present invention can be used with the invented method to cultivate a subterranean well wall surface by using a scraping member to arcuately extend a cutter via a linkage to, e.g., dislodge debris from, dig into, cut into, spread across and/or grout a furrow, crevice or feature associated with wall surface regions, longitudinally and/or transversely to the longitudinal axis of a well.

The present invention can, generally, use any conveyance means comprising, e.g., drill pipe, coiled tubing, wireline and/or slickline, and can be preferable to various conventional and/or prior art means comprising, e.g., the precise cutting of a downhole surface with, e.g., knives or the complete destruction of a downhole surface with, e.g., milling and/or explosives. Contrary to the precise cutting or complete destruction of a surface, the present invention provides a simpler and more cost effective approach to downhole surface preparation that can longitudinally and/or transverse longitudinally treat a wall surface to form a plurality of treated regions that can be used more effectively by ancillary apparatus or spreadable substances.

The present invention further relates to a hoistable axial longitudinal cutter apparatus with axial and transverse dimensions that can be suitable for one or more longitudinal cuts to one or more subterranean surfaces, within a range from small to large diameter tubing and/or casing that can avoid interference with longitudinal downhole cables with minimal of complexity, which can be easily and cost effectively machined, repaired, maintained and operated. The present invention still further relates to the downhole cutting of surfaces with a super abrasive filament that can cut cables, surfaces and longitudinally split surfaces with a minimal of complexity.

The present invention can prepare a subterranean wall surface using scraping spreader members to spread or cut a furrow or harrow using a coulter-like or cutter-like scraping member parts, that can scrape across a downhole wall surface using a flexible downhole draggable engagement and a deflectable arc-like engagement that can provide a kinetic drag force and can be radially extended and retracted from and to a hoistable shaft, which can be deployed through a well to cultivate or till a wall surface therein. A scraping member can perform primary wall surface cultivation comprising, e.g., cutting, abrading, ploughing and/or tilling a furrow in wall surface and allow debris to fall from the wall surface or to be carried by, e.g., a circulated fluid from the well or by another scraping member which can perform secondary cultivation comprising, e.g., scraping spreadable substances across a wall surface region or a plurality of wall surface regions to treat the wall region or regions and prepare them for subsequent use.

Accordingly, scraper members of the present invention differ significantly from convention well clean-up tools like casing and tubing scrapers, brushes, junk baskets, debris catchers, circulating subs, filters and various other downhole tools, which attempt to remove unwanted substances from a wall surface while avoiding the disfigurement or disruption of the wall surface being cleaned.

The present invention uses scraper members to affect a wall surface using a method that can be compared to cultivating a wall surface for use, or further treatment, using, e.g., any form of detergent, cleaning fluid, acid, dissolving fluid, cement, resin and/or any other type of substance applicable to a downhole wall surface.

The present invention can be operated with various actuators that can include the use of axial mechanical forces comprising, e.g., string tension and gravity applied to the mass of the bottom hole assembly (BHA), which can be pipe, electric-wireline, cable or slickline conveyed through a well bore, and axially disposed therein, to drag cutters along a well bore surface to urge transverse and/or longitudinal cuts by using the axial tension of the apparatus, pipe, wireline, cable and/or slickline to provide a kinetic drag force, which can be usable to urge a cutter into a wall surface, like a plough or disc urges a cut during cultivation. Alternatively, a motor actuator can rotate, e.g., a super abrasive cutter carried by a filament-like member to cut surfaces and cables, such as the use of a horticultural weed trimmer to cut fauna. After cultivation of the surface, the release tension can allow gravity assisted retraction of an arcuate linkage carried cutter from the wall surface.

Additionally, the low level of complexity associated with the transverse and longitudinal dimensions of the invented apparatus can be arranged to fit and can be used within the small confines of conventional production tubing. The apparatus of the present invention can also be enlarged to operate within the confines of production, intermediate, surface and conductor casing and/or a subterranean strata bore, without appreciable loss of functionality.

Methods of the present invention can use invented apparatus or adapt any conventional or prior art apparatus, according to the scope and spirit of the present invention, to cultivate a downhole wall surface in preparation for other operations comprising, e.g., milling, jetting, acid treatments, cementation, production, suspension, side-tracking or abandonment.

Various method embodiments (1A-1AU) and various apparatus embodiments (2A-2AU) of the present invention's claimed method embodiments (1) and claimed apparatus embodiments (2) are taught herein, wherein sequencing progresses from A to Z followed by AA to AU. Exemplary embodiments, substantially as described herein, with reference to: A) FIGS. 1 to 2; B) to L) of FIGS. 3, 4, 5, 6, 7, 12, 13, 14, 15, 16 and 17, respectively; M) FIGS. 18 to 21, N) FIG. 22, O) FIG. 23, P) FIGS. 37 to 38, Q) FIGS. 39 to 41, R) FIG. 42, S) FIG. 43, T) FIGS. 44 to 46, U) FIGS. 47 to 48, V) FIGS. 49 to 50, W) FIG. 51, X) FIGS. 52 to 54, Y) FIG. 55, Z) FIGS. 56 to 57, AA) FIGS. 58 to 59, AB) FIGS. 60 to 62, AC) FIGS. 63 to 64, AD) FIGS. 65 to 66, AE) FIGS. 67 to 68, AF) FIGS. 69 to 70, AG) FIG. 71, AH) FIG. 72, AI) FIGS. 73 to 77, AJ) FIGS. 78 to 79, AK) of FIGS. 85 to 93, AL) of FIG. 94, AM) of FIG. 95, AN) of FIGS. 99 to 101, AO) of FIGS. 104 to 107, AP) of FIGS. 108 to 111, AQ) of FIG. 112, AR) FIG. 113, AS) FIG. 113 and AT) FIGS. 118 to 123 and AU) FIGS. 80 to 84 and 102 to 103 of the accompanying drawings teach the cultivation of a surface of a subterranean well bores', conduits' or cables' wall surface, wherein because many varying and different embodiments may be made within the scope of the concepts herein taught, and because many modifications may be made in the embodiments described herein, it is to be understood that the details herein are to be interpreted as illustrative and non-limiting. It is to be further understood that member feature numbers followed by the embodiment letters (A to AU) and a further sequence number [e.g. 1AT1, 1AT2 for the retracted (141) and extended (142) cutter method (1) embodiment (AT) variations (1 and 2) of FIGS. 118 to 123] symbolise variations in member arrangement embodiments.

It is to be further understood that the practicality of increasing the scale of a downhole tool's transverse dimensions to fit within larger diameter well bores can be accomplished by those of common skill in tool construction; however, the scaling of a downhole tool's transverse dimension to fit within, e.g., the transverse dimension (192AQ2) of FIG. 112 of a soft drink can (172) represents the significant challenge of practicably reducing metal thickness and associated strength, wherein the benefit of providing a suitable tool of adequate strength to withstand downhole forces is of significant benefit because the percentage of wells producing through, e.g., tubulars (60) diameters of 88.9 mm. (3.5 in.) and smaller are drastically larger than those producing through larger diameter tubulars. Accordingly, embodiments of the present invention provide significant benefit over prior art by providing a suitably durable tool, which is capable of robust use within small transverse dimensions for a significantly larger number of wells, than that available by conventional tools or prior art.

The present invention embodiments teach how to practically provide transverse and longitudinal cuts within difficult and challenging transverse dimensions, which can, e.g., relate to slickline tool strings that have only a solid metal hoistable wire connection to surface winch that can conventionally be used to hoist tools within the smallest tubing diameters.

A slickline tool string, often referred to as wireline, generally comprises an assembly of tools connected to a 'slick' single wireline strand, which is used to hoist and deliver surface controlled impacts or jarring action, either upwards or downwards, to manipulate devices within a well bore. Additionally, various tools can be suspended from slickline and used to send signals or pulses through a string comprising a solid or insulated slick wireline strand.

Alternatively, various acceleration, velocity, time, pressure and/or temperature sensing tools may be engaged within a slickline BHA to actuate other tools, based upon various acceleration, velocity, time, pressure and/or temperature gauge readings. Generally, a gauging slickline run is made to both drift and measure the parameters at the desired actuation depth. After ensuring the tool string can be hoisted to the selected depth, and measuring the parameters for activation at the desired depth, the actuator gauges can be set to activate according to a desired acceleration, velocity, time, pressure and/or temperature protocol within the well.

Generally, a conventional slickline tool string can consist of: i) a wireline socket or rope socket for attaching the wireline to the tool string; ii) wireline stem or sinker bar for adding weight to sink the tool in the well bore against the well pressure and different gravity fluids encountered; iii) wireline jars, e.g., a spang link jar, hydraulic jar, tubular jar or knuckle jar, for magnifying the hammering effect of upward or downward movement; iv) a wireline knuckle joint for obtaining flexibility through the tool string; and v) a wireline functional apparatus comprising, e.g., a running or pulling tool for running and retrieving devices from the well bore or the apparatus of the present invention. Slickline tool assemblies can also comprise, e.g., centralizers to axially dispose the string, a roller stem to reduce friction, as well as wireline accelerators and shock absorbers to increase or reduce jarring forces. Slickline tools assemblies can have various coupling types comprising, e.g., sucker rod threads, unified threads (UN) or quick lock connections, which can provide a quarter turn rotated connection that can be stronger than a screwed connection.

It is to be understood that the embodiments of the methods (1) of the present invention can include using any tool suitable for any rig's bottom hole assembly, and selectively using the tension energy of the hoisting string, in addition to the mass and motion of the apparatus (2) of the present invention, at a selected subterranean depth associated with the desired subterranean well surface. It is also to be understood that the terms energy and force are used interchangeably because the purpose of using energy is to impart a force whereby, in practice, one cannot be separated from the other. Accordingly, at any selected depth, an actuating force, conventionally defined as mass multiplied by acceleration, can be usable to operate the apparatus (2) and form a longitudinal cut in the subterranean surface.

Referring now to FIGS. 1 and 2, the Figures relate to features of a subterranean well and show an embodiment (1A) of a method (1) and an embodiment (2A) of an apparatus (2), shown as a dashed line in the Figures. The left hand diagrammatic elevation view of FIG. 1 shows a slice through the subterranean strata with installed well equipment, and the right hand diagrammatic elevation view of FIG. 2 represents the same well, respectively, wherein section lines A-A, B-B and C-C are provided relative to the well and strata.

The method (1A) can be used to, e.g., form or use an apparatus's (2A) shaft (3A) member that can be hoisted into and out of the well from and to the surface. An arcuate acting centralizer (4A) member can radially deploy, e.g., an abrasive filament scraper (5A) member that can act upon a wall surface (6A) and, e.g., be axially rotated relative to the longitudinal axis of the wellbore to separate the wall surface into regions (9A) for use with an ancillary apparatus (7A) or spreadable substance (8A).

The method embodiment (1) is further usable with an apparatus embodiment (2) to, e.g., perform a mini-frac where the transverse longitudinal furrows (11), formed by a scraper (5) radially deployed from an arcuate linkage (4) and shaft (3), are treated with a spreadable fluid (8) carrying an ancillary proppant (7) urged into the furrows to fracture and further separate wall surface (6) regions (9).

Various apparatus (2A) arrangements, comprising various shafts (3A, 25A), pistons (20A, 21A) and housings (27A), can be usable to operate and arcuately engage a linkage (4A) carried cutter (5A) usable to scrape and furrow a wall surface (6A), and wherein unintentional well bore surface damage or damage to the cutter (5), prior to or after reaching a selected depth, can be avoided during apparatus (2) hoisting between the valve tree and the well's lower end by retracting the cutter (5).

An apparatus (2A) can be selectively hoisted to actuate the apparatus by engaging a portion of the well (52), e.g. the edge of the wireline entry guide (77), or by using an actuating apparatus member. The actuating apparatus member can be selectively programmed to activate at a selected formation pressure and hydrostatic pressure within the well to apply axial force to, e.g., the second shaft (25A) to impart axial movement to a piston (20A, 21A) and, thus, initiate coincidental forces between the apparatus assembly members, at the desired well feature, to urge the pistons within a housing (27A) and to operate a pivotal arrangement, e.g. a hinge, to axially and laterally dispose and force the cutter laterally and upward or downward through a lateral housing opening, into or away from a subterranean surface within the well, to form or retract from an axial longitudinal or axially transverse cut therein.

For example, a selectively placed longitudinal and/or transverse furrow-like cut could be made on or in between the tubing hanger (78) and wireline entry guide (77), which includes the subsurface safety valve (71), downhole control cable (72), packers (76), cross-overs or swages (80) and receptacles or nipples (79); or a selective furrow-like cut can be made on the liner below the entry wireline entry guide (77).

Selective hoisting of the apparatus (2A) can impart forces to initiate and promote axial movement and associated coincidental mechanical forces between the apparatus's members or between the cutter and subterranean surface (6) using, e.g., the weight of the tool string and/or bottom hole assembly against the momentum of hoisting and/or a subterranean surface of the well, like a nipple (79) or wireline entry guide (77), which can be usable to actuate or deactivate the apparatus by, e.g., moving a member piston into or away from another piston carrying a pivot arm and cutter on a hinge.

For example, apparatus (2A) actuation can be maintained by, e.g., a frictional slip engagement between shafts and pistons. After cutting a downhole surface, the frictional slip engagement can be sheared to allow the weight of the pistons and tool string to move downward, via gravity, to retract the arcuate linkage (4A), e.g. a pivot arm, carried cutter. Alternatively, a conventional electrical, hydraulic and/or chemically activated or deactivate actuator can be used with the apparatus bottom hole assembly to mechanically urge members or the pistons along a second shaft to extend and/or retract the pivot arm carried cutter.

Within the presently described invention, it is to be understood that the strata below line A-A of the FIGS. 1 and 2 represents any of the Quaternary and Neogene period or older epochs; with the strata below line B-B representing any of the Paleogene period, Oligocene, Eocene and Paleocene or older epochs; and strata below C-C representing any Cretaceous, Jurassic, Triassic, Permian, Carboniferous or older period late, middle and early epochs. It is to be understood that the strata below line D-D of FIGS. 3 to 6 represents any of the lines A-A, B-B or C-C geologic period epochs of FIGS. 1 to 2.

As subterranean wells (52) have many components, simplified well schematics (e.g. 52 of FIG. 2) are conventionally used to provide focus upon communicated aspects. Hence, it is to be understood that a schematic well diagram of FIG. 2 is equivalent to a more detailed well diagram of FIG. 1, below the section line A-A. It is to be understood that the various embodiments described in FIGS. 3 to 7, FIGS. 12 to 23 and FIGS. 42 to 86 can be used with the features of FIGS. 1 and 2, except where noted. Furthermore, it is to be understood that the various well (52) features described in FIGS. 1 and 2, FIGS. 8 to 11, FIGS. 22 and 23 and FIGS. 42 to 46 can be interchangeable and applicable to various other embodiments.

Referring now to: embodiments of FIGS. 1 to 7, FIGS. 12 to 23 and FIGS. 37 to 86, it is to be understood that "cultivation" of a subterranean well bore wall surface (6) can comprise: i) a scraping feature that substantially cuts a surface to form concave tracks that are, e.g., perforated, dug, sliced, blasted or otherwise cut into a wall surface to separate proximal surface regions and/or ii) a scraping feature to join a plurality of planes associated with separated surface regions into a continuous plane by reducing the amplitude of convex or concave protrusions from, or tracks cut into, a wall surface that separate proximal surface regions to prepare the surface for use, wherein "cultivation" is to be understood according to the ordinary meaning of the word, which can be proximally comparable to, e.g., the refinement or development of a wall surface for subsequent use or, e.g., primary and/or secondary agricultural cultivation of a surface for subsequent use.

The method (1) and apparatus (2) for cultivation of a surface can comprise scraping that can be similar to ploughing, harrowing or tillage where a cutting implement is scraped across strata, metal or other downhole surfaces. A cut-like or trench-like furrow (11) in a subterranean wall surface of a well can be made by a hard or filament cutter, disc, chisel-like or plow-like cutter to provide a track, a marked narrow depression, a groove or a deep wrinkle within a downhole wall surface or a surface of the terrain. Any filament, disc, knife or chisel can be adapted to harrow, till or plough and, thus, form a scraper member that is drug across and cultivates a surface, with limited disruption to other parts of the surface outwith the associated furrow. A feature of filament, disc, knife, chisel or jet nozzle scraper members can be to form a furrow that perforates to form a perforation (10) or a furrow (11) to loosen or dislodge a portion of the wall surface debris from the wall surface to form longitudinal or transverse longitudinal separations in a wall's surface that resemble cuts, trenches or furrows.

A feature of subterranean wall surface cultivation for both method (1) and apparatus (2) embodiments can comprise a concave cutting cultivation using, e.g., harrowing or tilling scraper members that can provide a track, a disruption, a slot, s groove or a crevice into a wall surface that disrupts the continuity of the wall surface to form a single perforation-like (10) cut through the wall, or a furrow-like (11) cut, that can separate wall surface regions and, thus, develop the wall surface for subsequent use.

Another feature of subterranean wall surface cultivation for both method (1) and apparatus (2) embodiments can comprise scraping convex or concave disruptions or interruptions in the plane of a wall surface to form a plurality of planes (210 of FIGS. 14 and 19 to 21) using a member that is scraped across the wall surface area to urge a reduction (12) of wall surface disruptions and/or perforations (10) or furrows (11) therein, and wherein the feature of subterranean wall surface cultivation can also comprise scraping a spreadable substance across disruptions or interruptions in a wall surface to smooth the wall surface or grout ((13), as shown I FIG. 20) across disruptions or interruptions in a wall surface and, thus, refine the wall surface for subsequent use.

In the agricultural form of cultivation, soils of the terrain are significantly less dense per unit of volume and exponentially easier to cultivate than steels and hard rock. The arts of well construction and well destruction have developed, over centuries of practice, various means for cutting or scraping a wall surface that can be adapted to cultivate a wall surface comprising rock, cement, metal and/or other downhole materials, whereby adaptation of conventional and prior art apparatuses within the art of drilling through rock, well intervention and/or abandonment can be performed, according to the present invention, to cultivate a subterranean wall surface.

Accordingly, method (1) and apparatus (2) embodiments can use scraper members to treat a wall surface to create a cut-like or a trench-like perforation (10) or furrow (11) disruption in a wall surface and/or the method (1) and apparatus (2) embodiments can use scraper members to reduce wall surface disruptions to refine or develop wall surfaces for subsequent use, as is the convention with the art of cultivation. Any suitable downhole prior art scraper-like members comprising, e.g., plough-like, chisel-like, disc-like, explosive and/or pointedly abrasive implements can be adapted to form a first feature embodiment using a flexible linkage, while any suitable downhole conventional or prior art scraper apparatus comprising, e.g., disc harrows, tine harrows, pedal basket harrows and/or bladed harrows can be adapted to form a second feature embodiment using a flexible linkage, by arranging said flexible linkage to arcuately extend and arcuately retract from the surface.

Figure 10:
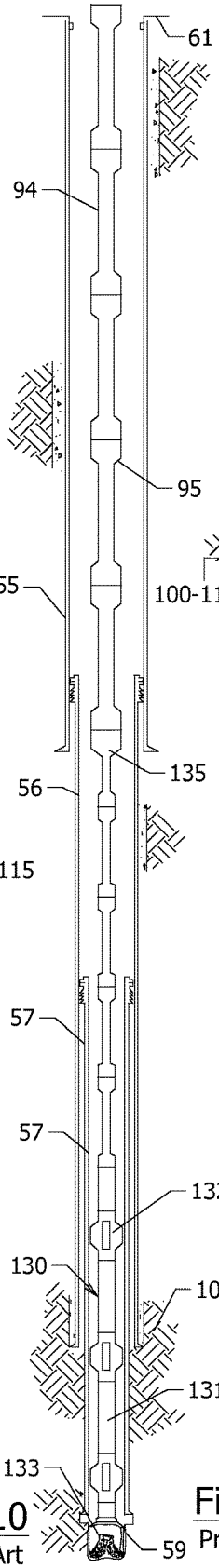
Fig.10 Prior Art

Method (1) and apparatus (2) embodiments can be used on various components of a well's (52) architecture, which generally comprises various cemented (58) and uncemented casing ((53 to 57), with (57) shown in FIG. 10) and strata (100 to 115) bores (59). Casings may comprise various sizes, for example, conduits (56, 57) can represent a liner that passes through an intermediate casing (54) conduit or production casing (55) conduit or a surface or conductor casing (53) conduit, around which an uncemented annulus and/or cemented (58) annulus can exist. Injection or production tubing (60) can be hung from a wellhead (61) or tree (62) at the tubing's upper end with a tubing hanger ((78), shown in FIG. 11), which can have a lower end wireline entry guide (77), and can be anchored within a casing (55-57) using one or more anchors and/or packers (76). Various sizes of crossovers or swages ((80), shown in FIG. 11) and receptacles or nipples ((79), shown in FIG. 11) can be included within a tubing (60) string for location of ancillary equipment like plugs, valves, gauges or chokes.

Various forms of engaged debris, e.g. NORM or LSA scale, or loose debris, e.g. strata debris, screened out unused proppant debris and/or perforating debris, can be present within or around the tubing (60) or casing (55-57). Debris can also comprise a functional downhole ancillary apparatus that is no longer of value to the user, which can become debris because it inhibits or prevents access to a wall surface in the well. Various embodiments can dislodge debris using primary or secondary cultivation of a wall surface to prepare it for use by a well user's preferred ancillary apparatus or spreadable substance.

A well (57) can have a valve tree (62) communicating with the tubing (60) and engaged to a wellhead (61) within which casings (53-55) may be hung and, then, cemented (58) in place within the strata level (100-115), wherein the wellhead (61) and tree (62) can be at ground level (63) or mud line below sea level ((64), shown in FIG. 4).

The above ground (63) valve tree (62), shown in FIG. 1, can be adapted for above or below sea level (64), referred to as subsea, use, wherein a conventional valve tree configuration represents primary (65) and secondary (66) master valves usable with the production valve (67) to flow production through the flow line (68). If the tree cap (69) is removed and a rig ((51), shown in FIG. 3) is erected to the tree's upper end, the swab valve (70) and master valves (65, 66) may be opened to access the production conduit (60) through the subsurface safety valve (71), wherein said subsurface safety valve (SSSV) can be operated with a control cable (72) using, e.g., hydraulic fluid. Various types and sizes of cables (72) can be used within a well and are commonly engaged to the tubing (60) with control line clamps (81 of FIG. 12). A conventional wellhead (61) generally uses multiple annulus valves (73, 74) to access annuli between the various well conduits (53, 54, 55, 60), wherein the larger shallow annuli can be exposed to normally pressured formations and, hence, can be left open without valves (75).

It is to be understood that any strata (101-115) wall surface, which can be accessible by a well (52) bore, can be cultivated using a primary or secondary cultivation using embodiments of the present invention. Wall surface primary or secondary cultivation methods or apparatus engagement with a strata bore (59) can be adapted to suit mineral and chemical composition, which can be generally classified by the texture of the constituent particles and by the processes that formed them, which separate rocks into igneous, sedimentary, and metamorphic. Igneous rocks may comprise, e.g., granite and basalt, which are particularly hard to bore through. While granite is often bored within wells, the majority of strata targeted for boring comprises sedimentary rocks formed at or near the earth's surface by deposition of either clastic sediments, organic matter, or chemical precipitates (evaporates), followed by compaction of the particulate matter and cementation during diagenesis. Sedimentary rocks may comprise, for example, mud rocks such as mudstone, shale, claystone, siltstone or sandstones and carbonate rocks, such as limestone or dolomite. Metamorphic rocks are formed by subjecting any rock type (including previously formed metamorphic rock) to different temperature and pressure conditions than those in which the original rock was formed, and hence may be prevalent in many well bores.

When constructing or destructing a well bore, conduit and/or cable, wall surfaces must often be cut to facilitate removal and/or installation of various well features or tools and materials associated with the construction or destruction of a well. As cameras are rarely operable or useful within dark murky, fluid subterranean environments it is important to blindly control cutting operations that cannot be visually witnessed during passageway to prevent unplanned events.

The art of subterranean well (52) construction, intervention, suspension and abandonment comprises blindly constructing or destructing downhole bores and wall surfaces within a borehole through strata or conduits therein. Various surface indications of the downhole operations associated with conduit or cable deployment and/or installation of well members can be used for selective actuation and/or operation of downhole tools and may comprise, e.g., axial or rotational energy transferred through a string ((33), shown in FIG. 22) from the surface. Motor and/or electrical energy ((35), shown in FIG. 22) can also be transferred through a string, a downhole electrical generator and/or battery, wherein energy can also be transferred through a flowing or pumped fluid ((34), shown in FIG. 22) and/or energy transferred through a chemical reaction ((36), shown in FIG. 22) using fluids like acids or substances like reagents or explosives.

Energy and downhole signals can be transferred through, as well as passed back through, the strata, a fluid within the bore, the tubing or casing lining a bore string and/or a string comprising, e.g., drill pipe, coiled tubing, electric wireline, slickline and/or a cable to provide surface indications relating to the performance of work. In addition, signals can be used to selectively operate a downhole apparatus and/or an adapted apparatus, or used with an embodiment of the present invention to operate a member of an apparatus, whereby an assembly of such tools, often referred to as a bottom hole assembly (130, BHA, with examples shown in FIGS. 8-10), can be deployed at the lower end of the string and used to perform well work along a well's axial length, between its upper end wellhead (61) or valve tree (62) and its lowest end.

During various well construction and well deconstruction or abandonment operations various planned and unplanned events can require cutting and/or treating of wall surfaces, wherein the cultivating or slicing, slot, trench and/or furrowing cutting of a wall surface of a well bore, conduit or cable can be preferred or necessary for more effective operations.

As gross or uncontrolled downhole cutting of walls and bores within a subterranean well may exacerbate well construction or destruction challenges, it is important to selectively arrange strings, BHA's and a cultivating apparatus for selective operation, especially when the downhole environment is relatively unknown, e.g., cutting of the strata during directional drilling, cutting of various materials during fishing operations where tools have been lost downhole and may rest or move in unpredictable ways, or when drill pipe, casing or tubing have collapsed, burst or parted and well integrity can or has been lost.

Various conventional and prior art downhole cutting tools are designed for making grossly controlled and relatively large gouging cuts of walls and bores along a single cut plane transverse to the longitudinal axis of the well, e.g. drill bits and milling arrangements, while other cutting operations require a controlled slice or slot cut of a single wall or bore surface. Such conventional apparatus can, however, be adapted according to the present invention to become embodiments for cultivating a wall surface. For example, arcuate filament linkages carrying associated cutters can be secured to the BHA that cut wall surfaces along the longitudinal axis of the well bore, which can be combined with bits and under-reamers to prepare a wall surface for improved combined drilling and under reaming operations.

Very few conventional or prior art tools exist for easy longitudinal cutting and few conventional or prior art tools exist to cut a relatively controlled slot or slice cut through a plurality of wall surfaces within a subterranean well, whereby said tools may not be able to cut a furrow or have other disadvantages. For example, cutting tools that involve a revolving knife, insert or abrasive cutters can become stuck in the first wall surface that is cut, when trying to extend through the wall and cut a second wall surface while conventional chemical cutters can lose either the pressure or the accuracy to extend a jet through one cut wall surface to the next. Various conventional cutting tools can be adapted according to the present invention to form embodiments that can, e.g., cut a longitudinal furrow more easily within a first wall surface furrow to guide and improve orientation and provide a slot for cutting a second wall surface furrow through the first wall surface.

Conventional or prior art abrasive grit cutters exist, which can use, e.g., sand or other hard materials carried by a fluid jet of slurry that may be controlled so as to provide a slicing slot like cut through a plurality of conduits; however sufficient quantities of grit for cutting multiple conduits generally require supply from the surface and the downhole logistics of carrying hoses and controlling the extent of the cut can be very difficult for slot cuts at relatively shallow depths and virtually impossible at relatively deep subterranean depths. Downhole jetting tools can be adapted, according to the present invention, to become embodiments that can be used to, e.g., form a furrow shape that more easily dislodges debris that can pick up sand and other abrasive or hard materials to further dislodge or erode a wall surface. Tools can be adapted to more easily cut or scrape furrows longitudinally and traverse to the well's axis to form a lattice or a plurality of planes associated with separated wall surface regions, which can in turn be dislodged to join a continuous plane on which the regions rested. This is especially useful for removing casing or liners lattices of separated surface regions, where poor cement bonding exists (e.g., 1M of FIGS. 18 to 21). For example, the tubing and casing or liner lattices of separated surface regions can be exploited using methods (1G) to (1J) sequentially, as shown in FIGS. 12 to 15, to join the plane and expose the continuous plane of the well bore within which the poor cementation and casing or liner existed prior to removing debris circumferentially disposed between the deepest concave furrows urged into the downhole wall surfaces.

Various conventional or prior art rotational knife or fluid jet cutters rotate around a central tool axis to sever walls and bores with a relatively precise cut that is generally in the axially transverse plane, but which can have significant misalignment problems when cutting rotation forms a slight helical path and, thus does not fully sever the conduit. Within the art of cutting knives and swords, the connection between such a helically misaligned cut slot is sometimes referred to as a "tang," which restricts separation of a conduit wall along its longitudinal axis. Conventional and prior art can be adapted according to the present invention to form embodiments that reduce the propensity for interference from a cut misalignment tang by cultivating the wall surface with longitudinal and/or traverse wall surface furrow separations that prevent tangs despite any misalignment during the cut.

Referring now to FIGS. 3, 4, 5 and 6, the Figures are elevation views depicting method (1) embodiments (1B, 1C, 1D and 1E) and apparatus (2) embodiments (2B, 2C, 2D and 2E) of an onshore drilling rig, offshore drilling rig, coiled tubing rig and a wireline or slickline rig, respectively, with section lines D-D below each Figure, which is understood to represent any of the geologic sections having lines A-A, B-B or C-C of FIGS. 1 and 2.

The method (1B, 1C, 1D, 1E) can be used to, e.g., form or use an apparatus's (2B, 2C, 2D, 2E) shaft (3B, 3C, 3D, 3E) member that can be hoisted into and out of the well from and to the surface using a land drilling rig (51B) string, offshore drilling rig (51C) string, coiled tubing rig (51D) string or cable rig (51E) string. An arcuate linkage (4B, 4C, 4D, 4E) member can radially deploy a scraper (5B, 5C, 5D, 5E) member, which can act upon a wall surface (6B, 6C, 6D, 6E) and be oriented to the longitudinal axis of the wellbore to separate the wall surface into regions (9B, 9C, 9D, 9E) for use with an ancillary apparatus (7B, 7C, 7D, 7E) or a spreadable substance (8B, 8C, 8D, 8E).

The method embodiment (1, 1B, 1C, 1D, 1E) is further usable to, e.g., prepare a wall surface (6, 6B, 6C, 6D, 6E) by cultivating longitudinal and/or transverse longitudinal wall regions (9, 9B, 9C, 9D, 9E) separated by digging into the surface with a scraper (5, 5B, 5C, 5D, 5E) radially deployed from an arcuate linkage (4, 4B, 4C, 4D, 4E) and shaft (3, 3B, 3C, 3D, 3E) hoisted by a rig (51), to place an apparatus embodiment (2, 2B, 2C, 2D, 2E) into and out of an onshore, offshore or subsea well, wherein ancillary equipment (7, 7B, 7C, 7D, 7E) and/or a spreadable fluid (8, 8B, 8C, 8D, 8E) can be urged onto the surfaces or furrows within the wall during secondary cultivation of the wall surface and/or during subsequent use by other equipment or substances within the well. It is to be understood that the method (1) and apparatus (2) embodiments of FIGS. 3 to 6 can be used with or replaced by embodiments of FIGS. 1 and 2, FIG. 7, FIGS. 12 to 23, and FIGS. 37 to 86, except where noted.

Various methods (1) may use fluids pumped from rigs (51B, 51C, 51D) or pumped through tubing and casing that can use a conduit string to circulate or place a fluid and/or spreadable substance through (28 of FIG. 7) and/or about (29 of FIG. 7) an apparatus (2), prepared wall surface (6) and/or furrow separated wall region (9).

FIG. 7 illustrates a diagrammatic elevation view of a slice through a well bore and subterranean strata of a method (1) embodiment (1F) and apparatus (2) embodiment (2F) that can be used for abandoning a well for a geologic time frame, wherein the diagram is a paraphrased representation FIG. 1 of the Oil and Gas UK Issue 4, July 2012 *Guidelines for Suspension and Abandonment of Wells*, entitled 'Permanent Barrier schematic "Restoring the Cap Rock"' and used within the publication to describe "minimum industry best practices." While the exact wording of requirements for permanent abandonment can vary by country, the diagram is generally consistent with NORSOK Standard D-010 Rev. 3, August 2004, *Well integrity in drilling and well operations* requirements, *United States Department of the Interior Minerals Management Service Gulf Of Mexico OCS Region Ntl* No. 2009-G21 (MMS) requirements, which have been assumed by the Bureau of Safety and Environmental Enforcement (BSEE), and those of the Texas Railroad Commission January 2000 *Well Plugging Primer*, which require that "dry or abandoned wells be plugged in such a way as to confine oil, gas, and water in the strata in which they are found and prevent them from escaping into other strata," as recited therein.

Published industry best practices for rig-less placement of a permanent barrier specifies a minimum height of good cement (91) of at least 31 meters (100 feet), which must be placed at a depth (90) determined by formation impermeability and strength (93) with primary cementation isolation behind the casing still in place. Pipe circumferential standoff (83) is required to prevent the channelling of high fluid frictional areas resulting in poor cleaning, bonding and/or missing cement. Axial downward cement support (84) is required to prevent cement movement, slumping and gas migration while cement is setting, with clean water wet surfaces to provide a good bond (85), to, thus, prevent poor bonding and micro annuli and leak paths. Once these minimum requirements are met, the published references generally conclude that a rig-less operation will provide "well barrier elements," of a permanent sealing abandonment plug (88) with the innermost conduits sealed with cement in cement (89) and the casing and tubing embedded in cement (87). Provided that both the existence and sealing bond of primary cementation (58, 86), adjacent to a formation is impermeable and of adequate strength, the resulting cement will contain future pressures (92). While "cement" is generally specified, the Oil and Gas UK Guidelines also provided for alternative permanent well barrier elements, provided that they provide an equivalent function to cement.

Meeting industry rig-less abandonment best practices therefore requires logging of the primary well cementation behind casing to ensure its presence and bond, followed by cleaning of well conduits to ensure they have wettable surfaces for cement bonding whereby tubing and casings is embedded within cement by providing cementing support and offset, where necessary over a sufficient portion of the well opposite an impermeable and strong formation that is capable of replacing the cap rock.

Conventional and prior art drilling rig abandonments and various rig-less prior art of the present inventor can be used to remove conduits for logging of the primary cementation, but milling may become necessary if perforations and cement squeezes cannot access leaks behind poorly or unbounded cemented casing.

The present invention can be usable to cultivate wall surfaces using, e.g. the method (1) and apparatus (2) of FIGS. 12 to 17 and, thus, avoid the need to mill back to primary rock either with a rig or rig-lessly, during the abandonment of a well to meet the published industry best practices, such as those described in the referenced Oil and Gas UK Guidelines, NORSOK Standards, United States Bureau of Safety and Environmental Enforcement (BSEE) Requirements or the Texas Railroad Commission's guidelines.

Meeting industry best practices for abandoning wells requires providing barriers to the vertical migration of subterranean fluids from one strata formation to another or to the surface, which can be improved by furrowing into a casing, cement and formation that is impermeable and of adequate strength prior to plugging the well and furrow with cement. Alternatively, a lattice of separating cuts or furrows can be placed in a wall surface to allow uncemented and or unconsolidated wall portions or debris to fall further down within the well to, e.g., provide support for cement plugs. The removal of debris and/or the lattice of separated wall surface regions, formed between the associated furrows, can be urged from a wall using, e.g., jetting and ploughing or reciprocation, circulation and rotation of a rotary string, whereby significantly improved milling operations can more easily destruct a lattice furrow structure than the less efficient milling operations that attempt to destroy a structurally stronger and more secure shape of a cemented whole casing.

Figure 8:
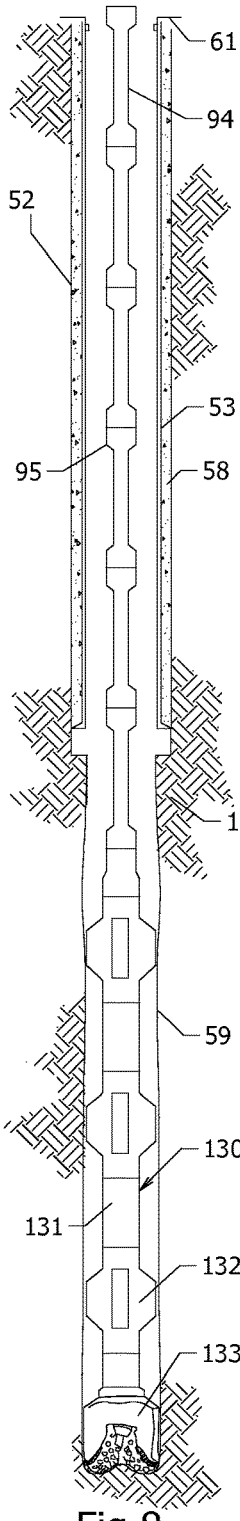
Fig.8 Prior Art
FIGS. 8 to 11 show various prior art well environments.
Figure 9:
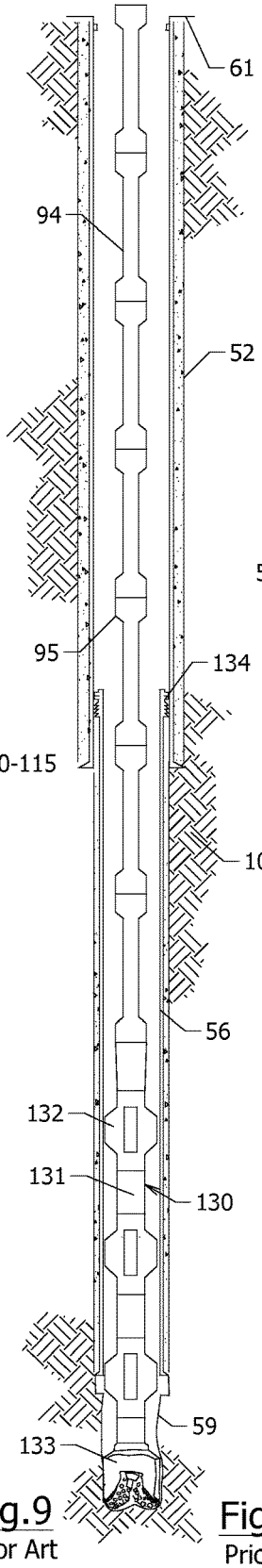
Fig.9 Prior Art
Figure 11:
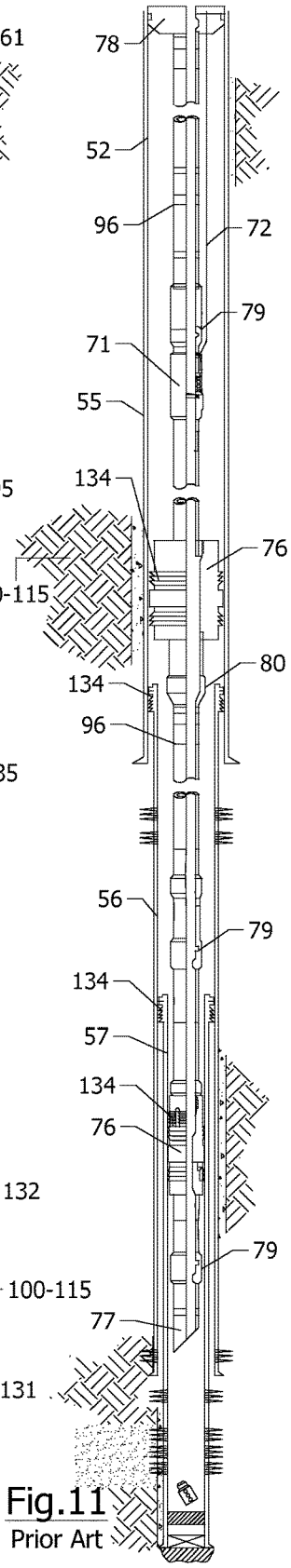
Fig.11 Prior Art

Referring now to FIGS. 8, 9, 10 and 11 showing diagrammatic elevation view slices through a well and the subterranean strata for conventional and prior art drilling through casings and liners and for a well completion. FIG. 8 shows boring through, e.g., a surface casing. FIGS. 9 and 10 illustrate boring through ever decreasing diameter liners, while FIG. 11 depicts completing a bored well for production from or injection into the strata.

Well (52) operations can comprise boring and/or operations involving bores, conduits and/or cables, wherein various conduit strings can comprise, e.g., a rotary drill string (94) or rotary drill pipe with tool joint connectors (95) or tubing (60) and casing (53 to 57) with coupling connectors (96). Various conduit strings can be are placed and hung with a hanger within a bore, casing or wellhead (61) and can be cemented (58) in place. A bore (59) can be drilled with a BHA (130) and bit (133) within the strata (100 to 115), or a bore can be cut into other conduits (53-57 and 60) during, e.g., a side-track. Well operations generally progress from larger diameter bores and casings to smaller diameter bores and conduits. Drill strings, casing and/or tubing and various completion equipment can be engaged by, e.g., hangers (134) and packers (76) to subterranean surfaces that have been cultivated. Accordingly, there are numerous downhole wall surfaces that serve different functions and require different preparations before they can be used by an ancillary apparatus and/or spreadable substances. Wall surface preparation apparatus can comprise, e.g., stabilisers within the BHA that rotate and arcuately engage a wall surface or a boring bit that can be adapted according to the present invention to provide a flexible arrangement in addition to their conventionally rigid engagements.

Surfaces can be created by reaming and milling which normally refers to destroying a smaller circumferential surface to enlarge the wellbore's circumference by drilling it again with a special bit, a hole opener, an under reamer and/or mills, wherein a reaming or milling apparatus can comprise a tool, which is generally fashioned to remove an untreated smaller diameter surface to provide a relatively smooth larger diameter wall surface within the well, but these reaming or milling tools and apparatus do not first treat the surface by cutting furrows therein. Reciprocating motion occurring during drilling or reaming, can comprise moving axially up and down or back-and-forth like motion, similar to a piston in a cylinder, whereby reciprocating cutting must occur during rotation and can causes surge and swab pressures within a cylinder or borehole that exert a force therein but will not generally provide longitudinal furrows.

Prior art and conventional practice can comprise treating a wall surface, but the objective is, generally, not to longitudinally and/or transversely cut the surface to separate it into a plurality of planar surface regions, but rather to make it more or less homogenous. For example a liner (56, 57) can separate one larger diameter surface from a smaller diameter surface, but the conventional objective is to make the transition as seamless as possible because a bottom hole assembly (BHA) must generally pass through the transition between larger to smaller bore sizes. Also, friction is conventionally avoided because it can cause difficulty trying to enter into a well bore and/or can cause drag when pulling out of a well bore.

Accessing a well can also comprise centralising various ancillary apparatuses using, e.g., the casing centralisers (119 of FIG. 26) and logging tool centralisers (121 of FIG. 28), but the conventional practice is silent as to the formation of furrows or the removal of surfaces formed by furrowing and, thus, is contrary to cultivation of the present invention.

Accordingly, a wealth of conventional and prior art cleaning tools are generally available and can comprise, e.g., fluid jetting tools, liner top mills and polishers, casing scrapers, brushes and/or scratchers, (e.g. 118 of FIG. 25) that are used to remove debris from a surface and clean it to a relatively low friction and smooth state so that other tools may be more easily placed into and retrieved from a subterranean well (52).

As the bores of conduits (53-57) and bored strata (59) become ever smaller in diameter, as shown in FIGS. 8 to 11, drill strings can comprise drill pipe (94) and drill collars (131) with tool joints that may be enlarged for flush connection to large stabilisers (132) that centralise the BHA (130) and direct the boring bit (133), which can affect the wall surfaces but are generally designed not to cultivate it. Transitions from casing (54) to liners (56) and liners (56) to liners (57) can force the use of transitions (135) to smaller diameter drill strings within tighter hole tolerances which can more easily twist off and/or become stuck during boring.

After boring is completed, a completion is installed which can include tubing (60) coupled (96) together with subsurface safety valves (71) using, e.g., electric and/or hydraulic control line cables (72) connected to a production packer (76) that can be hung (134) within the production casing (55). Like drill strings, the tubing (60) can transition (80) to a smaller diameter and can include smaller diameter packers (76), with smaller diameter hangers (134) and receptacles (79), generally referred to as nipples that can have "no-gos" to provide for the landing and engagement of selective diameter tools. Furthermore, gauge cables and other surveillance and/or operational cables can greatly complicate the downhole environment and represent a significant challenge, both during installation and later during any subsequent intervention within the well (52). Within most completions, a tail pipe below the bottom production packer, in the lower end of the well, is close to or adjacent to open hole producible rock or conventional perforations (137), which provide access to the pores and permeability of producible rock through, e.g., selective conventional perforations in a liner across the rock.

Accordingly, due to the complexity and variety of downhole surfaces, prior art and conventional wall surface preparation can, generally, comprise cleaning or completely destroying and/or removing a wall surface through, e.g., boring, under-reaming, hole-opening, milling and/or explosives. Such practice can be particularly inefficient because "all" of the wall surfaces may not necessarily need to be removed or destroyed. Furthermore, all operations, including milling of a wall surface, can be significantly more complex when cables are present.

Conventional and prior art downhole cables (72) are difficult to install or remove and can comprise a rope of metal wire and/or other strong fibres that can be formed into a small conduit, single strand or a series of braided or mono-core strands used to, e.g. carry fluid, weight, signals, forces and/or conduct electricity.

Cultivation of a downhole surface, including the surface of cables, can include placing furrows within a surface to avoid the need to remove all of the wall surface, and/or placing furrows through the wall and opposite wall surface of conduits and/or cables using furrowing operations that can be usable to minimize the probability of a cutter becoming buried in a surface and stuck in well (52) and/or forming a bird's nest of tangled cables about a cutting tool.

Referring now to FIGS. 12 to 21, which depict various views of wall surface cultivation method (1) embodiments and apparatus (2) embodiments that, with reference to FIG. 1, can affect any cable (72), any strata (100 to 115) bore (59), any tubing conduit (60), any cement (58) between the strata and casing and/or any associated casing conduit (53 to 57) wall surfaces using a cutter and scraper member (5) that can be deployed by an arcuate engagement linkage (4) carried on a shaft (3) so as to form furrows or to join furrow separate wall surface regions (9) into a continuous circumferential plane that can be usable for subsequent use by or engagement with an ancillary apparatus (7) or spreadable substance (8) within the subterranean well (52).

Cultivation of the wall surface (6) can comprise using a linkage (4) to engage a member (5) extended from a shaft (3) to scrape and furrow perforate (10) and/or cut a furrow (11) into a wall surface to form concave cuts comprising singular or a plurality of, e.g., single linear, cincture, mullion, cylindrical and/circumferential planar cuts, tracks, punctures or cutting blemishes, which can be formed in a series of aligned, overlapping and/or crossing concave furrow protrusions into the surface that can separate a wall into surface regions (9, 9G) which juxtapositionally form convex protrusions extending from the deepest concave point of a furrow, wherein such protrusions can be oriented longitudinally to the well axis and/or transversely to the well axis for subsequent application of an ancillary apparatus (7) or a spreadable substance (8).

Cultivation of the wall surface (6) can also comprise joining a plurality planes (210 of FIGS. 14 and 19 to 21) and/or a dichotomy of wall surface regions (9) separated by, e.g., the linear, cincture, mullion, cylindrical and/circumferential concave or convex planar protrusions from or into a wall surface by using a shaft (3) deployed linkage (4) to engage a member (5) and scrape the concave protrusion (208 of FIGS. 14 and 19 to 21) or convex protrusion (209 of FIGS. 14 and 19 to 21) between the concave deepest furrow end (207 of FIGS. 14 and 19 to 21), to reduce its amplitude (12) from the wall surface plane or concave deepest furrow end for joining the surfaces. Alternatively, separate regions can be joined by grouting (13) or filling protrusions into a wall surface to reduce deviations from the wall surface plane for joining a plurality of planes (210 of FIGS. 14 and 19 to 21) into a continuous plane (211 of FIGS. 14 and 19 to 21). Various linear, cylindrical and/or erratic planar wall surface deviations may be reduced to a desired surface deviation conducive with ancillary apparatus (7) or spreadable substance (8) engagement or use.

Figure 12:
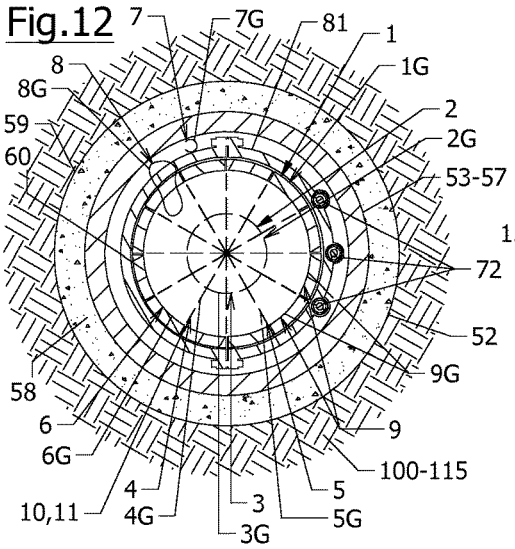

FIG. 12 illustrates a plan view of a slice through a well and subterranean strata showing a method (1) embodiment (1G) and apparatus (2) embodiment (2G) for cultivating the wall surface (6) of a tubing conduit (60), a casing conduit (53-57), a cement conduit (58) between the casing and strata, a bore (59) through the subterranean strata (100-115), a clamping control line conduit (81) and/or a control line (72).

Figures 52, 53, 54, 55, 56, 57, 58, 59:
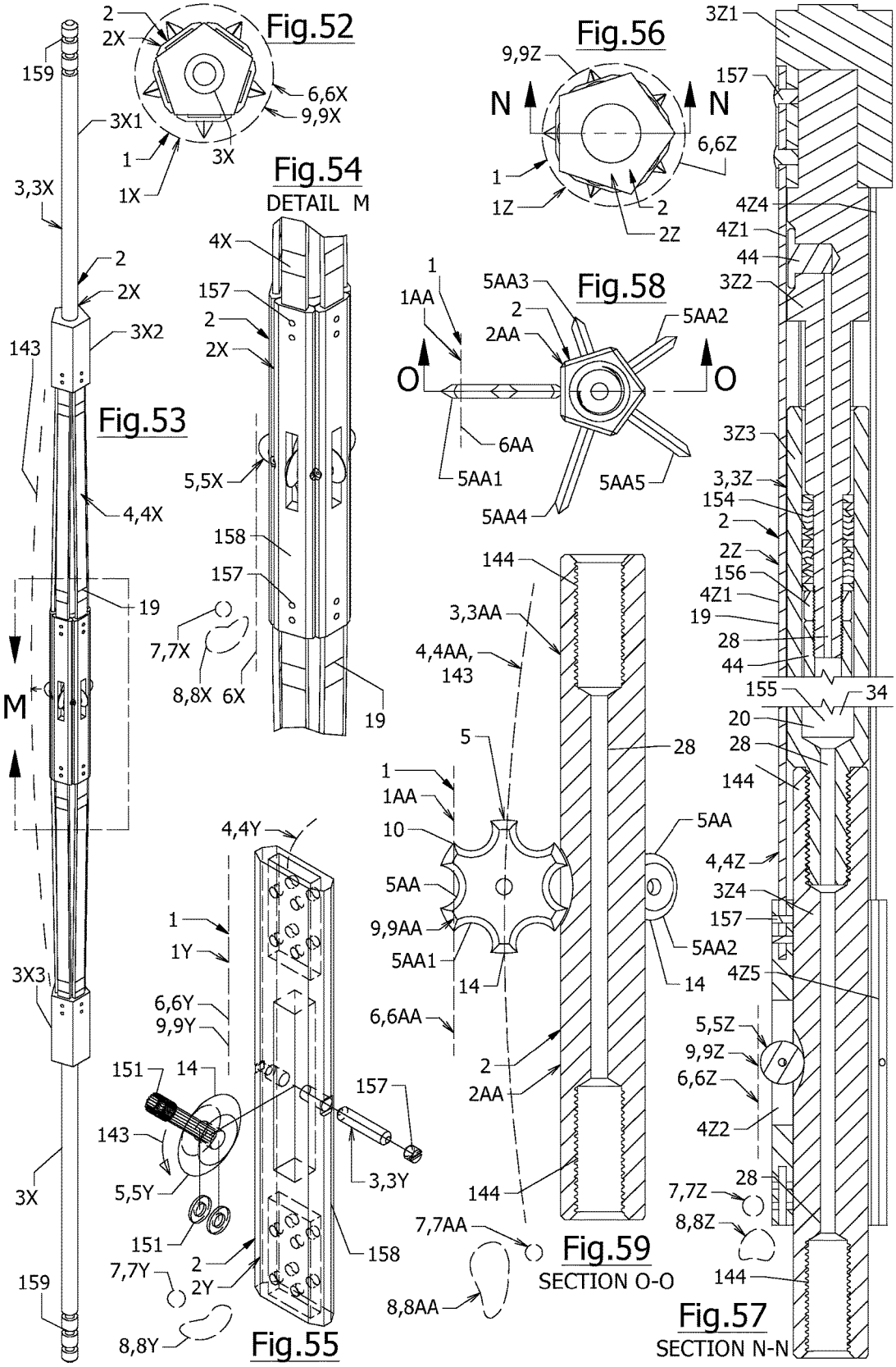

Furrows (11) or a longitudinal series of perforations (10) can be cut into and/or through the wall surface of the tubing (60) to weaken it with a shaft (3G) deployed arcuate engagement linkage (4G) cutter and scraper (5G), which can be similar to, e.g., (4Z) of FIGS. 52 to 53, which can radially deploy a cutting or perforating scraper member (5G) that can be similar to, e.g., (5AA2) or (5AA1) of FIG. 59. A scraper member (5G) can be adapted or formed, wherein, e.g., a super abrasive filament (18 of FIG. 32) is combinable with a rotary arrangement (98 of FIGS. 33 to 35) that can be adapted for downhole use from a shaft (3G) to, in use, form the shown longitudinal furrows (10, 11) in the tubing, or furrows which first cut the tubing (60) wall surface (6G) and, then, cut the wall surface of the control cables (72) transversely to the longitudinal axis of the subterranean well (52).

An ancillary apparatus (7G) can comprise, e.g., a packer and/or piston, described by patents GB2471760B, GB2484166B and GB2487274B or priority application GB2492663A of the present inventor, which can be engaged to the wall surface of a casing (53 to 57) to compress the tubing (60), control lines (72) and clamps (81) into a lower end of the well (52) after they have been severed. The present invention can provide significant benefit by cutting furrows into wall surface along a, e.g., longitudinal or axially transverse orientation using arcuately engaged wall surface scraper cutters of the present invention. Additionally, e.g., unwanted shaft and tool vibration, associated with transversely cutting the eccentric control lines (72) and clamp (81) using a rotated shaft that radially deploys a cutter, can be substantially reduced by dragging an arcuately extended and deflectable super abrasive filament cutter which scraps and cuts the wall surface with an abrading cutting structure to form a furrow through multiple eccentrically placed wall surfaces. Additionally, arcuate longitudinal cutting, with arcuate scraper members, can shred a conduit into spaghetti like strands to aid crushing, wherein after cutting and crushing of the severed tubing (60), control lines (72) and clamps (81), a spreadable substance (8G), e.g. cement or resin, may be engaged to the wall surfaces to seal the well temporarily or over a geologic time period.

Figure 13:
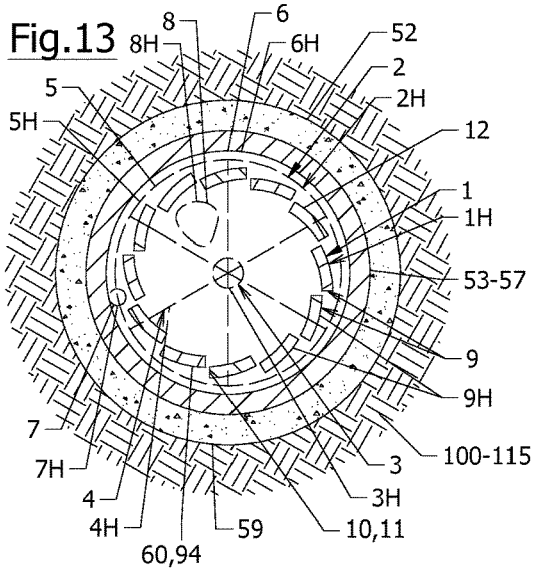

FIG. 13 depicts a plan view of a slice through a well for a method (1) embodiment (1H) and apparatus (2) embodiment (2H) usable to cultivate a conduit's wall surface, which can be used with, e.g., the embodiments of FIGS. 3 and 4. A shaft (3, 3H) and arcuate linkage (4, 4H) deployed scraper (5, 5H) can be used to provide a series of furrow perforations (10) or furrows (11) that cut through or into the wall surface (6, 6H) of, e.g., tubing (60), drill pipe or a rotary drill string (94). An upper end of the wall surface can be left uncut and a tool joint (95 of FIGS. 8 to 10) or tubing coupling (96 of FIG. 11) can be used to rotate the separated wall surface regions (9H) so that they may be twisted and pushed downward with, e.g., the weight of the tubing or drill string above a free point and against a lower end portion of the drill string and stuck within the lower end of the well (52). Alternatively, the tubing or drill pipe may can be used to deploy an expandable crushing piston (5H) below a severance point or the parting of a coupling or tool joint, wherein the piston can be adapted to scrape the casing (e.g. 100 to 115) when crushing and/or twisting the tubing (60) or drill pipe (94).

The embodiment (1H, 2H) can be used in various ways comprising, e.g., using a through tubing or through drill pipe arrangement to operate a scraper member (5, 5H) and axially cut through the pipe body into the tool joint or coupling prior to removing the cutter. Axial rotation and/or downward movement of an upper end uncut portion of the pipe or tubing body can twist and separate of the wall surface regions (9, 9H) to cause a threaded connection (e.g. 95 of FIGS. 8 to 10, 96 of FIG. 11) to separate at the longitudinal cuts so that the upper end of the tubing string or drill string may be freed from, e.g., its stuck lower end. Subsequent to freeing the tubing or drill string an ancillary packer (7, 7H) can be engaged to the wall surface in or below the casing, and above the lower stuck end to support a spreadable substance (8, 8H) comprising, e.g., cement placed above the packer to abandon the lower end of the well bore and stuck string. Alternatively, a screw tractor and motor can be fitted to a crushing piston (7H), which is anchored to the separated wall surface regions (9H), to twist and crush severed tubing or drill pipe downward for placement of a spreadable and settable substance (8H) thereafter.

Figure 14:
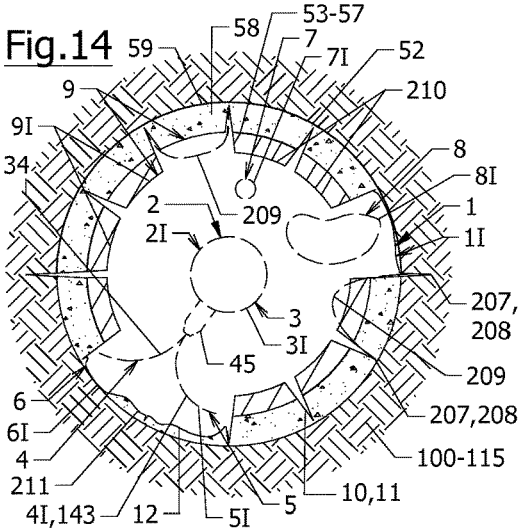

FIG. 14 shows a plan view of a slice through a well for a method (1) embodiment (1I) and apparatus (2) embodiment (2I) for cultivating well bore and/or conduit wall surfaces, wherein the surfaces are below, e.g., a wellhead or completion tail pipe or are the result of using the embodiments of FIG. 12 or 13, wherein any inner conduits (60 or 94 of FIGS. 12 and 13) have been destroyed, crushed or removed. Various longitudinal or transverse furrows (11) with concave (208) deepest ends (207), can be cut by a scraper member into the wall surface of the casing (e.g. 53-57), cement (58) and strata (e.g. 100-115) to provide wall surface (6I) regions (9I) separated by the furrows, cuts, slots, tracks or trenches. An associated plurality of planes (210) can be formed by longitudinally or axial transversely oriented perforations (10) through a surface plane to the opposite plane of a conduit's wall and/or furrows (11) into the surface, wherein a lattice of furrow separated surface regions (9I) divided by an associated lattice of longitudinal and axially transverse furrows can cut the surface's plane (6) into a plurality of planes (210). Additionally, e.g., an arcuate engagement (4I) of a fluid jet scraper (5I) member can be used to furrow the wall surface (6I) and can also be used to join separated wall surfaces into a continuous plane (211) by reducing the amplitude (12) of the debris or convex surface (209) protrusions extending from the deepest concave (208) furrow end (207) with fluid jetting of the strata bore (59) engaged cement (58), which is strong in compression but relatively weak in tension and shearing.

A spreadable substance (8I) or cutter (5I) can be included within the jet stream, comprising an arcuate engagement linkage (4I), when rotated to further dissolve or abrade a conduit, cement and/or strata wall surfaces to further furrow, join and/or reduce the amplitude of the furrowed convex wall surface (6I), using the partial or complete removal of the separated surface regions (9I). The fluid jet scraper (5I) can comprise a choke (45) used to form the arcuate engaging (4I) fluid energy (34) jet scraper, which can be rotated by a shaft (3I) and which can be used to reduce the amplitude (12) of furrow deviations from the cylindrical plane of the casing's inner diameter or to join the furrow separated plurality of planes into a continuous plane by removing all of the furrow's concave amplitude into the surface. A fluid energy (34), formed by choking (45), a fluid flow stream, can be used to cultivate furrows in a wall surface. Various prior art arrangements may be adapted to provide a fluid jetting scraper to cut furrows or remove convex protrusion formed by the furrows, wherein, e.g., a conventional nozzle may be placed on the end of a rotated drill pipe tubular shaft or alternatively from a nozzle rotated by, and existing from, the rotary cable tool fluid motor of the present inventor described in GB 2471760, GB 2484166 and/or GB2492663. Various logging tool ancillary apparatus (7I) can be used to confirm the joining of separate surface regions or the reduction in a furrow's concave amplitude into the circumference of the well bore surface.

Figure 15:
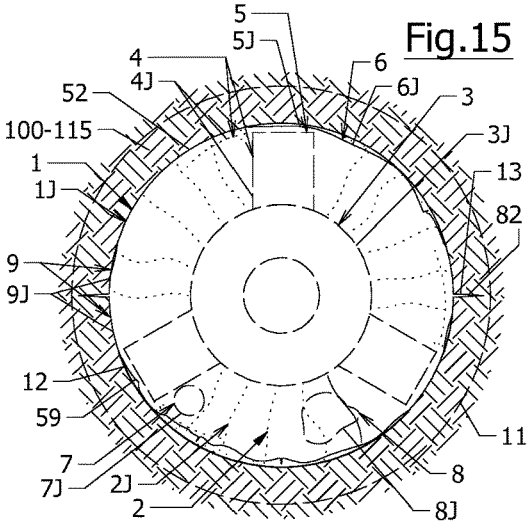

FIG. 15 illustrates a plan view of a slice through a well and subterranean strata of a method (1) embodiment (1J) and apparatus (2) embodiment (2J) for cultivating the wall surface of a well bore, wherein the arcuate engagement linkage (4) comprises a stabilizer blade (4J) usable to centralize the shaft (3) embodiment (3J) to rotationally and radially deploy arcuately engaging filament cutter and scraper (5) members such that abrasive filaments (5J) can be used to cut furrows or to join a discontinuous circumferential plane by reducing or removing the amplitude (12) of wall surface (6) convex disturbances (6J) protruding from the surface into the well bore (59). Rotation of the string and associated shaft (3J) can also deploy wall surface cuttings or other spreadable substances (8, 8J) like a lost circulation material (LCM) slurry to, in use, grout (13) fractures (82) separating wall surface regions (9, 9J) by scraping a substance like LCM along the wall surface (6J) until it lodges into and grouts (13) induced or natural fractures in the strata (e.g. 100 to 115). The embodiment (1J) can occur independently during, e.g., drilling operations or after the series of embodiments progressing from FIG. 12 to FIG. 14.

Figure 17:
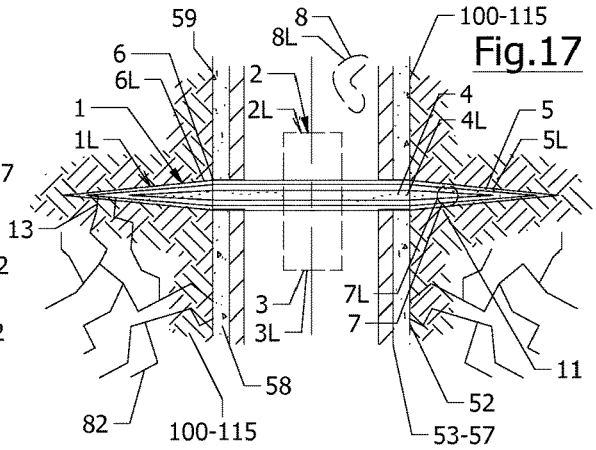

Alternatively, the length of filaments may be changed and/or selectively controlled with adaptation of prior art reels or automatic feeds to extend past the arcuate path (4J) of the stabilizer blades to cut furrows into the well bore (59) and strata (e.g. 100-115) in a manner comparable to embodiments (1S) of FIG. 43 and (1L) of FIG. 17. An ancillary apparatus (7, 7J), comprising the hole diameter calliper gauge measuring device of FIG. 24, can be used to record the amplitude of furrows placed within the strata to indicate if a settable sealing spreadable substance can be placed within the furrows to seal the well bore (59) from longitudinal fluid migration.

Figure 16:
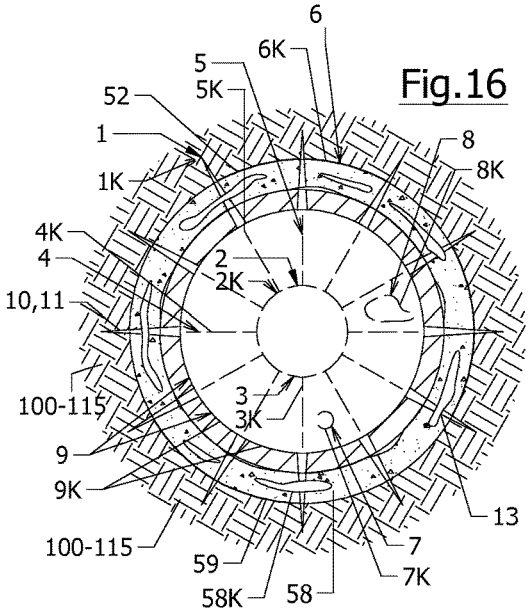

FIG. 16 depicts a plan view of a slice through a well for a method (1) embodiment (1K) and apparatus (2) embodiment (2K) usable to cultivate a conduit's wall surface during, e.g., well abandonment, wherein a lack of cement bonding, fractures and/or fluid passageways exist in the cementation (58), which can be accessed through the bore (59) wall surface via furrow perforations (10) through an opposite wall surface and/or furrows (11) placed in a wall surface using a cutter and/or scraper adapted according to the present invention. Conventional practice is to pump and squeeze cement into the well and pressurize the well in the hope that fluid flow will carry the cement into the conventional perforation holes to seal the faulty cement (58K). The conventional practice of squeezing cement can be significantly improved with a scraping member (5, 5K) deployed from an arcuate linkage (4, 4K) and deployment shaft (3, 3K) to cut and scrape a furrow into the bore (59) and to scrape and urge cement into the furrow separated wall surface (6, 6K). Grouting (13) and filling furrows can join the plurality of planes associated with the furrow separated surface regions into a continuous plane and/or reduce or remove the amplitude difference (12) between the deepest concave end of the perforations (10) and/or furrows (11) and the well bore cylindrical plane (59) and, thus, prepare the well bore for use by a spreadable substance (8, 8K) like produced fluid and/or an ancillary apparatus (7, 7K) like a production packer or a conduit lining.

Various adaptations of prior art or conventional wiper plugs, pedal baskets or packers, according to the present invention, can be usable as cutters and scraper members that can urge a furrow and spreadable substances, like cement or resin, into the desired holes, crevices and/or cracks or cut tracks that exist within a wall surface and can be accessed by a furrow. The use of a scraper member for grouting (13) and repair of the surface can ensure that grouting material does not remain within the bore (59) and prevent subsequent access. Alternatively, said adapted prior art or conventional scraper members can be used to urge dissolving fluids and/or reagents like acid through furrows into fluid accessible passages or pore spaces to prepare the surface for further cultivation or, e.g., more efficient milling or other wall surface destruction operations.

FIG. 17 shows an elevation view of a slice through a well for a method (1) embodiment (1L) and apparatus (2) embodiment (2L) usable to cultivate a well bore and/or a conduit wall surface that can be used with the embodiments of FIGS. 12 to 16. A shaft (3, 3L) is deployed on, e.g., wireline or slickline to carry an arcuate engagement linkage (4, 4L) that is rotated to drag a scraper member (5, 5L) around an arcuate engagement path to form a furrow (11) through a plurality of strata (e.g. 100 to 115) bores (59), casings (e.g. 53 to 57) and/or cable wall surfaces (6, 6L), which can be used to, e.g., grout (13) fractures (82). The sealing of fractures and proppant frac-jobs is becoming ever more important with the advent of shale gas plays and/or tight-sand plays because while fracturing or breaking the rock makes the shale formations and/or the tight-sand resources significantly more productive, it also makes the fractures significantly harder to seal.

Proppant fracturing is generally designed relative to the horizontal and vertical stresses within the subterranean strata, wherein fractures can continue for significant distances horizontally and significantly less in the vertical direction. Accounting for the stresses applied to the casings during pumping of fluid pads and associated proppants, which can form micro-annuli between cement and casing, one or more furrows can be cut through affected wall surfaces into the strata at or above the vertical extent of a proppant fracture to seal the well in the vertical direction. Accordingly, the need to mill a large section of casing may be replaced by one or more furrows that cross potential fluid leak paths.

The cutting of furrows (11) into "at least a part" of one or more wall surfaces can represent a significant improvement over, e.g., milling and removing "all" of the wall surface back to a point within the strata and/or perforating a limited number of holes which may or may not connect with fractures, fluid passageways or pore spaces that need to be sealed with a settable spreadable substance (8, 8L), wherein sealants can be more readily squeezed and grouted (13) into furrows connecting to strata fractures and/or poor cementation of either the rock or space between the casing and rock.

Cultivation can also prepare a subterranean surface for a cement bond logging ancillary apparatus (7, 7L), further described in GB 2494780 A of the present inventor, or an acoustic listening device, such as those found in production logging tools, which can be placed within a furrow (11) and/or engaged to the casing to empirically measure and transmit a signal after placement of cementation to provide data for fluid flow, or a lack thereof, occurring around the well bore.

Referring now to FIGS. 18, 19, 20 and 21, the Figures depict a plan view with line E-E, a cross section elevation view through line E-E of FIG. 18 with line F-F and break lines representing removed portions, a plan cross section view through line F-F of FIG. 19, and an isometric view of FIG. 19 and associated break lines, respectively, which illustrate wall surface cultivation method (1) embodiments (1M, 1M1, 1M2) and associated apparatus (2) embodiments (2M, 2M1, 2M2) usable on strata bore (e.g. 100 to 115), a conduit (e.g. 53 to 57) and cable (72) wall surfaces that can provide a lattice of furrows (11) through said wall surfaces, which can later be grouted (13) to seal the various wall surface interfaces representing, e.g., possible fluid leak paths. Various selectively arranged and oriented embodiments can be used on a string comprising, e.g., drill pipe (94) or a string usable through, e.g., drill pipe (94) or tubing (60).

Alternatively, the cultivated wall surface convex protrusion (209) extending from the deepest end (207) of the convex (280) furrow protruding into the surface (6) to form a lattice of furrows that can be dislodged using various means, which can include, e.g., fluid jetting, explosives and/or milling, to join the plurality of planes (210) and associated separate surface regions (9) into a continuous plane (211) at the strata bore. Intermediate scraping of the surface regions can reduce the amplitude of the furrow cuts when wall surface debris is created and dislodged with less energy than otherwise is possible with the conventional practice of using abrasive jetting, explosives and/or milling to destroy the entire wall, wherein dislodging portions of separate surface regions of latticed metal and cement by first cultivating the downhole wall surfaces, can be more efficient.

Accordingly, cultivation can prepare the surface of a downhole wall for any suitable downhole ancillary apparatuses (7) comprising, e.g., milling tools, reamers, hole openers and/or expandable linings and/or any suitable spreadable substance (8) comprising, e.g., LCM, resin, cement, acid, fraccing fluids and proppants and/or reservoir pore space substances or facture operable substances.

The method (1) and apparatus (2) embodiments can comprise cutting (1M2) longitudinally oriented furrows (11) into a wall surface (6M2) using a longitudinally oriented apparatus (2M2) scraper (5M2) member, which can be radially deployed from a linkage (4M2) arcuately engaged between a deployment shaft (3M2) and the surface being scraped. The apparatus can be longitudinally moved to provide a substantial furrow separating wall surface regions (9M2) for use by an ancillary apparatus (7M2) or spreadable substance (8M2). The method (1M1) can comprise cutting transversely oriented furrows (11) into a wall surface (6M1) with a transversely oriented apparatus (2M1) scraper (5M1) member that can be radially deployed from an arcuate engagement linkage (4M1) carried by a deployment shaft (3M1), which can be axially rotated to transversely orient the furrow separated wall surface regions (9M1) for use by an ancillary apparatus (7M1) or a spreadable substance (8M1).

Alternatively, longitudinally and transversely axially oriented furrows can be cut (1M) into a wall surface (6M) with apparatus (2M) cutter and scraper (5M) members that can be axially and radially deployed from arcuate linkages (4M) engaged with a deployment shaft (3M), which can be both longitudinally moved and axially rotated to provide lattice wall regions (9M) associated with the lattice of longitudinally and transversely oriented furrows, which can be used by an ancillary apparatus (7M) or spreadable substance (8M).

For example, an apparatus (2M1) can comprise any conventional apparatus adapted according to the present invention to axially rotate an abrasive filament cutter, wherein an apparatus (2M2) that can centralize the rotated scraper (5M1) can also be adapted from conventional apparatus and comprise, e.g., a blade, bow spring and/or other arcuate linkages usable to longitudinally orient scraper members (5M2). Scraper members can also be adapted from conventional downhole cutting, according to the embodiments of the present invention, so as to be interoperable with other member embodiments to provide furrows and/or a furrow separated lattice of wall regions (9, 9M) comprising FIGS. 22 and 23 show diagrammatic elevation views of slices through a well that illustrate method (1) embodiments (1N and 1O, respectively) and apparatus (2) embodiments (2N and 2O, respectively) usable for cultivating a wall surface of a bore, conduit and/or cable within a subterranean well (52). It is to be understood that embodiments (1N to 9N and 1O to 9O) can be any apparatus (2) of the present invention, or can include a prior art or conventional apparatus that has been adapted according to the present invention, which can then be usable to cultivate (1) a wall surface.

For example, embodiments (1) to (9) of FIGS. 1 to 7 and FIGS. 12 to 21, can have transverse (192) and axial (193) dimensions deployable downhole and use longitudinally and/or transversely oriented arcuate linkages that can operate an extendable (142) and deflectable or retractable and draggable cutter and scraper members (5) that can be arcuately engagable (143) to a wall surface (6) and usable to separate said wall surface into longitudinally and/or transversely separated wall surface regional (9) planes, relative to the well's axis, wherein said separated regions (9) are usable by an ancillary apparatus (7) and/or spreadable substance (8).

A wall surface cultivating (1N, 1O) apparatus (2N, 2O) can place perforations (10) or furrows (11) in a wall surface (6N, 6O) of a strata bore or cement wall surface, conduit bore wall surface (e.g. 53 to 57, 60 and 94 to 96) and/or cable (72) wall surfaces and/or said cultivating (1N, 1O) apparatus (2N, 2O) can reduce the amplitude (12) of a concave protrusion into or convex protrusion out of the plane of a wall surface (6N, 6O), or remove the amplitude of said protrusions to join the various planes into a continuous plane, by cutting the convex protrusion from or grouting (13) a concave protrusion into the surface. Cultivating (1N, 1O) can include furrow perforating (10) of an opposite wall surface and/or furrowing (11) of an inner surface, wherein joining of the furrow separated surface regions can occur if the amplitude of the convex protrusions (12) formed between a furrow's deepest concave point, is removed, or if grouting (13) is used to fill a furrow. Such operations can occur through a first wall surface (e.g. 60 and 94) into a second wall surface (e.g. 95 to 96 and 53 to 57). For example, drill pipe (94) or tubing (60) bodies can be cut longitudinally together with their associated tool joints (95) or couplings (96), so that the strength of the rotary threaded connection and inner pipe (60, 94) cylindrical shapes are lost and can separate from the surrounding connector (96, 95) to part or separate (9N1) the tubular string for access to a previously obstructed surface.

Alternately, separating (9N1, 9O1) inner string (60, 94) wall surfaces (6N1, 6O1), couplings (95, 96) wall surfaces (6N2, 6O2) and separating (9N2, 9O2) the control line (72) surfaces (6N3, 6O3) can be used to remove at least part of the wall surface obstructing access to surrounding wall surface regions (9N, 9O), wherein further furrowing (11) and separation (9N3, 9O3) of a wall surface (6N4, 6O4) of the surrounding conduit bores (e.g. 53 to 56), surrounding cement and surrounding strata bore can occur. The separations (9, 9N, 9N1-9N3, 6O, 6O1-6O3) can be oriented transversely or longitudinally to the axis of the well (52), in any orientation of furrow perforations (10) or furrows (11). Subsequently, joining of the plurality of planes formed by said furrows can occur with removal of the amplitude (12) of the convex protrusions formed across the deepest furrow ends or by grouting (13) and filling a furrow's concave protrusion into the wall surface.

Cultivation (1N, 1O) can be actuated or powered by: an axial deployment string's compressive or tension energy (33) acting through a shaft (3N); fluid energy (34) passed through and/or about the deployment string and apparatus (2N, 2O); electrical energy (35) transferred through the apparatus (2N, 2O) and/or deployment string; and/or the energy of a chemical reaction (36) comprising, e.g. an explosion, a reagent reaction or a battery. Any energy transferred combinations can operate an apparatus (2N, 2O), wherein, e.g., a string may provide axial energy force (33) to deploy an electric (35) tool which has an electrical power generation turbine operated by fluid (34) passing through and/or around the string, and/or apparatus (2N, 2O) which operates a member and stores excess energy in a battery that latter uses the chemical nature (36) to release electrical (35) energy to provide a multi-energy source (37) apparatus (2N, 2O) and method (1N, 1O).

Various tubular (27) member parts can be selectively arranged to be interoperable with other members, e.g. the apparatus's (2N, 2O) shaft (6N, 6O) to provide fluid flow through (28) or about (29) said other members or parts of other members to further operate (1N, 1O) an apparatus (2N, 2O).

During operation of the method (1N, 1O) and apparatus (2N, 2O) fluid energy (34) can be selectively controlled with, e.g., a fluid valve ((44), shown in FIG. 57) and/or fluid choke (45), while axial string energy (33) can be translated into axial movement (38) and/or axial rotation (39). Electrical (35), fluid (34) and/or axial (33) energies can also be selectively supplemented through, e.g., the use of an actuating motor (42) or pump (40) and/or a spring (19) or piston (20).

Flexible arcuate linkages (4N, 4O) and the carried cutter and scraper members (5N, 5O) can be formed with, e.g., rigid (30) and/or flexible (31) parts, wherein elastic material (32), bendable filament (18) and/or hinges (41) can be used to provide a flexible arcuate engagement usable to engage a draggable scraper member and, in a manner comparable with agricultural or horticultural implements, provide for its cutting and retraction and/or deflection to prevent, e.g., burying the scraper member in a wall surface. Various actuating members, such as vibrating members (46) arranged with, e.g., a rotor and stator, can be used to operate a scraping member's flexible engagement with a surface (6N, 6O).

A scraper member (5N, 5O) can use edged (14) and/or abrasive (15) cutters that can have associated rigid (30) and/or flexible (31) parts. Scraper members (5N, 5O) can also incorporate a fluid nozzle (16) and/or basket (17) that scraps a wall surface (6N, 6O). Scraper members (5N, 5O) can also use a ploughing arrangement (166) that can use mainshare ((167), shown in FIG. 36), foreshare ((168), shown in FIG. 36), mouldboard ((169), shown in FIG. 36), coulter ((170), shown in FIG. 36) and/or cut regulator ((171), shown in FIG. 36) member parts.

Various apparatus (2N, 2O) member parts can also be made of fibre (47), plastic (48) and/or combinations thereof, that comprise composite materials (49) which can be buried in a wall surface and/or well and later removed through, e.g., boring. For example a portion of scraper buried within a bore can be used as a whipstock (50), wherein portions of the scraper member (5O1) can be made of composite material which is removed during boring of a side-track as a BHA is deflected off of the whipstock's lower metal end, similar to, e.g., embodiment (1Q and 2Q) of FIGS. 39 and 41.

For example, a cultivating (1N1) apparatus (2N1) can comprise a shaft (3N1) engaged abrasive (15) arcuately flexible filament (18) or plurality of filaments that scrape through one or more walls and across, or into, a wall surface to remove or reduce the amplitude (12) of protrusions from a wall surface, which can be followed by a basket (17) arranged with pedals to arcuately engage (4N1) and scrape (5N1) the same wall surface to remove associated debris, or grouting (13) a spreadable substance (8N1) into furrows to join the furrow separated surface planes and/or to further scrape and reduce their amplitude relative to the wall surface to, thus, prepare the wall surface for use by an ancillary apparatus (7N1), comprising, e.g., a packer, hanger or other downhole apparatus requiring a continuous substantially planar cylindrical surface that is free of significant protrusions into or out of the surface.

A cultivating (1N2) apparatus (2N2) usable to prepare a surface for use by ancillary apparatus (7N2) or spreadable substances (8N2) can comprise, e.g., a shaft (3N2) deployed arcuate engagement linkage (4N2) that can be made of an elastic material like a metal bow spring formed into a mouldboard (169), which can be actuated by a cut regulator (171) comprising a coiled spring (19) that operates linkage carried draggable cutter scraper (5N2) member, wherein an initial foreshare 168) cutter or coulter is followed by a mainshare (167) cutter scraper member part. Another apparatus (2N3) can also form a coulter (170) that precedes the foreshare (168) and mainshare (167) cutters. The amplitude of the edged (14) draggable cutters (167, 168) penetration into a wall surface can be control by the size of the cutter as the mouldboard (169) limits its protrusion into a wall surface.

Alternatively, or additionally, a cultivating (1N3) apparatus (2N3) can comprise, e.g., a nozzle (16), or a choke (45) jetting tool, or an abrasive slurry cutting tool adapted to provide longitudinal and/or transverse amplitude deviation in a surface's plane by cutting into or reducing deviations in the amplitude of previous cuts into the surface's plane by, e.g., cutting convex protrusions into a surface to form separated wall surface regions or grouting the previously cut concave protrusions into a surface to remove their amplitude. Grout can fill a furrow separation in a wall surface to provide a continuous plane at the previous surface or, alternatively, a wall surface can be separated by furrows to form regions, wherein the amplitude of planar deviations associated with said regions between the deepest end of the furrows can be removed or reduced until a continuous plane is formed at the point of the deepest concave protrusion into the surface.

The apparatus (2N3) fluid nozzle (16) or fluid choke (45) scraper (5N3) member can be rotated to provide an arcuate wall surface engagement with the surface, wherein adaptation of a car wash method can be incorporated to provide filaments comprising fibres (47), plastics (48) or composite materials (49), e.g. fibreglass arcuate engaging strands (4N3), with or without imbedded carried abrasive (15) cutters, that can be used with the fluid jetting or fluid slurry cutting to cultivate (1N3) a wall surface for use by ancillary equipment (7N3) or spreadable substances (8N3). Reagent or reactive chemicals (36) can be added to the fluid energy (34) flowing about (29) the apparatus (2N3) and applied to the wall surface, wherein fluid can be taken from within (28) the shaft (3N3) or from about (29) the shaft to provide the fluid scraper member (5N3) that can carry abrasive fluids and/or solids.

Cleaning removes debris from the surface that has accumulated, on the surface, without damaging the surface, whereas cultivation can cut and/or repair the surface for use. Accordingly, scrapers designed to clean debris without affecting a surface can be adapted to cut and/or repair a surface and abrasive fluid cutting apparatus can be adapted with the removal of hoses to cut longitudinally to provide a matrix or lattice of cuts. Abrasive cutting apparatus using choked (45) fluid energy (34) can be further adapted to cut, vibrate (46) and/or dislodge and separate surface regions from a planar wall surface to join and/or reduce the amplitude of inner cylindrical planes of separated wall surface regions relative to surrounding outer cylindrical planes of separated wall surface regions.

Cultivating (1O1) with an apparatus (2O1) can comprise using a plough-like arrangement (166) that can be adapted from the use of prior art, e.g. U.S. Pat. No. 8,376,043 B2, or conventional apparatuses in a variety of ways consistent with the flexible arrangements provided within agriculture and horticulture, e.g. those shown in FIGS. 33 to 36, which can include, e.g., (2P) of FIGS. 37 and 38. Alternatively, parts of the apparatus can also be arranged with composite materials to provide a whipstock (50), which can include (2Q) of FIGS. 39 to 41. Various edged (14) or abrasive and rigid or flexible (31) scrapers can be usable with or without actuating pistons and/or springs. Generally, the apparatus (2O1) can be arranged with a substantially arcuate linkage (4O1), which can be carried by an above subterranean surface hoisted shaft (3O1), wherein a substantially arcuate linkage (4O1) can be arranged for carrying scraper (5O1) members, which can engage a wall surface (6O1) so as to treat or cultivate the surface for subsequent use by an ancillary apparatus (7O1) or spreadable substance (8O1).

Alternatively, or additionally, cultivation (1O2) of a wall surface (6O2) can comprise using an apparatus (2O2), having a shaft (3O2) that rotates a flexible or rigid hinged scraper (5O2) member in a longitudinal orientation to the well bore axis to flexibly engage draggable foreshare (168) and mainshare (167) cutters across the wall surface (6O2), which can be usable by the present method. A mouldboard (169) can comprise a portion of the scraper (5O2) member without cutters that can also contact and engage the intended or targeted surface, wherein dependent upon cutter penetration during each engagement, as the scraper is selectively rotated the controller (171) of the arcuate engagement path (4O2) associated with dragging or scraping edged or abrasive cutters across the wall surface (6O2) can adjust to provide a flexible arrangement. The treated or cultivated wall surface (6O2), as shown in FIG. 23, can then be used by an ancillary apparatus (7O2) or spreadable substances (8O2). Rigid and hinged edge prior art cutters can be adapted to emulate various agricultural or horticultural implements to provide a flexible hinged arrangement to a rotating motor (42) driven shaft that can reduce deflection transverse to the rotating path (4O2), to further reduce the possibility of dragging the scrapers across and damaging the apparatus (2O2) itself. For example, prior art and conventional apparatus, e.g. U.S. Pat. No. 2,708,335 and U.S. Pat. No. 6,025,907, can be adapted for downhole use as an apparatus (2O2) with an abrasive filament to provide longitudinal oriented cultivation.

Any arcuate rotated arrangement using a filament to cut a furrow or trench transversely, or any cutting wheels, hinged knives and/or filaments arcuately used to cut a furrow trench longitudinally into a wall surface or to join separated planar regions by reducing the amplitude of deviations from the plane of the wall surface can use a flexible arcuate engagement linkage, according to methods of the present invention, wherein arcuate engagement can be actuated by axial rotation of, e.g., an arcuately flexible abrasive cutting filament applied to the surface of the wall by an above subterranean rotated shaft (3) and/or applied by a downhole motor shaft (3) rotating said filament.

Additionally, or alternatively, cultivation (1O3) with an apparatus (2O3) can comprise adapting a prior art or conventional rotating tool, e.g. U.S. Pat. No. 4,926,557, U.S. Pat. No. 4,942,664, U.S. Pat. No. 6,025,907, U.S. Pat. No. 7,966,736 B2, U.S. Pat. No. 7,979,991 B2, US 2011/0005185 A1 and US 2012/0266705 A1, with an arcuate (4O3) engagable flexible (31), elastic (32), filament (18) and/or a hinged linkage, that can be usable to carry an abrasive or edged cutter and scraper (5O3) member, which can be oriented to axially rotate (39) on a shaft (3O3) within a plane transverse to the longitudinal axis of the well bore and cultivate (1O3) a downhole cable's wall surface (6O3) or tubing (60), drill pipe (94) or casing/liner (53-57) wall surfaces (6O4) to separate (9O3) said wall surfaces for subsequent use by ancillary apparatus (7O3) and/or spreadable substances (8O3).

Referring now to FIGS. 24 to 36, which illustrate various prior art that are silent to the innovative features of the present invention, but can be adapted for downhole use within the methods of the present invention.

Adaptation within the scope and spirit of the present invention can include providing interoperability between the various described members and other: strings, downhole tools and downhole tool members that extend to the surface systems comprising, e.g., rigs, wellheads, valve trees, control and/or signal processing systems, wherein a string deployed assembly of apparatus (2) members can be selectively arrangable to provide actuation and a functional synergy between all engaged systems, tools and elements of a well, which can be capable of downhole operation and/or signal conductance and the conversion of mechanical, electrical, explosive and/or hydraulic energy into an associated force, or alternatively to absorb a force and convert it into energy, that, in an amalgamation is usable to provide an interoperable apparatus (2) and method (1) of the present invention.

Adaptation of conventional and prior art apparatuses and/or actuation of any apparatus (2) or associated tool or function within a string of an apparatus (2) or associated tools may comprise any manner of interoperability between the string, the apparatus (2), associated tools and/or connected surface systems. The selectively arrangable and selectively actuatable apparatus (2) of the present invention can further comprise, e.g., any suitable downhole self-actuating or remotely actuated members, associated tools, and/or associated tool members, which can comprise, for example (e.g.) control or actuation systems using: i) a burst disc comprising, e.g., glass, dissolvable salts, metals, ceramics or plastics; ii) timers comprising, e.g., fuses, clocks or chemical reactions; iii) rotation, tension or compressive forces comprising, e.g., string tension, string weight, sinker bars, jars, string momentum or spudding, rotary speed, and/or rotary torque; iv) fluid pressure comprising, e.g., hydrostatic pressure, differential pressure and/or trapped atmospheric pressure at a subterranean depth; v) temperature comprising, e.g., heating, cooling, super-cooling and/or temperature differentials, vi) chemical reactions comprising, e.g., reagents, swelling, shrinking, explosions, liquification, gasification, congealing, and/or dispersing, vii) transducers comprising, e.g., crystalline materials, ceramics, magnets and/or coils, and viii) signals comprising the transmission of, e.g., electricity or axial energy, comprising mechanical energy or kinetic energy and/or chemical energy which includes thermal energy.

Adaptation of conventional and prior art apparatuses and/or interoperability of various connections between various parts of an apparatus (2) can include various members, associated tools, associated tool members and associated deployment strings that can be selectively arranged and actuated, wherein connections between various components can be any type of connector comprising, for example: i) rotary connectors, ii) snap connectors, iii) slip and segmented slip connectors, iii) shear pin connectors, iv) spring connectors, v) joint connectors comprising, e.g., ball joints, knuckle joints, hinge joints and/or flexible material joints, vii) dogs or mandrels and their associated receptacle connectors, viii) coupled connectors comprising, e.g., glues, welding and/or spikes, ix) membrane expandable or swellable connectors, and/or x) segmented connectors comprising, e.g., fans, screens and/or baskets.

Furthermore, selective arrangements of adapted conventional and prior art apparatuses and/or the embodiments of the apparatus (2) of the present invention can include providing interoperability between members and associated surface systems, strings and well elements that are capable of signal conductance and that can comprise, e.g., i) drilling rig jointed pipe strings, ii) rig-less jointed pipe strings, iii) preferred coiled strings comprising, e.g., coiled tubing strings, electric line strings, slickline strings, iv) tubing, v) casing vi) cement within the strata and/or vii) strata about the casing and cement.

FIG. 24 shows an isometric view of a prior art multi-finger calliper (117), oriented horizontally, showing conventional pivot arms (174) that, contrary to various embodiments of the present invention, are generally extended axially downward and laterally outward or retracted laterally inward and upward from the housing (177) and shaft (176), to prevent impacting and/or binding the pivot arms into a subterranean surface, like an anchor in the sea bed or a fish hook into the skin, when hoisting the calliper (117) axially upward within a well. Calliper's can be used with the present invention to empirically measure cultivation and/or can be adapted with abrasive or edged scraper members usable to cultivate a surface according to the scope and spirit of the present invention.

Countless prior art lessons teach shafts, cam faces, pistons, pivot arms, cutting wheels and hinges arranged for extension and retraction of, e.g., the calliper's (117) pivot arms (174) as shown, wherein such teachings are generally contrary to, e.g., a slickline brake which is used to stop tools from being blown uphole.

Pivot arms are commonly used in a multi-finger calliper (117) and within, e.g., U.S. Pat. No. 6,478,093's disclosure of a possible packer splitter (190 of FIG. 96), whereby conventional pivot arms are generally oriented away from axially upward hoisting so as not to form a hook-like arrangement that can be imbedded in a side wall surface when a tool is hoisted out of a well bore.

Embodiments of the present invention provide a flexible arrangement for extension and retraction of a pivot arm that can be oriented, contrary to conventional practice, to facilitate the transferring of axial hoisting force to kinetic drag energy that can longitudinally cut and align the pivot arms primary axis of strength with hoisted cutting, while orienting the lever of the pivot arm for retraction, using mass and axially downward movement of the apparatus. Expansion and contraction of various shaft members and/or pistons can be usable to allow easy reconfiguration and/or cutter deflection to reduce binding. A spring-like device ((19) of FIGS. 85 to 94) can be included to improve kinetic drag force applied to a wheel cutting while reducing the propensity for binding, impaction and/or sticking of the cutter into the surface when the apparatus (2) is hoisted axially.

In instances where deactivation using a jarring motion is desired, orienting the pivot arms of the present invention, contrary to conventional practice and in a seesaw and/or axially upward orientation, can be usable to form a change in diameter between the uncut surface and the furrow cut surface to allow jarring of the apparatus (2) against said change in diameter and, e.g. shear a coupling holding tension force between various shafts to, thus, release and/or relax the forces acting on the shafts or pistons to allow the pivot arm and cutter to retract from the surface being cut.

Further provisions to reduce the probability of imbedding the apparatus's (2) cutter (5) into a subterranean surface (6) can be further mitigated by using mandrel connectors in, e.g., the pivot arms and/or cutter, which can be sheared by jarring the apparatus against the point of surface embedding. After shearing a connection, the majority of the tool can be retrieved and, where necessary, the remaining pieces can be fished from the well using, e.g., a magnet.

FIG. 25 depicts an elevation view of a slice through a prior art well bore cleaning tool (118), described in U.S. Pat. No. 6,148,918, which uses scratching filaments to clean a surface but is silent to forming concave protrusions into or reducing the amplitude of surface planes associated with convex wall surface protrusions, which are substantial and do not simply comprise debris stuck to the surface. Other similar apparatuses can also be adapted with, e.g. super abrasive filaments to be used with the present embodiments for cultivating a wall surface, according to the scope and spirit of the present invention.

FIGS. 26, 27 and 28 illustrate elevation views of a prior art: casing centralizer ((119), shown in FIG. 26) with a quarter section removed, a mechanical through tubing centralizer ((120), shown in FIG. 27) for centralizing wireline tools, described in U.S. Pat. No. 5,575,333, and U.S. Pat. No. 5,785,125, and a wheeled centralizer ((121), shown in FIG. 28), descried in U.S. Pat. No. 7,090,007 B2, respectively.

Various adaptations, within the scope and spirit of the present invention, can be applied to the prior art apparatuses (119-120), to change or modify the apparatuses into, e.g., draggable scraper members and flexible arcuate spring arrangements, which can be usable to longitudinally and/or transversely cultivate a wall surface for subsequent use by an ancillary apparatus or spreadable substance.

FIGS. 29 and 30 show an isometric view and an elevation slice through a well for a prior art pipeline cutter ((122), shown in FIG. 29 and downhole mill ((123), shown in FIG. 23), as described in U.S. Pat. No. 7,726,028 B2 and 2009/0308605 A1, respectively, that can be adapted and changed from their rigid engagement methods to provide a flexible engagement arrangement by adding, e.g., opposing scrapers that are arcuately flexible, e.g. opposing abrasive filaments on downhole mill (123) and opposing bow spring linkages on pipeline cutter (122). Alternatively, other adaptations within the scope and spirit of the present invention can also be applied.

FIG. 31 depicts an elevation view of a slice through a prior art tubing cutter, as described in U.S. Pat. No. 7,575,056 B2, whereby similar transverse cutting apparatus (124) can be adapted with a flexible arcuate linkage for forming transverse furrows and/or can be adapted to provide longitudinal furrows within a wall surface for a more cost effective use of a subsequent ancillary apparatus or spreadable substance. While U.S. Pat. No. 7,575,056 B2 teaches arcuate engagement, which is generally rigid but could be adapted, using the teachings of the present invention, to become flexible and draggable, such prior art is also silent to substantial longitudinal and/or transverse furrowing to provide separate surface regions that are usable by ancillary apparatus or spreadable substances. Additionally, apparatus similar to U.S. Pat. No. 7,575,056 B2 are intended for a smooth inner circumference and are silent to cutting across more than one surface, and controlling the depth of the cut, to provide a plurality of concave protrusions into a surface. Additionally, conventional and prior art rigid cutting arrangement lessons can increase the propensity of binding and burying the right angle deployed cutters (124) into the well when a plurality of cutters are operated concurrently, and the cut pipe impacts upon the right angle member deploying the cutter.

The present invention provides the further significant benefit by passing a solid or insulated slickline through the apparatus (2) and, hence, is compatible with transmitting mechanical waves through solid slickline or electricity through insulated slickline. A solid slickline arrangement, using mechanical pulses, can pass through a central passage in a shaft member or surface sensing of the mechanical waves passed through the slickline can be adapted to account an apparatus (2) slip engagement. For insulated slickline arrangements, a central passage for solid slickline and an alternative, e.g. a timer or pressure, actuator can be used to prevent adverse engagements with the insulation of an insulated slickline.

FIG. 32 illustrates a cross section through a prior art filament (18) with affixed super abrasive (15) grain structures comprising, e.g., those described in EP 2,497,602 A1, which can be used and/or adapted (125) for use as a scraper member according to the scope and spirit of the present invention.

FIGS. 33 and 34 show an isometric view and an elevation cross sectional view, respectively, of a prior art weed trimmer described in U.S. Pat. No. 4,926,557, as well as the various other cited references, that can be used to cut weeds horizontally. FIG. 35 depicts an elevation view of a weed trimmer (98), as described in U.S. Pat. No. 2,708,335 that can be used to cut weeds vertically. The apparatus and method taught within conventional practice and prior art can be adapted (126) for the downhole cultivation (1) of a surface (6), whereby the application of abrasive (15) filaments (18) can be used to form longitudinal and/or transverse longitudinal concave protrusions into a surface (6) and/or reduce the amplitude of convex protrusions from a surface (6) by scraping (5) the convex protrusion or surface with a flexible engagement in a longitudinal or transverse orientation, whereas conventional practice and prior art generally teach a rigid engagement.

The adaptation ((127), shown in FIG. 34) of a the various conventional and prior art methods and apparatus (99) for selectively controlling the operation of a filament, and various other scraper members, can be adapted and arranged for a downhole environment based upon the use of the embodiments of the present invention.

FIG. 36 illustrates an elevation view of a prior art plough used in the cultivation of organic surfaces whereby a mainshare (167), a foreshare (168), a mouldboard (169) connected via a linkage (116) to the coulter (170) and/or a cut regulator (171) can be present. A mainshare (167), foreshare (168), mouldboard (169), coulter (170) and/or a scraper regulator (171) adaptation (128), according to the embodiments of the present invention, can be applied to a conventional downhole practice to form an apparatus (2) that can be usable to cultivate (1) a well bore, conduit and/or cable by forming longitudinal and/or concave protrusions into a surface (6), using the mainshare (167), foreshare (168) and coulter (170) and/or reducing the amplitude of convex protrusions from a surface (6) by using one of said scraping (5) members for scraping the convex protrusion extending from the plane of a surface (6), or for grouting a concave protrusion into the surface using the mouldboard (169), wherein cultivation can be selectively controlled by a scraper regulator used to adjust the scraper's amplitude variation.

Referring now to FIGS. 37 to 46 showing various method embodiments (1) and apparatus embodiments (2) usable with rotary strings and strings deployable within completions.

FIGS. 37 and 38 illustrate a plan view with line G-G and an elevation view of the cross section through line G-G of FIG. 38, respectively, for a method (1) embodiment (1P) and apparatus (2) embodiment (2P) for cultivating a wellbore.

Cultivation (1P) of a wall surface (6P) can comprise using an arcuate path (143) engagement linkage (4, 4P) operated scraper member (5, 5P) flexibly extended and deflectable from a shaft (3, 3P) via a piston (20) arrangement within the blades of a stabiliser (132) apparatus (2P), which can be connectable to a drill string via tool joints (96) and usable to longitudinally separate wall surface (6, 6P) regions (9, 9P) of a conduit or strata bore for use with ancillary apparatus (7, 7P), which can comprise, e.g., a sleeve usable to operate the internal fluid passageway (28) and associated piston (20) and/or a spreadable substance (8, 8P) comprising, e.g., drilling slurry.

The apparatus (2P), linkage (4P), scraper (5P) and shaft (3P) can be selectively arranged to provide a mainshare (167), foreshare (168), mouldboard (169), coulter (170) and/or a cut regulator (171) that can comprise a piston (20) operated from internal drill string fluid energy pressure, wherein any scraper (5P) is engagable to the piston (20) for flexible extension and deflection according fluid pressure cushion within the piston to provide longitudinal furrows, with circulation pressure and axial reciprocation of the drill string and longitudinally transverse scraping when axially rotated. The illustrated arrangement can provide benefit in vertical bores and instances where back-reaming is not problematic. In extended reach wells where back reaming can be problematic, the edged scrapers can be replaced with abrasive scrapers to reduce convex protrusions from the plane of the bore wall surface. When the foreshare (168) and coulter (170) members of the scraper (5P) are not present, the piston is usable to centralize the stabiliser to prevent digging into high inclination side walls. Accordingly cultivation (1) can provide benefit over the conventional practice of limiting back-reaming within bores of high inclination by allowing the removal of convex protrusions to provide a more continuous circumferential plane.

FIGS. 39, 40 and 41 show a plan view with line H-H, an elevation view of a cross section through line H-H of FIG. 39, and an isometric view, respectively, of a method (1) embodiment (1Q) and apparatus (2) embodiment (2Q) usable for cultivating a wall surface of a well and providing, e.g., a whipstock (50).

An apparatus (2Q) can be used to cultivate (1Q) a wall surface (6, 6Q) with a scraper member (5, 5Q) extended with an arcuate engagement (143) linkage (4, 4Q) from the shaft (3, 3Q), whereby the scraper and linkage can comprise a combined arcuate scraper (4Q, 5Q) usable by the apparatus (2Q) to separate wall surfaces (9, 9Q) for use by and ancillary apparatus (7, 7Q), comprising e.g. a foam wiper ball, and/or spreadable substance (8, 8Q), comprising e.g. cement or resin usable to anchor the lower whipstock end (2Q2) of the apparatus (2Q) to the wall surface (6Q) regions (9Q). An upper end (2Q1) can comprise, e.g., a fibre (47), a plastic (48) and/or a composite material (49) that can be bored through, during subsequent side-track operations deflected form the lower (2Q2) whipstock end, wherein the lower end can further comprise a whipstock surface or be an adapted conventional whipstock (50). It is to be understood that the length of the whipstock can be significantly extended to provide a conventional whipstock inclination for kick-off during boring.

The apparatus (2Q), linkage (4Q), scraper (5Q) and shaft (3Q) can be selectively oriented and arranged to be interoperable to provide a mainshare (167), foreshare (168), mouldboard (169), coulter (170) and/or a cut regulator (171) that can comprise a filament (18) downhole reel (165), which can be adapted from, e.g., a fishing reel and operated with a flat spiral coiled spring (19), downhole motor (42) or any other suitable downhole actuating devices, usable to control the length of filament extended from the stabiliser (132) and longitudinal arcuate engagement from the stabilizer blade. A filament (18) arcuate (4Q) scraper (5Q) member can be secured in an arcuate loop, as shown, or provided with a free end that is rotated (39) in an arcuate path (143) to furrow into a surface (6Q).

FIG. 42 depicts an elevation diagrammatic view of a slice through a well for a method (1) embodiment (1R) and apparatus (2) embodiment (2R) that can be used to place a whipstock (50) and kick-off cement plug to side-track a well after becoming stuck in the hole (164) and severing and leaving the lower end of the drill string BHA (130) down hole, wherein a BHA can comprise, e.g., heavy weight drill pipe, stabilisers (132), drill collars (131) and a boring bit (133). Becoming stuck in the hole, and as a result needing to side-track the well, is a significant problem due to the propensity of the side-track to follow a cement kick-off plug which is softer than the surrounding formation. Additionally, the low patience levels of drilling practitioners when waiting-on-cement, can cause over optimism on the hardness of the cement that can necessitate repeating the cementation and result in a relatively high daily cost for the drilling operations.

A scraper member (5, 5R) can be used to cultivate (1R) a wall surface (6, 6R) into regions (9, 9R) using an arcuate engagement linkage (4, 4R), which can be carried by a shaft (3, 3R) and can comprise, e.g., an abrasive (15) filament (18) that furrows deep into the surface (6, 6R) during rotation (39) of the apparatus (2R), which can comprise an adapted stabilizer with lower end cementing conduit ancillary apparatus (7, 7R) usable to place a spreadable substance (8, 8R) like cement used for a side-track kick-off plug.

Engaged drill pipe and the apparatus (2R) upper stabiliser (2R1) portion can comprise a fibre (47), plastic (48) and/or composite material (49) that can be easily bored through while the lower end (2R2) can comprise a whipstock (50), which can be made of a metal and anchored to the strata bore (59) with filaments (18) and cement (8R) that can be pumped around (29) the apparatus (2R) to tie it to the wellbore after the cement fully sets.

Accordingly, the time and expense spent waiting-on-cement during an open hole (59) side-track can be saved by inclusion of arcuate (4R) scraper (5R) members that can be rotated (39) to furrow into and anchor to the side wall so as to provide a lower end whipstock with an upper end drillable portion.

FIG. 43 illustrates an elevation diagrammatic view of a slice through a well for a method (1) embodiment (1S) and apparatus (2) embodiment (2S) that can be used to isolate a passageway behind a liner or casing which, in practice, can represent a significant problem during boring and abandonment operations because high pressure fluids from strata (100-115) can enter the well bore behind a poorly cemented liner and rupture or collapse casing, whereby the strength of the strata (100-115) at that depth may be insufficient to support a weighted fluid column necessary to kill the trapped fluid pressure and repair the annulus using conventional practice.

A wall surface (6, 6S) can be prepared by a draggable scraper member (5, 5S) comprising, e.g., a super abrasive (15) cutter that is flexibly engaged via an arcuate linkage (4, 4S) comprising, e.g., a filament (18), deployed from a shaft (3, 3S) to cultivate (1S) and separate the wall surface (6, 6S) into regions (9, 9S), which can be usable by an ancillary apparatus (7, 7S) comprising, e.g., a bridge plug (163) and/or a spreadable substance (8, 8S) comprising, e.g., a kill weight fluid supported by the bridge plug of sufficient weight to circulate any trapped fluid pressure behind the liner out of the well followed by, e.g., cement to seal the poor cementation behind the liner.

An additional benefit of the present invention can comprise the relatively low torque required to operate a scraper (5). Accordingly, the lower end of the drill pipe (94), the apparatus (2S) and/or the bridge plug (163) can comprise composite fibre and plastic material of sufficient strength to perform rotation and cementation that can also be left in place during cementing operations used to repair and seal the annulus between the smaller diameter liner (57) and larger diameter liner (56). The composite fibre portion of the apparatus can later be bored through after the repair. As cement is a heavy fluid, the application of pressure to squeeze the cement will force it downward to seal passageways and prevent fluid pressure energy (34) from entering.

FIGS. 44, 45 and 46 show an elevation diagrammatic view of a slice through a well with detail lines I and J, a magnified diagrammatic elevation view within line I, and a magnified diagrammatic elevation view within line J, respectively, for a method (1) embodiment (1T) and apparatus (2) embodiments (2T, 2T1, 2T2) that can be used through a well completion, wherein the tubing (60) is hung from a tubing hanger (78) to support a safety valve (71) and control line (72) extending downward to hanger (134) production packers (76), whereby the well accesses the strata (100-115) through perforations (137) and the spent perforating guns (162) were left in the hole. The present invention provides significant benefit over conventional practice and prior art by providing relatively simple and cost effective solutions to preparing the many surfaces associated with, e.g., the swages (80), nipples (79), packers (76), valves (71), control lines (72) and/or wireline entry guides (77) during a well completion.

Cultivating (1T) a wall surface (6T) can include using a draggable scraper member (5, 5T) that can be flexibly engaged via an arcuate linkage (4, 4T) deployed from a shaft (3, 3T) to form an apparatus (2T) that can separate the wall surface (6, 6T) into regions (9, 9T) usable by and ancillary apparatus (7, 7T) and/or spreadable substance (8, 8T).

An apparatus (2T1) can comprise using a shaft (3T1) with a series of longitudinally spaced arcuate linkage (4T1) abrasive scrapers (5T1), e.g. abrasive (15) filaments (18), that can transversely separate wall surface (6T1) regions (9T1) when rotated (39) using, e.g., a surface or downhole motor application of axial forces to the shaft (3T1). The method provides significant benefit because it can be used in isolation or incorporated with longitudinal furrowing of a production packer (76) and hanger (134) to avoid the conventional practice and prior art methods of milling such a heavy ancillary apparatus. As filaments (18) can be more easily separated from the shaft (3T1) the method and apparatus are less likely to become buried in the well if portions of the packer (76) or hanger (134) lodge between the shaft and the side wall.

The method (1T) can include using a shaft (3T2) to rotate (39) arcuate linkage (4T2) scraper (5T2) members comprising an abrasive (15) filament (18) arrangement similar to that of a weed trimmer to separate wall surface (6T2) regions (9T2) for the tubing (60) and control line (72) above the safety valve (71), wherein the apparatus can be centralised and the length of the filament (18) can be controlled to avoid cutting the production casing (55).

A crushing piston ancillary apparatus (7T) and spreadable substances (8T) comprising viscous and/or weighted sealing fluids used to aid crushing and/or cleaning of a bore, liner or casing (55) to aid cement or resin sealing, wherein the primary cement (58) behind the casing and/or liner can be logged to confirm its competence. If the primary cementation is unsuitable, significant benefit can be added by the embodiments of the present invention, which include the ability to form a lattice of separated surface regions that can provide access to allow sealants to be placed around poor cement bonding, by squeezing the sealant or cement into furrows or furrow perforations.

Alternatively, the present invention can use longitudinal furrows or a series of perforations to increase the likelihood of squeezing cement to a wet shoe (161) and, thus, provide significant benefit over the conventional practice and prior art use of small round holes provided by conventional perforating (137).

Referring now to FIGS. 47 to 50 illustrating various method embodiments (1) and apparatus embodiments (2) usable with, e.g., wireline or slickline rigs.

Figure 47:
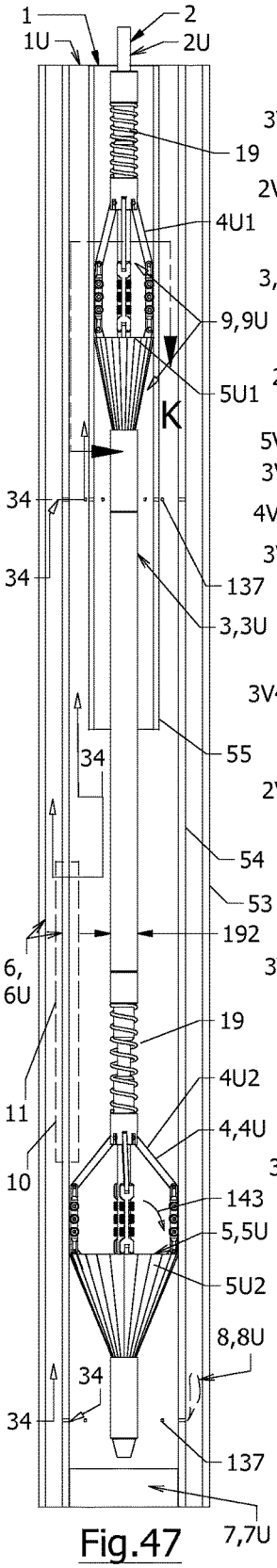
FIGS. 47 and 48 illustrate scraper member substance application embodiment (U).
Figure 48:
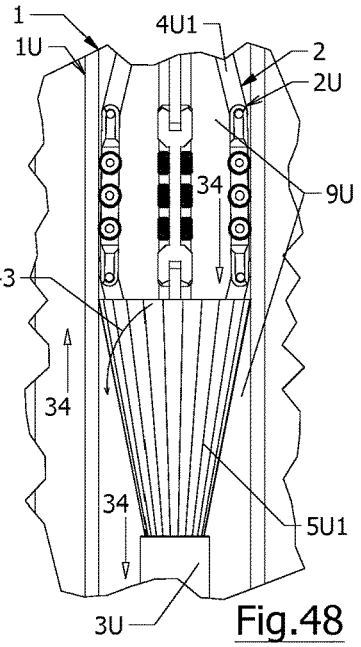

FIGS. 47 and 48 illustrate an elevation view of a slice through a well with detail line K and a magnified detail view within the line K of FIG. 47 for a pedal scraper apparatus (2) member embodiment (2U) usable with method (1) embodiment (1U) to apply a spreadable substance (8) and squeeze cleaning and cementing fluid embodiments (8U) into various well spaces.

The use of an ancillary apparatus (7, 7U) and/or a spreadable substance (8, 8U) squeezed (1U) between two scraper members (5U1, 5U2) can arranged by cultivating (1U) a wall surface (6, 6U) with draggable scraper members (5, 5U) that can be flexibly formed with a pedal baskets (17) arcuately (143) engage the linkage (4, 4U) embodiments (4U1, 4U2) deployed from a shaft (3, 3U), so as to separate the wall surface (6, 6U) into regions (9, 9U) to apply fluid energy (34) and squeeze a spreadable substance (8, 8U) through furrows (11), perforations (137) and against, e.g., a bridge plug ancillary apparatus (7U).

The cultivating (1U) application of a spreadable substance provides significant improvements over conventional practice and prior art, which is silent to using fluid pressure with arcuately engagable (143) scrapers, adaptable and arrangable using features of the present invention, to better fill or grout a concave protrusion into the surface of a wall, because the method (1) and apparatus (2) of the present invention provides a system, wherein, e.g., the perforations (137) can be replaced with longitudinal furrows (11) or a longitudinal series of perforations (10) that provide improved fluid communication, such that the squeezing of a spreadable substance is significantly improved. For example, while cement may be squeezed through a hole into a space, the cleaning of said space using, e.g., surfactants is limited through conventional perforations. The additional and significant benefit of adding furrow perforations, that pass through a first conduit (54) wall to access a space or to allow the scrapers (5U) to engage a second conduit (53), can be used to reduce eccentricity through centralisation of the inner conduit (54) via the arcuate engagement linkages passage through the wall to a second surrounding surface and can be usable to apply a viscous surfactant that better cleans and prepares the surfaces (6U) for squeeze cementing.

Figure 49:
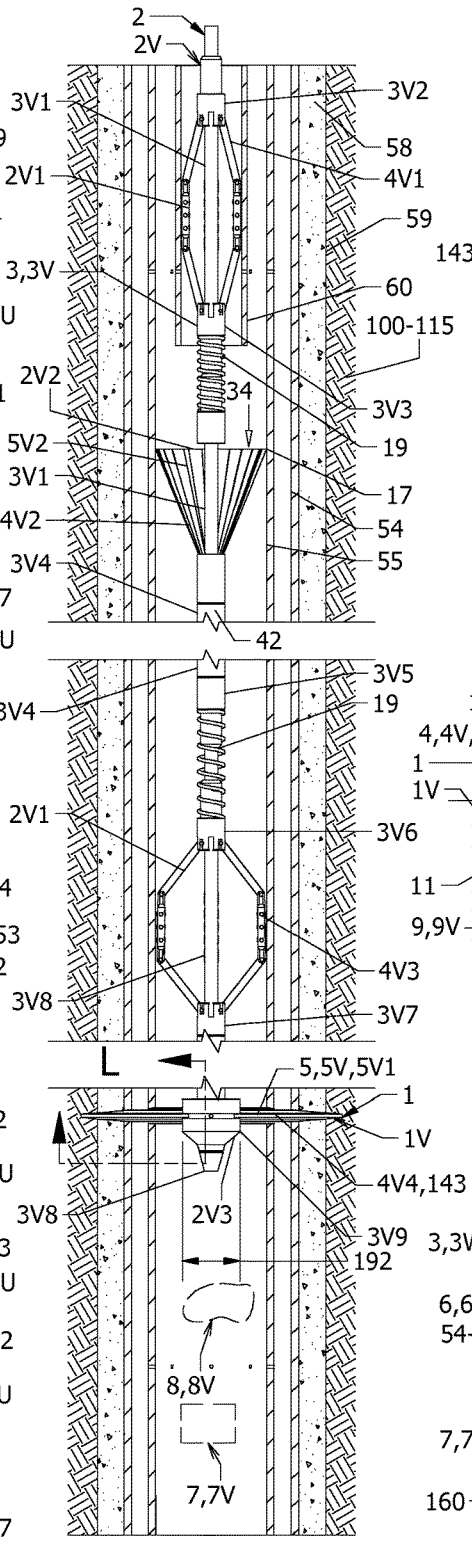
FIGS. 49 and 50 show rotary coiled string embodiment (V).
Figure 50:
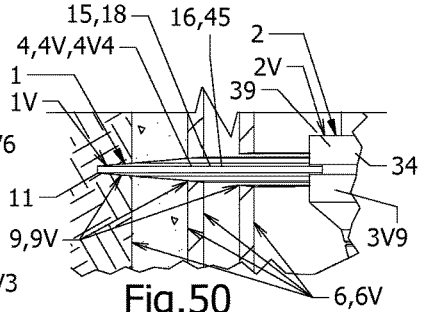

FIGS. 49 and 50 show an elevation view of a slice through a well with detail line L and a magnified detail view within the line L of FIG. 49 for a rotary filament method (1) embodiment (1V) and apparatus (2) embodiment (2V) that can be used for forming a furrow (11) transverse to the longitudinal axis of the well and/or furrows oriented longitudinally to the axis of the well during cultivation of a wall surface (6, 6V) thereof.

An apparatus (2, 2V) to prepare a wall surface (6, 6V) for use by an ancillary apparatus (7, 7V) and/or a spreadable substance (8, 8V) using a method of cultivation (1V) can use a draggable scraper member (5, 5V) comprising, e.g., a basket (17) to seal against a conduit to direct fluid through ((28), as shown in FIG. 59) a shaft (3V4) to operate a fluid motor (42) that can be used to axially rotate (39) as shaft (3V9) using the fluid energy (34) from the motor to operate an abrasive (15) filament (18) scraper (5V) arrangement (2V3), or alternatively, fluid can be directed via the basket (17) to a choke (45) to operate a fluid jet scraper (5V) nozzle (16), that can be flexibly engaged to the surface (6, 6V) in an arcuate path (143) to abrade or jet a furrow (11) using an arcuate axial rotating (39) linkage (4, 4V) deployed from a shaft (3, 3V) to furrow and separate the surface (6, 6V) into regions (9, 9V).

The apparatus (2V) can be adapted with centralizers (2V1), and the apparatus (2V) shaft (3V) can comprise a centralisation and basket actuation shaft (3V1) that can pass through the centralisation shafts (3V2, 3V3) operating arcuate centralization linkages (4V1) that can be flexibly engaged to conduit walls via the mechanical energy of a coiled spring (19), such that a basket (17) centralization scraper member (5V2) can collect and direct fluid energy (34) into a shaft (3V4) housing a fluid motor (42) that operates a rotary shaft (3V8) passing through shafts (3V5-3V7) and a coiled spring (19) operating a centralizing arcuate linkage (4V3), wherein shaft (3V8) is usable to rotate shaft (3V9) when deploying combined arcuate linkage (4V4) and scraper (5V, 5V1) members that are usable to cultivate (1V) the wall surface (6V) by separating the surface into regions (9V) using a transversely oriented furrow (11) with, e.g., either an abrasive (15) filament (18) combined (4V4,5V1) member (2V3) or a fluid jetting nozzle combined (4V4, 5V1) member (2V3).

Prior art is silent to downhole abrasive filament cutting of conduits, whereby the present invention provides significant benefit over conventional and prior art abrasive jet cutting by providing the ability to pass through tubing (60) to cultivate casing (54, 55) without the conventional limitation of shallow operations that are suitable for the numerous conventionally necessary cables and hoses required for conventional abrasive jet cutting of multiple conduits and cables.

A fluid motor (42) is depicted, but it is to be understood that any form of energy and/or motor is usable and may comprise, e.g., electricity and a downhole electric motor or axial rotation using a surface driven top drive and rotary string.

Referring now to FIGS. 51 to 66, which depict various method embodiments (1) and apparatus embodiments (2) that can be used with various arcuate engagement paths or arcuate shaped members comprising a bow-shaped bascule arrangement, wherein, like the engagement of a rocking horse, one end of the arcuate linkage bow-shape engagement to the shaft (3) is counterbalanced by the other end of the shaft engagement.

Figure 51:
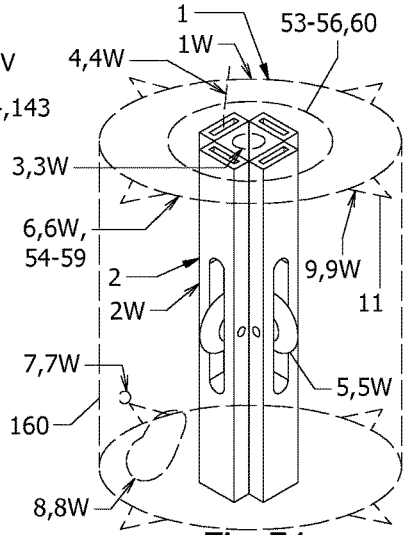
FIGS. 51 to 66 depict embodiments (W) to (AD) that can be usable as a bascule arranged arcuate spring.

FIG. 51 shows an isometric view for a method (1) embodiment (1W) and apparatus (2) embodiment (2W) that can be used to form a wall surface furrow (11) during cultivation of a wall surface (6, 6W) of a conduit (54-57), cement (58) and/or bore (59) after passage through a smaller diameter conduit (53-56 and 60) bore.

A scraper (5, 5W) apparatus (2W) for cultivation (1W) of a wall surface (6, 6W) can be formed by selectively arranging a draggable scraper member (5W) and associated engagement arcuate linkage (4, 4W) deployed from a shaft (3, 3W) to separate the surface (6, 6W) into regions (9, 9W) for use by an ancillary apparatus (7, 7W) and/or a spreadable substance (8, 8W). Longitudinal furrows (11) are depicted but it is to be understood that providing any concave protrusion into any wall surface plane, which is shown as a cylindrical plane (160), or reducing the amplitude of convex or concave wall surface planes by, e.g., shaving or honing and, thus, reducing the amplitude of a convex protrusion out of the surface plane; or by filling and grouting a concave protrusion into the wall surface plane can be used to provide a continuous plane via cultivation of the wall surface.

FIGS. 52, 53 and 54 illustrate a plan view, isometric view with detail line M, and a magnified view with line M of FIG. 53, respectively, for a method (1) embodiment (1X) and apparatus (2) embodiment (2X) that can be used with an arcuate bow (143) spring (19) member. Cultivation (1X) of a wall surface (6, 6X) can use a scraper (5, 5X) apparatus (2, 2X) that can be formed by selectively arranging a flexibly engagable and deflectable scraper member (5X) extended and retracted with an arcuate engagement (143) linkage (4, 4X) comprising a bow spring (19) selectively arranged with a plurality of shafts (3, 3X) to furrow and separate regions (9, 9X) of the surface (6, 6X) for use by an ancillary apparatus (7, 7X) and/or a spreadable substance (8, 8X).

The use of bow springs (19) provides the benefit of a relatively low cost and simple implementation of the cultivating (1X) method and apparatus (2X), wherein an actuator may grip a shaft receptacle (159) and swallow the shaft (3X1) to urge movable shafts (3X2, 3X3) axially along the central shaft (3X1) toward the scraper members (5X) to compress the bow spring (19) and radially and arcuately force the bow spring engagement to the pad (158) and associated fastener ((157), as shown in FIGS. 40-41) engaged scraper members (5X) to radially extend (143) and flexibly engage the wall surface (6X), wherein the scrapers (5X) are draggable and deflectable along and from the surface during cultivation (1X) of the surface (6X).

FIG. 55 depicts an isometric view with dashed lines illustrating hidden surfaces for a method (1) embodiment (1Y) and apparatus (2) embodiment (2Y) that can be deployed radially to provide an arcuate path engagement (143) or used with an arcuate shaped linkage (4Y) to engage any scraper member including the disc coulter scraper member (5Y) shown.

FIG. 55 further shows the use of the apparatus (2Y) for cultivation (1Y) of a wall surface (6, 6Y) with a scraper (5, 5Y) member selectively arranged and operated by a flexible engagement linkage (4, 4Y), which can be combined with the scraper member (5, 5Y) to provide an arcuate engagement (143) operated by a fastened (157) shaft (3, 3Y) and associated bearing (151) to drag the scraper across the wall surface (6, 6Y) to separate the wall surface into regions (9, 9Y) that can be used by an ancillary apparatus (7, 7Y) and/or a spreadable substance (8, 8Y). The arcuate linkage (4Y) can comprise, e.g., linear radial deployment if an arcuate engagement path (143) is provided to the example rotating scraper (5Y).

Alternatively, if the edged (14) disc coulter scraper member (5Y) and associated receptacle and shaft (3Y) are omitted then, e.g., abrasive scrapers can be applied to the resulting pad (158) to reduce the amplitude of convex protrusions from the plane of the wall surface using an arcuate (4Y) shaped member, which is not the convention within, e.g., prior art polishing or honing operations which use non-deflectable honing engagements or within prior art cleaning operations that can use deflectable arcuate engagements but focus only upon removing debris that is attached to a surface and not honing or cutting of the surface itself.

FIGS. 56 and 57 show a plan view with line N-N and an elevation view cross section through line N-N of FIG. 56, respectively, for a method (1) embodiment (1Z) and apparatus (2) embodiment (2Z) that can be selectively used with hydrostatic pressure actuation.

An arcuate engagement linkage (4Z) comprising, e.g., a flexible (31) bow spring (19) linkage (4Z1) engaged with fasteners (157) to a rigid (30) skate linkage (4Z2) carrying a scraper (5, 5Z) to form an apparatus (2, 2Z) usable for cultivating (1Z) a wall surface (6, 6Z) by dragging a scraper member (5,5Z) across the surface. A shaft (3, 3Z) can be selectively arranged and can comprise a shaft (3Z1) for engaging the linkage (4Z1), which is secured to a shaft (3Z2) with an internal fluid passageway (28) to a hydrostatic chamber (155) usable to actuate the apparatus (2Z) with fluid energy (34).

Valves (44) and packings ((154), also shown in FIG. 38) secured to the shaft (3Z2) with a packing nut (156) can be used to control a hydrostatic fluid chamber (155) and piston (20), whereby selectively placing of a fluid pressure within the chamber (155), which is equivalent to the selected depth of subterranean actuation allows a compressible fluid, e.g. nitrogen, to be compressed below the desired depth by the surrounding hydrostatic fluid above and about (29) the apparatus (2Z) to activate the piston for the bow spring (19) linkage (4Z1, 4Z2), downward to actuate the apparatus (2Z). When the apparatus is retrieved above the selected depth associated with the fluid pressure trapped within the chamber (155), the trapped pressure is greater than the surrounding hydrostatic pressure and actuates the piston to retract the arcuate linkage (4, 4Z) and associated scraper member (5, 5Z), thus, selectively deactivating the apparatus at the selected depth. A connecting fluid passageway (28) may connect an upper and lower chamber (155), through the shaft (3Z4) to allow a lower version of the upper shaft (3Z2) to stroke within shaft (3Z3) during operation of the piston (20). Accordingly, lower end arcuate linkage, shafts, piston and chamber correspond to upper end linkage (4Z1), shafts (3Z1-3Z3), piston (20) and chamber (155), which are not shown, and can be present.

The desired depths and associated pressures surrounding and within the apparatus can be calculated and/or empirically measured through logging runs and various controlling mechanisms used for downhole actuation and operation of the flexible engagement arcuate linkage (4, 4Z) and scraper member (5, 5Z) usable to separate the surface (6, 6Z) into regions (9, 9Z) for use by an ancillary apparatus (7, 7Z) and/or a spreadable substance (8, 8Z).

FIGS. 58 and 59 illustrate a plan view with line O-O and an elevation view cross section through line O-O of FIG. 58, respectively, for a method (1) embodiment (1AA) and apparatus (2) embodiment (2AA) that can use different types and sizes of disc coulters or disc cutters. It is to be understood that scraper (5) members can comprise any size or variation that is draggable across a wall surface (6AA) the scraper member can comprise various embodiments (5AA) of cutting (5AA2) and/or perforating (10) scraper members.

A shaft (3, 3AA) selectively arranged to operate a wall surface (6AA) engageable arcuate linkage (4AA) and associated scraper members (5AA) comprising, e.g. any size of scraper (5AA1-5AA5) member suitable for deployment from the apparatus (2AA) and usable to cultivate (1AA) the surface (6, 6AA) into regions (9, 9AA) usable by an ancillary apparatus (7, 7AA) and/or a spreadable substance (8, 8AA). Any suitable linkage (4) comprising a downhole arcuately shaped linkage (4AA) or linkage deployable in an arcuate path (143) is usable to deploy a scraper member (5), wherein, e.g., a member (5AA1) can perforate (10) when rotated and can be draggable to furrow.

The arcuate linkage (4) can act as a depth regulator (e.g. 171 of FIG. 36) to control the depth that a concave perforation or furrow can be cut into the surface, wherein the depth can be controlled by arranging the distance from the outer edge of the scraper (5) to the abutment of the arcuate member (4) against the surface (6) for either forming perforations (10) or furrowing. Accordingly, as shown in FIG. 58, various sizes of cutters can be selectively arranged, oriented and deployed to selectively control the depth of a concave protrusion into the plane of the surface (6), provided that the transverse dimension of the apparatus (2) can be deployed through the upper end bores of the well to the surface (6) where cultivation (1) occurs.

Figures 60, 61, 62, 63, 64, 65, 66, 67, 68:
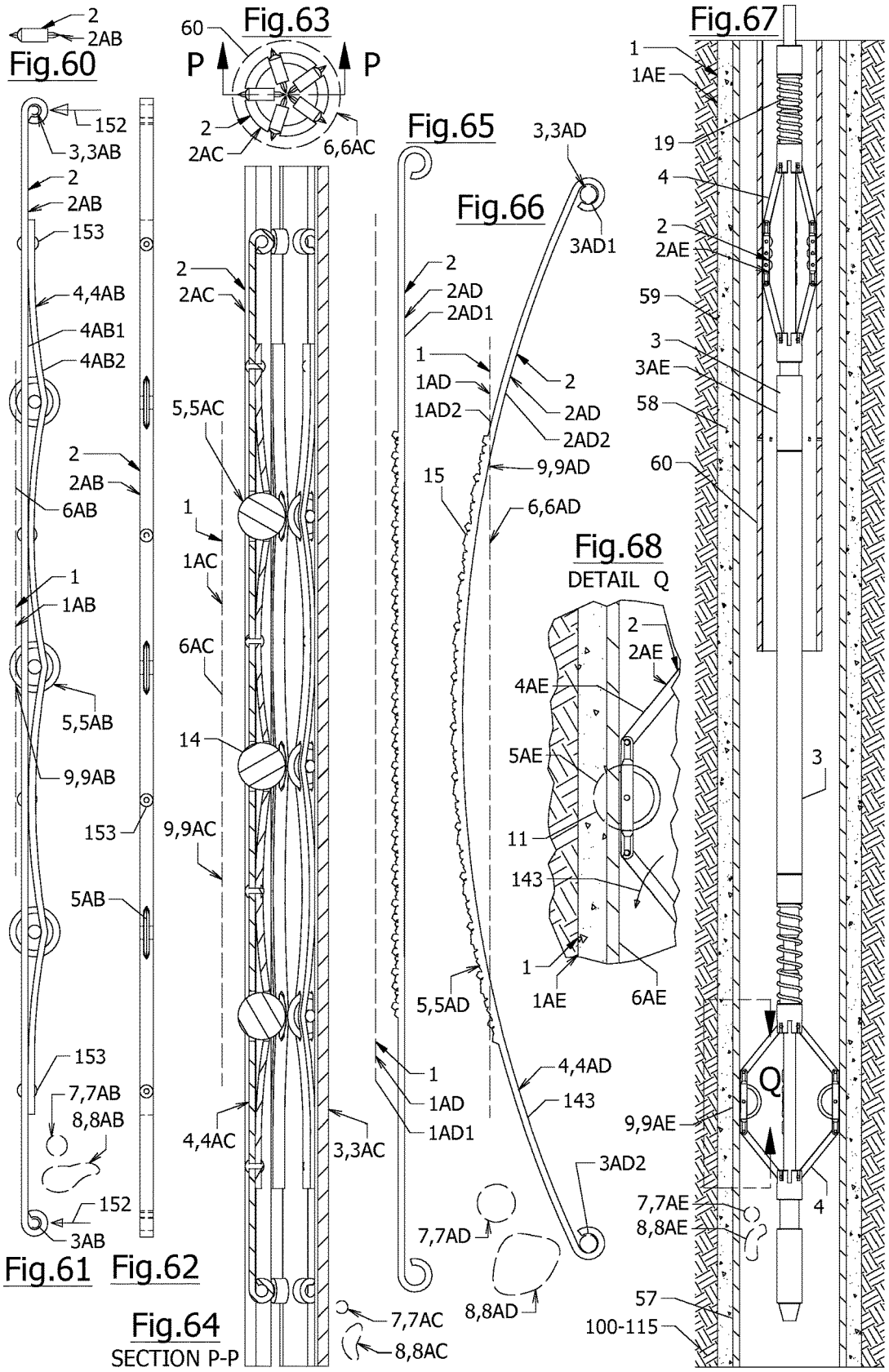
FIGS. 67 and 68 illustrate casing wall surface embodiment (AE).

FIGS. 60, 61 and 62 depict a plan view, side elevation view, and front elevation view, respectively, for a method (1) embodiment (1AB) and apparatus (2) embodiment (2AB) that can be adapted to have a low width to length ratio.

A scraper (5AB) flexible arcuate engagement linkage (4, 4AB) can comprise a plurality of arcuately bendable members (4AB1,4AB2) engaged with, e.g., rivets (153) to hold the scraper members (5, 5AB) and to laterally (152) deploy them with shafts (3, 3AB) that can be selectively arranged to be interoperable with other members. The apparatus (2AB) members can be interoperable and selectively actuatable using any lateral, radial (152) or longitudinal means to engage and separate wall surface (6AB) regions (9, 9AB) and, thus, cultivate (1AB) the wall surface (6, 6AB) for use by an ancillary apparatus (7, 7AB) and/or a spreadable substance (8, 8AB).

FIGS. 63 and 64 show a plan view with line P-P and an elevation view cross section through line P-P of FIG. 63, respectively, for a method (1) embodiment (1AC) and apparatus (2) embodiment (2AC) that can have a low diameter to length ratio for small diameter passage.

An apparatus (2AC) is formed by selectively arranging interoperable members comprising a scraper member (5, 5AC), a flexible arcuate engagement linkage member (4, 4AC) and an associated shaft member (3, 3AC) that can be usable to cultivate (1AC) a wall surface (6, 6AC) by separating the wall surface plane into a plurality of planes forming separate regions (9, 9AC) that can provide a prepared surface for subsequent use by an ancillary apparatus (7, 7AC) and/or a spreadable substance (8, 8AC). As shown in FIG. 63, a plurality of scraper members can be arranged for passage through a conduit, e.g. tubing (60), to cultivate the tubing or another surrounding surface that can, at least in part, be obstructed by the tubing before cultivation, and whereby thin arcuate linkages and associated scraper members can comprise edged (14) and/or abrasive (15 of FIGS. 65-66) cutters that can pass through a first surface to cultivate at least a second surface.

FIGS. 65 and 66 illustrate elevation views for an unactuated (1AD1) method (1) embodiment (1AD) and actuated (1AD2) method (1) embodiment (1AD) for an apparatus (2) embodiment (2AD) that can be used with an abrasive filament and arcuate spring.

Cultivating (1AD) a wall surface (6, 6AD) can be performed by separating the surface of the wall into regions (9, 9AD) by actuating (1AD2, 2AD2) an apparatus (2AD) from an unactuated position (1AD1, 2AD1), wherein the apparatus can be adapted or formed by selectively arranging one or more shafts (3AD, 3AD1, 3AD2) to be interoperable with an arcuate engagement linkage (4, 4AD) that can be bendable in an arcuate path (143) to carry an associated scraper member (5, 5AD) comprising, e.g., an abrasive cutter (15) that cultivates (1AD) the surface (6, 6AD) for use by an ancillary apparatus (7, 7AD) and/or a spreadable substance (8, 8AD).

FIGS. 67 and 68 depict an elevation view of a slice through a well with detail line Q and a magnified view within detail line Q of FIG. 67, respectively, for a method (1) embodiment (1AE) and apparatus (2) embodiment (2AE) that can be used to cut a conduit comprising casing along the longitudinal axis of the well after passing through an internal conduit, e.g. tubing or drill pipe.

An apparatus (2AE) for cultivating (1AE) a wall surface (6, 6AE) into furrow separated regions (9, 9AE) can be selectively arranged to provide a shaft (3, 3AE) and an arcuate engagement (143) linkage (4, 4AE) that can be interoperable with an associated deep furrowing (11) scraper member (5, 5AE), which is shown flexibly engaged to and draggably deflectable from the surface (6AE) to cut convex or concave protrusions from or into a plane of the surface to separate furrow regions (9, 9AE) into a plurality of associated planes for use by an ancillary apparatus (7, 7AE) and/or a spreadable substance (8, 8AE). An apparatus can be selectively adapted and arranged using flexible features of an arcuate engagement linkage which can be further usable for passage through a dissimilar contiguous passageway comprising, e.g., tubing 60 entering a larger annulus space within a liner (57) cemented (58) into a strata bore (59). The method can be used with deep cutting scraper members (5AE) to, e.g., prepare deep furrows (11) that can be supplimented with transverse furrows, like the example of FIG. 17, to form a lattice separation that, as describe in FIG. 14, can be used to provide a continuous plane that removes debris disposed circumferentially around the deepest point of a concave furrow to join the previously separated planes at a different diameter.

Referring now to FIGS. 69 to 86, which show method embodiments (1) and apparatus embodiments (2) that can use a bascule arrangement of a seesaw-like pivotal arcuate engagement linkages to cultivate a well surface (6) with a scraper (5) member arcuately engaged by a linkage (4) extending radially from a shaft (3) to prepare the surface for use by an ancillary apparatus (7) or spreadable substance (8).

Figures 69, 70, 71, 72:
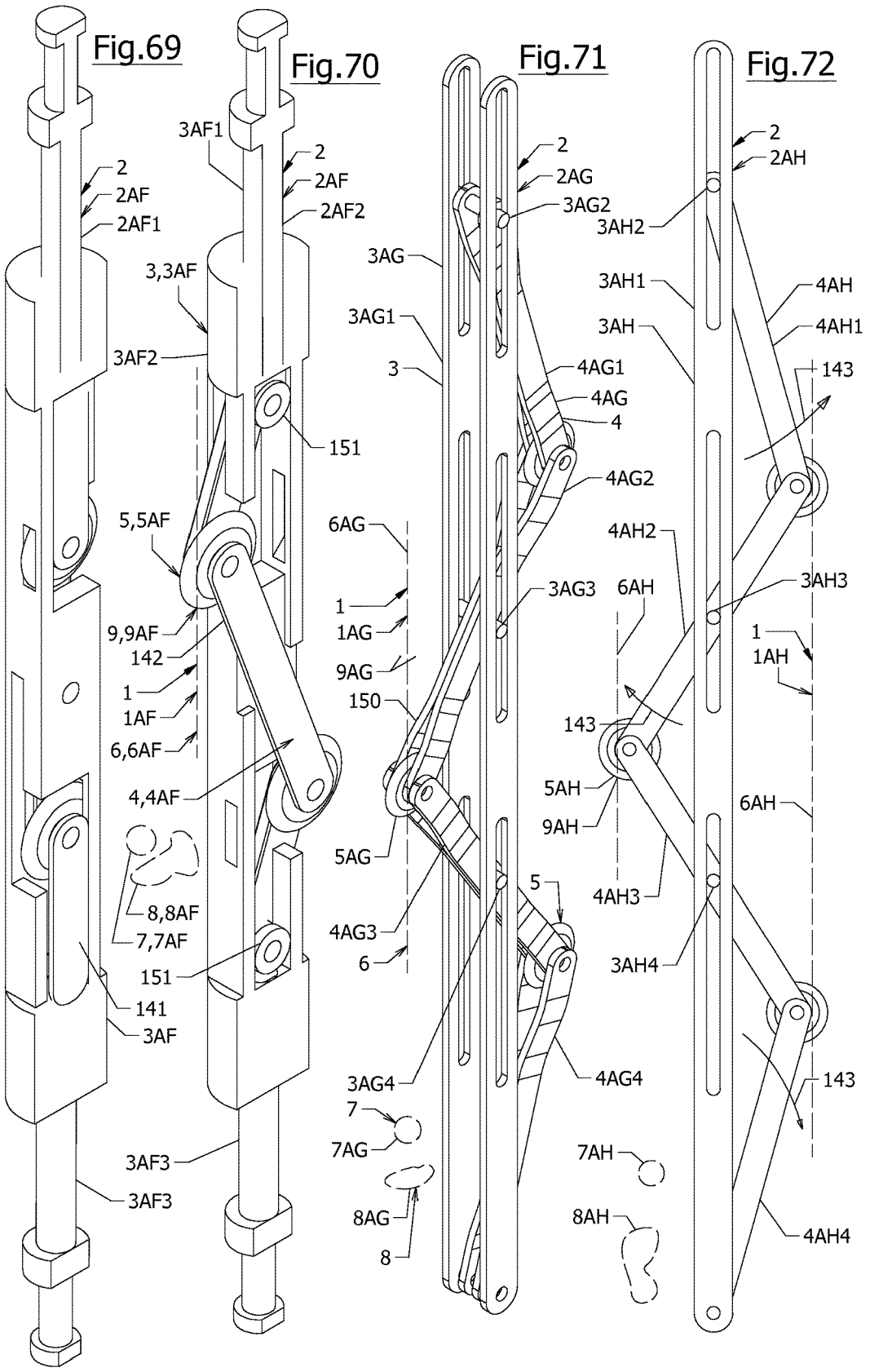
FIGS. 69 to 79 show various bascule or seesaw-like arcuate engagement linkage embodiments (AF) to (AJ).

FIGS. 69 and 70 depict isometric cross sectional views of an off-centre longitudinal slice through one side in FIG. 69 and another off-centre longitudinal slice through the other side of the 180 degree rotated apparatus in FIG. 70, to illustrate a method (1) embodiment (1AF) for an unactuated (2AF1) retracted position (141) and actuated (2AF2) extended position (142) of an apparatus (2) embodiment (2AF) that can be used for forming a cultivating furrow in a well's wall surface along a longitudinal axis thereof.

A scraper (5AF) member of an apparatus (2AF) for cultivating (1AF) a wall surface (6, 6AF) plane into a plurality of separated regional (9, 9AF) planes can be operated by selectively arranging shaft (3, 3AF) members (3AF1-3AF3) with track bearings (151) and an arcuate engagement linkage (4, 4AF) to flexibly engage the scraper member in the longitudinal orientation shown or a transverse orientation using, e.g., knives, coulters and/or chisels that can be axially draggable or axially rotated relative to the well bore axis to provide longitudinal and/or transverse longitudinal furrow separated surface (6, 6AF) regions (9, 9AF) usable by an ancillary apparatus (7, 7AF) and/or a spreadable substance (8, 8AF).

FIGS. 71 and 72 illustrate isometric views of method (1) embodiments (1AG, 1AH, respectively) and apparatus (2) embodiments (2AG, 2AH, respectively) for various bascule, seesaw and/or bellow folding type arcuate linkage arrangements.

The Figures show a flexibly arranged arcuate linkage (4, 4AG, 4AH) that can be usable to drag a scraper (5, 5AG, 5AH) member across a plane of a surface (6, 6AG, 6AH) to furrow and separate the surface into a plurality of regional planes (9, 9AG, 9AH). The flexibly arranged arcuate linkage can use pivotal engagements, via axially variable yoke (150) arrangements, to radially and arcuately dispose a scraping member (5AG) that can be usable to form a furrow cultivating (1AG, 1AH) apparatus (2AG, 2AH), which can be deployable and operable from a shaft (3AG, 3AH) that can be disposed downhole. The arcuate engagement linkage (4AG, 4AH) can be usable to flexibly engage the scraper (5AG, 5AH) draggable edge in a longitudinal and/or transverse orientation to the wall surface plane to provide an associated well bore axis to provide longitudinal and/or transverse longitudinal separate regions (9, 9AG, 9AH) in the surface (6, 6AG, 6AH) for use by an ancillary apparatus (7, 7AG, 7AH) and/or a spreadable substance (8, 8AG, 8AH).

The shaft (3, 3AG, 3AH) can include a longitudinal shaft (3AG1, 3AH1) with receptacles for engagement of axially slideable transverse shafts (3AG2-3AG4, 3AH2-3AH4) associated with arcuate linkage (4AG, 4AH) members (4AG1-4AG4, 4AH1-4AH4) that can provide an arcuate path (143) for flexibly and arcuately engaging a wall surface (6AG, 6AH) to furrow and separate the wall surface into separate regions (9, 9AG, 9AH) using a scraping member (5AG, 5AH) comprising any scraper-like member comprising, e.g., the cutting wheels shown.

Figures 73, 74, 75, 76, 77:
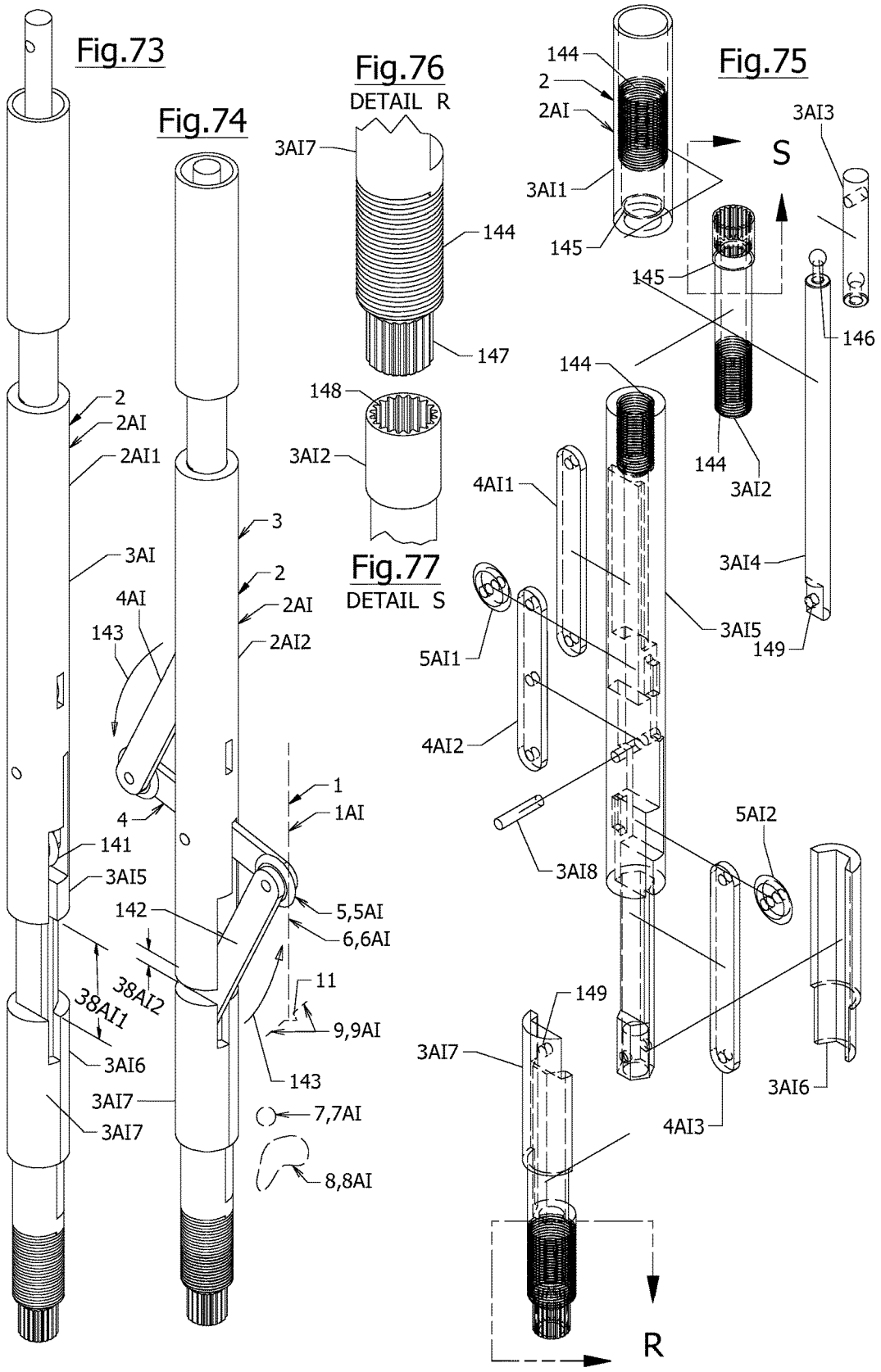

FIGS. 73, 74, 75, 76 and 77 show an unactuated apparatus (2AI1) isometric view, actuated apparatus (2AI2) isometric view, exploded view with dashed lines showing hidden surfaces with detail lines R and S, a magnified detail view within line R of FIG. 75, and a magnified detailed view within line S of FIG. 75, respectively, illustrating a method (1) embodiment (1AI) and apparatus (2) embodiment (2AI) that can be used for forming a furrow along the longitudinal axis of a wellbore wall surface.

An apparatus (2) for cultivating (1AI) a surface (6, 6AI) with a scraper (5, 5AI) member of an apparatus (2, 2AI) usable to separate the surface into regions (9, 9AI) can be used to prepare the surface for ancillary apparatus (7, 7AI) and/or spreadable substance (8, 8AI) operations, wherein selectively arranging a shaft (3, 3AI) and an arcuate engagement linkage (4, 4AI) to flexibly engage the scraper (5AI) in an longitudinal and/or transverse orientation to the well bore axis can provide a longitudinal and/or transverse longitudinal furrow separated surface (6AI) regions (9AI) usable by the ancillary apparatus and/or a spreadable substance.

The shaft (3AI) can comprise an upper end connector shaft (3AI1) rotatable about an orientation shaft (3AI2) that can be engaged to a central shaft (3AI5) using, e.g., threaded (144) and swivel (145) connections. An upper end actuation connector shaft (3AI3) can be engaged to a lower end actuation shaft (3AI4) using a flexible connector, e.g. a ball joint (146), therebetween and a lower end hinge that can be interoperable with an arcuate linkage (4AI) arm (4AI1).

The arcuate engagement linkage arms (4AI1-4AI3) are extendable and retractable into and out the central shaft (3AI5). An upper arcuate linkage arm (4AI1) is interoperable with and engaged to a central pivot arcuate linkage arm (4AI2) via the axles of a draggable scraper (5AI1) member. The central pivot arm (4AI2) pivots on a shaft (3AI8) and can be engaged to and interoperable with a draggable scraper member (5AI2) that can oppose an opposite scraper member (5AI1), when actuated, to centralize the apparatus (2AI). The lower arcuate linkage arm (4AI3) is engaged to the pivot arm (4AI2) via the axle of the draggable scraper (5AI2) and the lower engagement shaft (3AI7) via a transverse oriented hinge engagement (149).

The unactuated (2AI1) apparatus (2AI) can be actuated (2AI2) by sliding the central shaft (3AI5) within the lower engagement shafts (3AI6, 3AI7) to shorten the apparatus by closing the gap (38AI1) to (38AI2) to actuate the arcuate linkage (4AI), wherein the linkage arms (4AI1, 4AI3) extend and the pivot arm (4AI2) rotates around a transverse oriented shaft (3AI8). As shown, the arcuate path (143) of the linkage can arcuately engage the wall surface (6AI), wherein the extended (142) and retracted (141) sliding nature of the shafts (3AI5-3AI7) provides a flexible engagement that is draggably deflectable when sliding of the shafts is combined with, e.g., a spring-like actuation mechanism.

A plurality of apparatus (2AI) can be longitudinally engaged, as shown in FIGS. 80 to 86, by engaging the upper end internal shaft (3AI3) transverse bore with an associated central shaft's (3AI5 of the longitudinally connected apparatus) lower end bore with a pinning shaft and then placing the split shafts (3AI6 and 3AI7) around the connection. The upper end connector shaft (3AI1 of the longitudinally connected apparatus) can be engaged to the lower end connector of the split shaft (3AI7) using, e.g., a threaded connection, which can also be used to hold the split shafts (3AI6, 3AI7) together. The split shafts (3AI6, 3AI7) and securing shaft (3AI1 of the longitudinally connected apparatus) can be used to provide access for engagement of the lower end transverse bore of the central shaft to the upper end bore of an internal shaft (3AI3 of a different apparatus) using a transverse pinning shaft similar to (3AI8).

Accordingly, one or more apparatuses (2AI) can be longitudinally engaged, as shown in FIGS. 80 to 86, to cultivate (1AI) a wall surface with furrows (11) oriented longitudinal to the well's axis. The illustrated wheel or disc cutters and/or harrows can be draggable if, e.g., they are prevented from rotating for any reason, wherein any form of knife, chisel, cutter, coulter and/or abrasive scraper member is usable to cultivate (1AI) a surface (6AI). The central shaft can have receptacles for scraper members (5AI1, 5AI2), which can have pass through ports or passages to reduce clogging of the receptacle with debris during downhole use.

Figures 78, 79, 80, 81, 82, 83, 84:
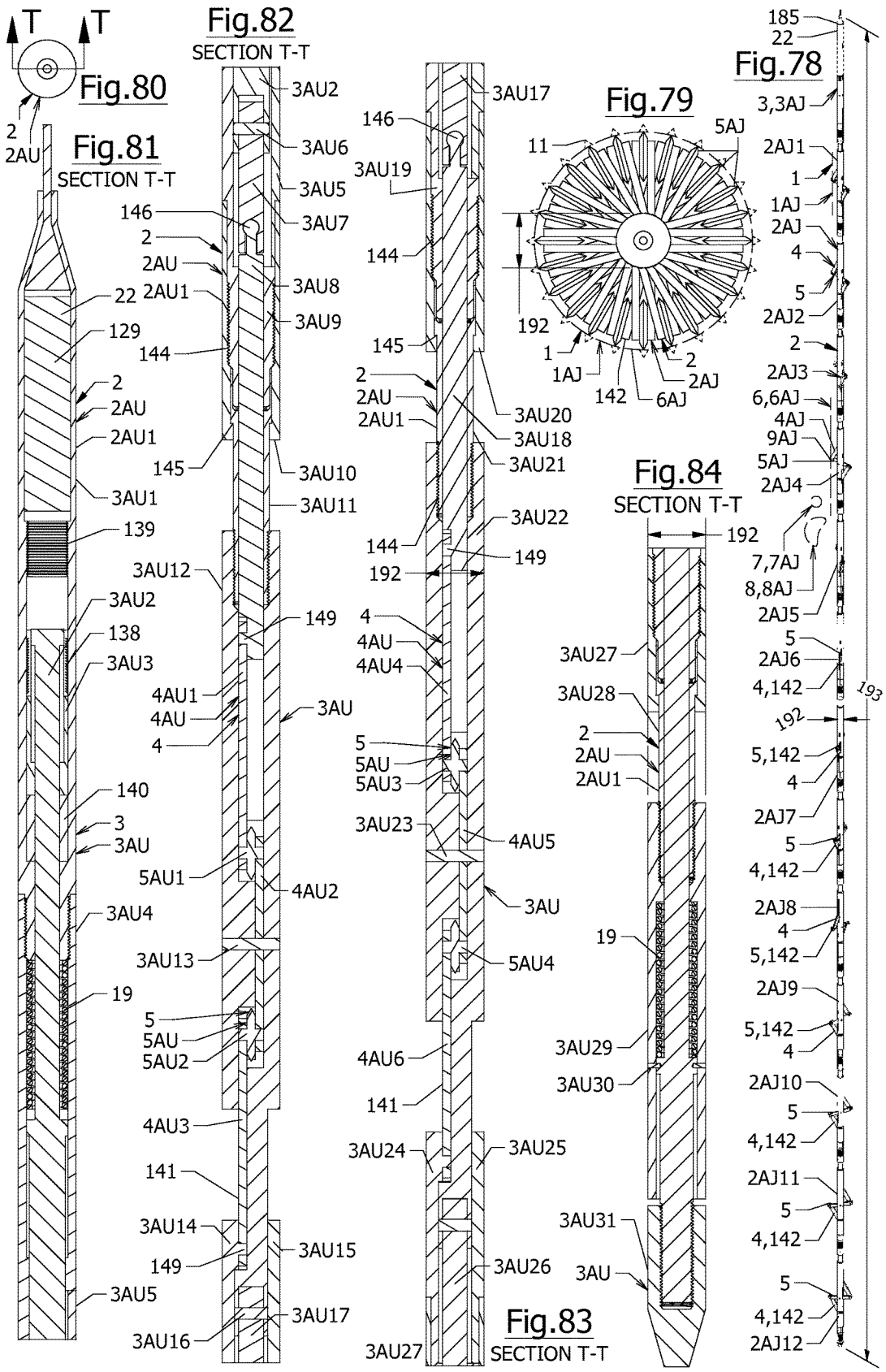
FIGS. 80 to 84 depict a slice through retracted embodiment (AU).

As shown in FIGS. 76 and 77, shafts can be selectively arranged and interoperably formed using, e.g., a spline mandrel (147) with an associated spline receptacle (148) that can be used to orient or phase one apparatus (2AI) relative to an associated apparatus to provide a plurality of longitudinally phased scraper engagements like that shown in FIGS. 78 and 79.

As described, a conduit can separate when vertically cutting through a wall of the pipe body at a coupling or tool joint due to the possible loss of the cylindrical shape or plane of the surface, whereby separation of the thread can form or occur at the tool joint or coupling. When separation is not desired various prior art and/or conventional actuation apparatus, like a collar or coupling locator (CCL) tool comprising a logging tool that can measure the presence of a connector, can be adapted and/or combined with an axial actuation tool, to selectively extend and retract a vertical oriented scraper member at couplings to prevent cutting and destroying of the cylindrical surface plane at the connector to, thus, prevent inadvertent separation.

Such adaptation and selective control provide significant benefit by providing for the furrowing and weakening or complete longitudinal cutting of a surface's wall with a cutter and scraper member (5AI) to weaken or shred the pipe body between the couplings, so that the conduit is suspended within the well. Maintaining conduit suspension, via sliced or weakened longitudinally separated surface regions can be used to allow the apparatus (2AJ) to be removed prior to transversely cutting and severing or parting the pipe body above the weakened or shredded portions. Subsequently, various methods and apparatus of the present inventor can then be used to place a piston and to crush the conduit to provide space for a spreadable substance. Weakening or shredding of the conduit significantly, e.g. (1AJ of FIG. 79), can provide the benefit of turning the pipe body into an extremely thin walled cylinder with a diameter (D) to wall thickness (t) ratio (D/t) of over fifty, in the weakened case, or into a shredded arrangement of spaghetti-like strands that can suspend the conduit string in tension, but can easily be transversely severed with, e.g., a filament cutter, and subsequently failed in compression so as to significantly increase the crushing compression ratio.

As the tubing can part when the weight of the lower end is such that the extremely thin wall and/or spaghetti-like shredded conduit wall strands fail, the embodiments of the present invention can provide significant benefit using cushioned actuation with, e.g., springs or hydrostatic pistons within a relatively small passage diameter tool that can be centralised within the pipe body once it is activated. If the conduit parts during the cultivation of its wall surface, string tension can support the apparatus (2AI) while the cushioned, flexible arrangement, can allow the parted tubing to fall axially downward around a supported apparatus with sufficient clearance to prevent binding. Accordingly, if the pipe body falls around the apparatus to leave it in the well bore, the apparatus can be operated with line tension to re-enter the bottom passage of the upper end of the parted conduit to continue operation or be retrieved to surface for repair or replacement.

Additional and significant benefit is added by the relatively small number of working parts and the relatively small diameter of the apparatus (2AI) which is usable within significantly larger conduit diameters comprising, e.g., the tubing to the production casing, intermediate casing and even the surface or conductor casing, whereby the length of the apparatus and member part can be adapted or adjusted to engage the wall surface of said conduits. The simplicity of the tool and ability to provide commonly sized parts for a range of tubing and conduits provides the significant benefit of reducing inventories and allowing on-site inspection and repair of the apparatus (2AI).

The benefits of a pivotal arrangement of arcuate engagement linkages (4AI) is also significant because it provides for more metal and/or composite material thickness and associated strength to be packaged or arranged within the relatively small diameter, e.g. a 44.45 mm (1.75 inches) diameter capable of operation within a relatively small 60.33 mm (2⅜ inches) outside diameter conduit, with an inside diameter drift of 45.03 mm (1.773 inches) when the conduit is a 8.65 kilograms per meter or 5.8 pound per foot tubing. Accordingly, the illustrated proportions of the apparatus (2AI) show that the tool can radially expand to arcuately engage a 177.8 mm (7 inch) casing or a liner's internal diameter of 152.5 mm (6.004 inches), using sufficient pivotal arm thickness and associated strength with phasing, e.g. like that shown in FIG. 78 to FIG. 81. The length of the pivot arms can be increased while maintaining the same apparatus (2AI) diameter to reach various casings, including, e.g., 762 mm (30 inch) outside diameter conductor or surface casing with an inside diameter of 711.2 mm (28 inch).

Various materials can be used to form the members of an apparatus (2AI) that can include metal or, e.g. fibre (47), plastic (48) and/or composite material (49) comprising a mix of fibres and plastic to allow tools to be more easily removed should they become stuck during operations. For example, if it is critical to retain access through a conduit after preparing the conduit's wall with longitudinal furrows to allow placement of, e.g., a swellable packer therein, the cultivating apparatus (2AI) could be constructed of a composite material (49) to allow removal with, e.g., an electric motor or coiled tubing fluid motor driven mill that would remove a stuck composite material apparatus (2) from the well bore, after which the metal scraper (5AI), used for cutting could be collected in a junk basket or allowed to fall downward.

FIGS. 78 and 79 depict an isometric view and plan view, respectively, of a method (1) embodiment (1AJ) and apparatus (2) embodiment (2AJ) that phases a longitudinal cutter, e.g., 2AI of FIGS. 73 to 77, to cultivate a plurality of longitudinal furrows in a wall surface along the longitudinal axis of a wellbore. The Figures further depict an apparatus (2AJ) with a series of member assemblies (2AJ1 to 2AJ12) sized (192, 193) for downhole hoisting and selected actuator ((22), as shown in FIG. 81) surface (6, 6AJ) cultivating (1AJ). The Figures further show a plurality of scraper (5, 5AJ) members, with selectively arranged and axially phased shafts (3, 3AJ), that can carry a plurality of axially spaced arcuate engagement linkages (4AJ), to extend (142) and flexibly engage the plurality of scraper members (5, 5AJ) in a longitudinal and circumferential orientation to the well bore axis, to provide a plurality of longitudinal furrows (11), when hoisted, to weaken or completely separate the surface (6, 6AJ) wall into regions (9, 9AJ), which can then be usable by an ancillary apparatus (7, 7AJ) and/or a spreadable substance (8, 8AJ).

Significant benefit can be provided by such an arrangement when used over a longitudinal portion of the well bore during, e.g., weakening of conduits for use by a subsequent crushing ancillary apparatus usable to compress various conduit/cables and to provide space for logging tools or a spreadable substance, such as cement. The ability to provide a plurality of longitudinal furrows or separations in a surface allows engineers to design for, and to control the forces necessary for crushing a conduit by controlling the resistance to crushing. For example, to lower the resistance to crushing, more longitudinal cuts can be added to reduce the cross sectional area resisting longitudinal column crushing forces to, in effect, turn the conduit into spaghetti-like columns that can be more easily compacted.

Alternatively, the longitudinal furrows in a surface of a wall of a well bore or the complete separations in the surfaces of a wall can be combined with transverse surface furrows or complete transverse wall separations to replace conventional milling operations or to provide concave protrusions into a wall surface, whereby a spreadable substance can be scraped across a surface to bridge across a concave protrusion into a well or further scraped to reduce a convex protrusion from the surface to form a continuous planar surface. For example, a spreadable substance can be placed onto and/or grouted into a concave protrusion along the wall surface and allowed to set and be anchored to the surface in preparation for use by ancillary equipment, such as expandable liners or packers.

Adding vertical furrows within a strata wall after initially boring the furrows can be used to increase the speed of under-reaming operations. Conventionally, the time to under-ream a strata bore can take as long as boring the strata bore. If conventional drill collar shafts were adapted with longitudinal scraper members actuated on trip out of or into the well bore after boring and deactivated before entering the casing and/or before beginning under-reaming or hole opening operations, efficiencies could be gained in respect to reducing the time and associated energy necessary to under ream a section, which has already been bored, because the longitudinal furrowing weakens the surface of the well bore prior to such operations.

Various cutting and non-cutting scraper or disc arrangements, e.g. adaptations according to the embodiments of the present invention of the cutting tools described in U.S. Pat. No. 5,752,454, can be selectively arranged to be interoperable with other members to cultivate a wall surface by scraping it with a member to produce a concave protrusion into a plane of the surface of the wall, reduce or remove a convex protrusion from the plane of the surface of the wall, and/or fill or grout a concave protrusion along or into the wall surface, for use by ancillary downhole equipment or spreadable substances.

Figures 98, 99, 100, 101, 102:
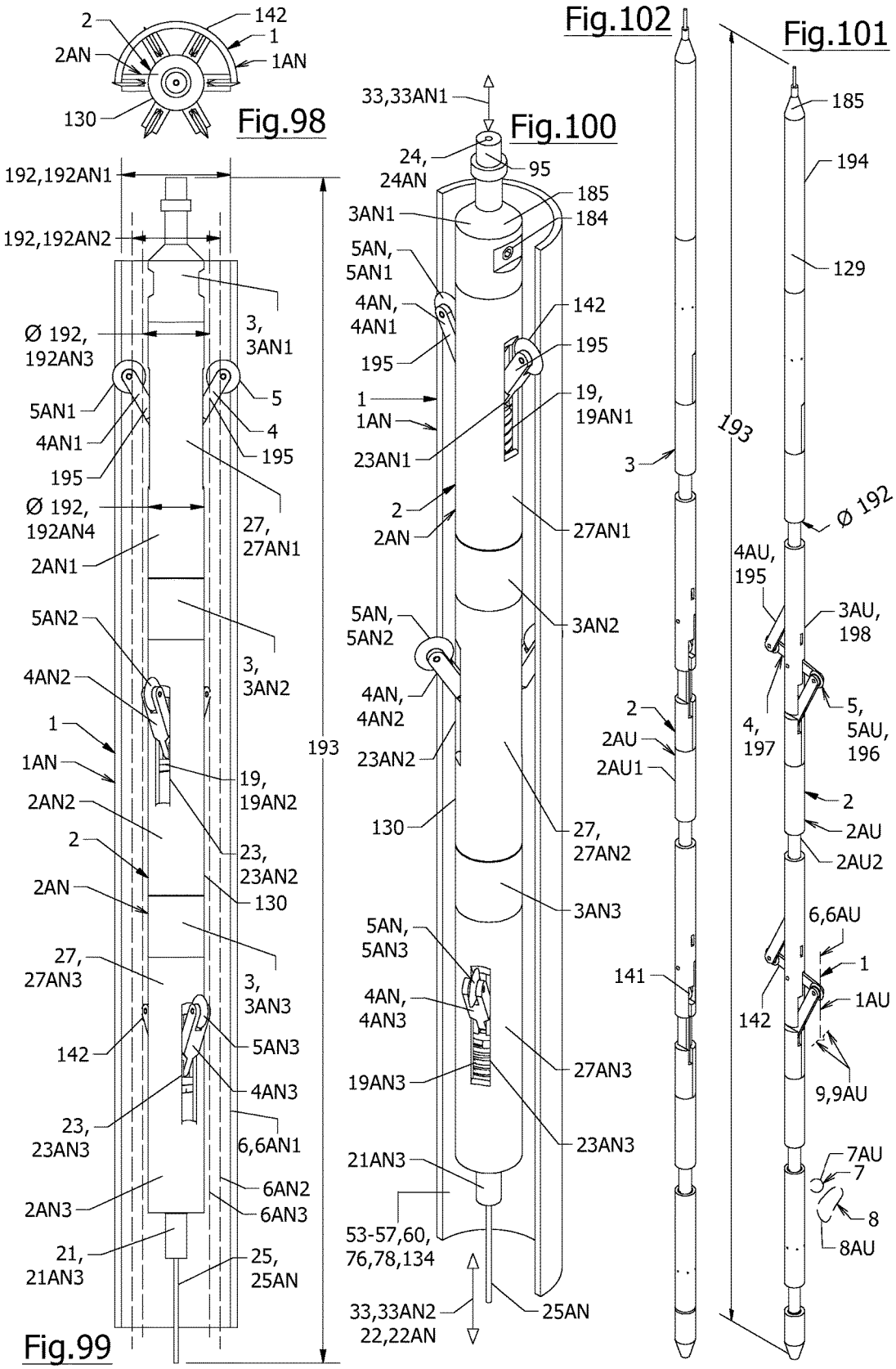
FIGS. 98 to 102 illustrate embodiments (AN) and (AU) with axially stacked apparatus member assemblies rotationally oriented.

FIGS. 101 and 102 illustrate isometric views of an actuated (2AU2) and unactuated (2AU1) apparatus (2) embodiment (2AU) and method (1) embodiment (1AU) that can be used with, e.g., a plurality of vertical cutters (2AI of FIGS. 73 to 77) using bascule-like pivotal arms (4AU).

The transverse dimension (192) can be usable with smaller conduit diameters, wherein the longitudinal dimension (193) of a pivotal seesaw arrangement can be longer than, e.g., the opposing pivot arm arrangement of embodiment (2AN) of FIGS. 98 to 100. A vertical cutter (194) can use a seesaw pivot arm (197), coupled with a levered pivot arm (195), to extend a cutter (196). The longitudinal cutter (194) can be hoisted in a retracted disposition within a bore without cutting and used in the extended position (142) to cultivate a surface (6) by longitudinally cutting it into regions (9) to prepare it for subsequent use. The benefit of a seesaw pivotal arm (197), with supporting pivot arms (195), over a lone pivot arm (195 of FIGS. 99 and 100) is less stress on the arm members at the same kinetic drag force to, thus, increase the furrow cutting force and/or the longevity of the tool.

The benefits of an opposing bascule pivot arm arrangement (e.g., 4AN diametrically opposed pivot arms 4AN1-4AN3 of FIGS. 98 to 100) over a bascule seesaw pivot arm longitudinal cutter (194) can include: i) coincidentally extending a plurality of cutters laterally to maintain tool centralization and to reduce the propensity of unbalanced forces generating helically longitudinal cutting paths or twisting of the assembly during cutting, ii) a balanced arrangement that can provide space for use of an insulated slickline cable second shaft to pass through a shaft passageway to tools within the lower end BHA, iii) an arrangement with fewer parts to reduce apparatus inventories associated with API conventional well sizes, iv) and an arrangement with less complicated parts that are easier to assemble and maintain, wherein v) member parts are more cost effectively machined and vi) the overall axial length (e.g. 193 of FIG. 99) of the apparatus member assembly (e.g. 2AN of FIG. 99) is generally less than the axial length (193) of a pivotal seesaw longitudinal cutter (194) to, e.g., better fit within a lubricator with the same number of stacked cutting assemblies.

Embodiments of the present invention can provide significant benefits over differential pressure-operated longitudinal cutting and weakening tools since the present invention requires fewer tool sizes, applicable over a larger range of conduit sizes, does not require a seal that can be lost during operation, and does not require pressure integrity of the tubing.

While angularly offset (2AJ of FIG. 79) and/or diametrically opposed pluralities of cutters (2AN of FIG. 98) can be arranged and used to longitudinally cut a subterranean well surface, various needs may require use of a single pivot arm carried cutter (2AO of FIGS. 103 to 110) that is deployed through a single lateral housing opening. A single longitudinal cut arrangement can be advantageously used to: i) orient a single longitudinal cut to the top of an inclined well bore surface using gravity to place the larger mass of the apparatus at the bottom of the well bore, wherein the apparatus can be hoisted with less risk of binding by providing more room for the cutter; and/or ii) provide a deeper longitudinal cut by providing more space for a larger cutter, which can be laterally extended further to improve the cutting ability and durability of the pivot arm cam face angles, and which can be operated in smaller transverse dimensions.

FIGS. 80, 81, 82, 83 and 84 show a plan view with section line T-T, an upper end elevation view cross section through line T-T of FIG. 80, an elevation cross section view through line T-T of FIG. 80 starting from the bottom of FIG. 81, an elevation cross section view through line T-T of FIG. 80 starting from the bottom of FIG. 82, and an elevation cross section view through line T-T of FIG. 80 starting from the bottom of FIG. 83, respectively, for the actuated ((2AU2), shown in FIG. 101) and deactivated ((2AU1), shown in FIG. 102) embodiments of FIGS. 80 and 81, wherein upper end of FIG. 82 is a continuation of the lower end of FIG. 81, the upper end of FIG. 83 is a continuation of lower end of FIG. 82, and the upper end of FIG. 84 is a continuation of lower end of FIG. 83.

The Figures depict a scraper (5, 5AU) apparatus (2, 2AU) for cultivating and preparing a surface ((6, 6AU), shown in FIG. 101), for use by an ancillary apparatus ((7, 7AU), shown in FIG. 101) and/or spreadable substance ((8, 8AU), shown in FIG. 101), can use a shaft (3, 3AU), which can be actuated axially from a lengthened retracted (141) position ((2AU1), shown in FIG. 102) to a shortened (193 of FIG. 101) extended (142 of FIG. 101) position ((2AU2), shown in FIG. 101), with an associated arcuate engagement linkage (4, 4AU) that can be movable from a retracted position (2AU1) to an extended position (2AU2), thereby selectively arranging to flexibly engage the scraper (5, 5AU) in an longitudinal and/or transverse orientation to the well bore axis, during scraping engagements. This movement of the scraper (5, 5AU) during the scraping engagements can prepare longitudinally and/or transverse longitudinally separated surface ((6, 6AU), shown in FIG. 101) regions ((9, 9AU), shown in FIG. 101) that can be usable by the ancillary apparatus ((7, 7AU), shown in FIG. 101) and/or a spreadable substance ((8, 8AU), shown in FIG. 101).

The shaft member (3AU) can comprise a plurality of shaft members (3AU1-3AU31) that can be selectively arranged to be interoperable with other members. Similar to the embodiment in FIGS. 73 to 77, the shaft (3AU) can comprise a plurality of upper end connector shafts (3AU10, 3AU20), rotatable about orientation shafts (3AU11, 3AU21), that can be engaged with central shafts (3AU12, 3AU22) using, e.g., threaded (144) and swivel (145) connections. Upper end actuation connector shafts (3AU7, 3AU17) can be engaged to a lower end actuation shaft (3AU8, 3AU18) using a flexible connector, e.g. a ball joint (146) therebetween and a lower end hinge (149) that is interoperable with arcuate linkage (4AU) arms (4AU1, 4AU4).

The arcuate engagement linkage arms (4AU1-4AU6) are extendable and retractable into and out the central shafts (3AU12, 3AU22). Relative to the central shafts, an upper arcuate linkage arm (4AU1, 4AU4) can be interoperable with and engaged to a central pivot arcuate linkage arm (4AU2, 4AU5) via the axles of draggable scrapper (5AU1, 5AU3) members. The central pivot arms (4AU2, 4AU5) pivot on shafts (3AU13, 3AU23) and can be engaged to, and interoperable with, draggable scraper members (5AU2, 5AU4), which can oppose opposite scraper members (5AU1, 5AU3), when actuated, to centralize the apparatus (2AU). As shown, the lower arcuate linkage arm (4AU3, 4AU6) can be engaged to the pivot arms (4AU2, 4AU4) via the axles of the draggable scrapers (5AU2, 5AU4) and the lower split engagement shafts (3AU14, 3AU24) via a transverse oriented hinge (149).

The unactuated retracted position (141, 2AU1) of the apparatus (2AU) can be extended (142) and actuated (2AU2) by sliding the central shafts (3AU12, 3AU24) within the split engagement shafts (3AU15, 3AU16 and 3AU24, 3AU25) to shorten the apparatus and actuate the arcuate linkage (4AU), wherein the linkage arms (4AU1, 4AU3 and 4AU4, 4AU6) extend and the pivot arms (4AU2, 4AU5) rotate around transverse oriented shafts (3AU13, 3AU23).

Initially, the apparatus (2AU) can be actuated by engaging the lower end shaft (3AU31) with, e.g., a no-go profile in a completion, to shear the transverse shear pin shafts (3AU30) to release and activate the springs (19), which can be held in a compressed state during deployment. The arcuate engagement linkage (4AU) can be actuated by an actuating device (129) within the apparatus (2AU) shaft (3AU), which can comprise a shaft (3AU1) that can axially actuate a shaft member (3AU2) and/or engage a shaft member (3AU3) used to engage the internal shaft member (3AU2), using, e.g., slip segments (138), grabs (139) or any other means. The actuator (129) can, e.g., use electromagnetic forces to pull and release the actuation shaft (3AU2), which can be caught and released with the slips (138) and grips (139). The actuator (129) can include a coupling collar locator (CCL) to measure the presence of connectors and selectively actuate and deactivate the apparatus (2AU) according to the method (1AU, shown in FIG. 101) so that, e.g., a conduit sting does not inadvertently separate due to longitudinal cultivation of the wall surfaces.

Any suitable actuation means can be used according to the available space and application. For example, the shaft (3AU1) can house a small explosive charge (140) to deactivate the apparatus (2AU) by pushing the slip segments (138) into the grabs (139) to compress the springs (19), which can be used for extendable and deflectable engagement of scrapers. Alternatively, e.g., the hydrostatic actuation described in FIG. 57 can be used.

Referring now to FIGS. 85 to 93 illustrating the method (1) embodiment (1AK) and a string connected (95) hoistable apparatus (2) embodiment (2AK) in various actuation stages (1AK1, 1AK2 and 1AK3), wherein selective application of axial force (33) selectively activates member movement (38) embodiments (38AK1 to 38AK8) through a mechanical slip arrangement (138), located on the second shaft (25AK). The hoistable apparatus (2, 2AK) can be usable to form diametrically opposed axial longitudinal cuts that perforate (10) through the plane of opposite wall surface (6) embodiment (6AK) of a tubular (53-57, 60, 76, 78, 134) or can be used to form a furrow (11) therein.

It is to be understood that the axial length of the second shaft (25) embodiment (25AK) can be a solid or insulated slickline cable that can extend from surface through a passageway (24AK) in the upper end tool joint connector (95) that also passes through (24AK) associated apparatus (2AK) members to a lower end device in a BHA (130). A stacked series of longitudinal cutters, an axially transverse filament-like cutter and/or a conventional BHA (181) can be engaged to the lower end, wherein the tool joint connector (95) and securing dog (184) can be suitable for anchoring to a rope socket (185) or, alternatively, be associated with an insulated slickline to power an actuator or other device within the lower end of the BHA. If the slickline, or wireline, should fail, the apparatus can also comprise a fishing neck (182) on the first shaft (3AK) to allow an overshot fishing tool to swallow the neck (182) to attempt to secure and hoist the apparatus (2AK) to surface.

It is to be further understood that a BHA attached to the lower end of the apparatus (2, 2AK) can comprise a conventional BHA (181) or a lower end apparatus (2) BHA (130) comprising a selectively activated filament-like axial transverse cutter and/or a plurality of longitudinal cutter apparatuses (2, 2AK) that can be axially stacked with coincidentally aligned cutters to reduce the wear on an single cutter (5, 5AK). The longitudinal cutter apparatus (2, 2AK) can be circumferentially orientated and angularly offset or comprise diametrically opposed cutters (5, 5AK) forming an axially phased plurality of longitudinal cuts.

Figure 91:
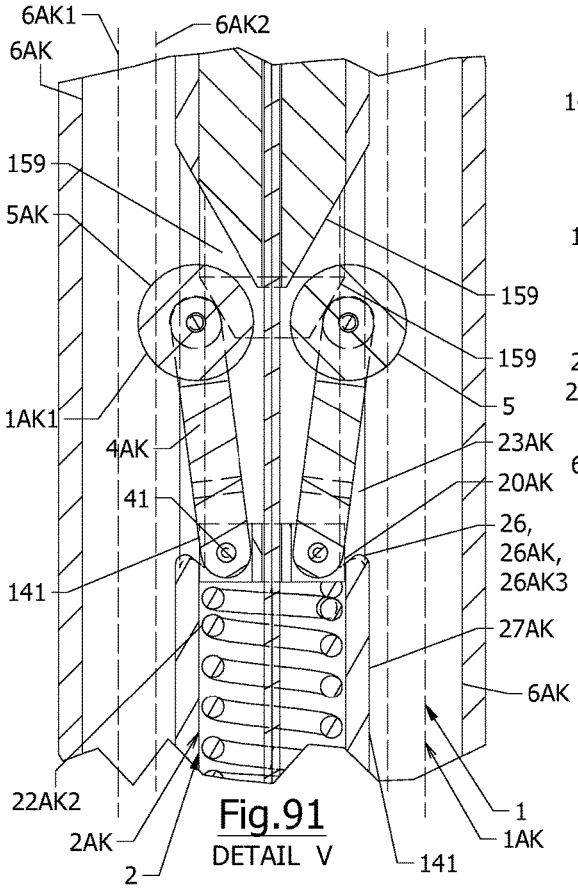

FIGS. 85, 86 and 91 illustrate the plan view with section line E-E, an elevation cross sectional view through line E-E of FIG. 85 with line F and the magnified detail view within line F of FIG. 86, respectively, with dashed lines showing hidden surfaces, for apparatus (2) embodiment (2AK), and a hoisting method (1) for using a retracted (141) cutter arrangement (1AK1) embodiment (1AK) to hoist and deploy the tool assembly (2) prior to forming a longitudinal cut in the subterranean well surface of a tubular body disposed therein.

The second piston (21) embodiment (21AK) of the apparatus (2AK) can be selectively movable (38AK1) using force (33) selectively applied with the hoisting string, the actuator (22, 129) and/or the BHA (130, 181) engagement (95) to the lowest end of a housing (27) embodiment (27AK), wherein an actuatable energy (19, 34, 35 or 37) is also usable to move (38AK2) members within the housing. A spring (19) can be usable between the second piston (21AK) and the first piston (20) embodiment (20AK), which can be hinged (41) to the pivot arm (4) embodiments (4AK), which carries a cutter (5) embodiment (5AK) in a retracted (141) arrangement (1AK1).

The slip (138) actuators (22AK1) and the spring (19) actuator (22AK2) can be arranged so that the cutters (5AK) are partially retracted into the housing (27AK) lateral opening (23) embodiments (23AK) shown. Hoisting the apparatus (2AK) in a retracted (141) arrangement with the cutting wheels extending outside the housing (27AK) can be usable in instances where the larger mass of the housing rotates the apparatus (2AK) off of the retracted cutter (5AK) and where any incidental cutting of the surface (6AK) and inadvertent dulling of the cutter (5AK) are not of concern. Alternatively, the thickness of the housing (27AK) can be increased or a second housing with second lateral openings can be engaged to the first housing to cover the gap (38AK1) and prevent any build-up of debris that could prevent it from closing and to prevent incidental cutter (5AK) wheel contact with the surface (6AK).

Selectively applied string hoisting force (33AK1) can act against the inertia or momentum force (33AK2) of the BHA mass to cause the slip (138) actuator (22AK1) to slip upward along the second shaft (25AK) so as to be secured by said slip arrangement against downward movement from the weight of the remaining portion of the BHA. Selective operation of the slips (138) can move (38AK1) an actuator (129) and/or BHA (130, 181) engaged second piston (21AK) axially upward when, e.g., a jarring or quick change is made to the axial direction of apparatus (2AK) hoisting. Using the momentum of the BHA mass, or the jarring of the BHA against a downhole surface, to initiate a quick downward tool string movement can release the slips for movement in one direction, wherein inertia of the weight of the BHA can quickly stop downward tool string movement in the other direction to engage the slips at an axially higher position and, thus, move associated members to close the gap (38AK1).

A series of selective jarring forces (33AK2) can initiate selective axial movements (38AK1) that can urge the mass of the BHA to incrementally move the second piston (21AK) axially upward and actuate the uncompressed spring length (38AK2) axially upward into the first piston (20AK), so as to compresses the spring (22AK1), and push the piston to operate the hinge (41) to urge the pivot arms (4AK) against the cam faces (26AK) to extend (142 of FIGS. 87 to 90 and FIGS. 92 to 93) the cutters (5AK) laterally (38AK4) upward (38AK6) from the shaft cutter receptacle (159) and lateral opening (23AK) of the housing (27AK) at the selected subterranean depths that selective hoisting (33AK2) moves the pistons from (38AK1) to (38AK5 of FIG. 88).

Alternatively, any conventional actuation device (129) can be used to exert (22) axial force (33) between the anchored second shaft (25AK) and second piston (21AK) to move the second piston (21AK) axially upward from (38AK1) to (38AK5 of FIG. 88) using, e.g., a hydrostatic actuator containing a pre-charge pressure actuator (e.g. 129 of FIGS. 117 to 122) that is matched to the hydrostatic fluid pressure of the well (52) at a selected depth. Various other devices can be used, including conventional timers, motion activated, explosive means and/or electrical mechanical means that may be operated by using batteries or by insulated slickline cable that passes current through the second shaft (25) to the actuator device (129). It is to be understood that the innovative integration of a small second shaft (25AK) can provide an anchoring means and/or electrical conductor means that can be usable to function various suitable conventional or prior art actuators (129).

Figure 92:
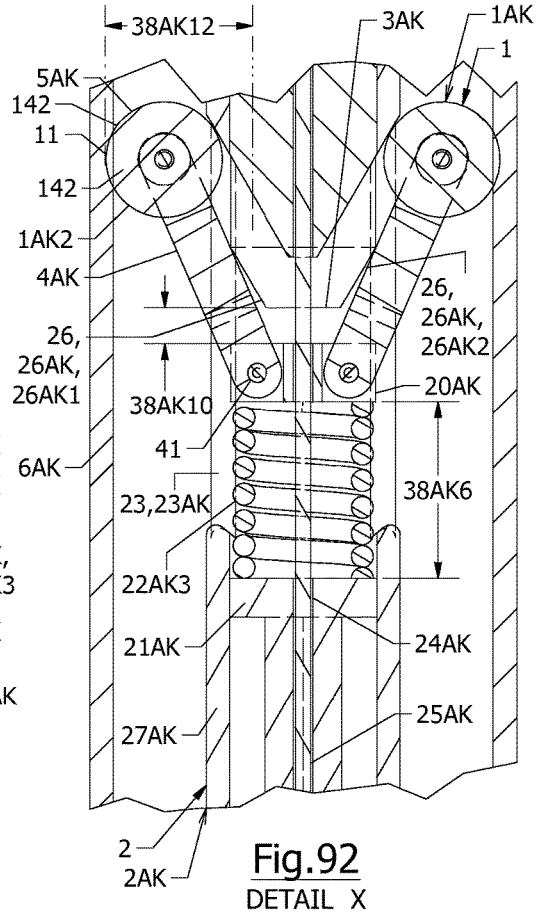

FIGS. 87, 88 and 92 show the plan view with section line G-G, an elevation cross sectional view through line G-G of FIG. 87 with line H and the magnified detail view within line H of FIG. 88, respectively, with dashed lines showing hidden surfaces, for the extended (142) hoisting method (1) embodiment (1AK) to selectively actuate an apparatus (2) embodiment (2AK) into an initial furrow (11) cutting disposition (1AK2) using axial hoisting force (33) embodiment (33AK3) and BHA mass force (33) embodiment (33AK4) to form a longitudinal furrow (11) along the circumference and axis of a tubular body's subterranean surface (6AK).

Application of hoisting tension force (33AK2) to lift the BHA and the mass force (33AK4) to lower the BHA can drag the cutters (5AK) to selectively cut longitudinal furrow grooves between two depths using a winch hoisting wire, which can be connected (95) to the first shaft (3AK) to urge and axially move (38AK5) the first piston (20AK) relative to the second piston (21AK) which can be secured from downward movement along the second shaft (25AK) by the slips (138) that can be used to compressively actuate (22AK3) and move (38AK6) from an unactuated (22AK2) spring (19) arrangement, so as to urge cutters (5AK) into the surface (6AK).

Alternatively, a force (33AK4) can be applied by, e.g., fluid (34) energy using a hydrostatic actuator, electrical (35) energy using a solenoid and/or combined axial, fluid, electrical and chemical energies (37) using an explosive or battery operated device, to compress the spring (19) and/or move the spring (19) axially upward within the housing (27AK) against the first piston (20AK) to operate hinges (41) and move the pivot arm (4AK) carried cutters (5AK) axially upward (38AK3) and laterally outward (38AK4) into the subterranean surface (6AK) to form a longitudinal cut when the apparatus is hoisted in the well.

The method (1) can further comprise the method actuation embodiment (1AK2) of selectively engaging the apparatus (2AK) and/or the lower end of the BHA (130, 181) or actuator (129) axially against, e.g., the no-go of a nipple profile (79 of FIG. 1), a surface diameter reduction, a bridge plug (163 of FIGS. 1 and 88), or the top of a cement plug (88 of FIGS. 7 and 88) placed through circulation, between the tubing and the annulus between the tubing and casing at the lower end of a subterranean well being suspended or abandoned.

Figure 93:
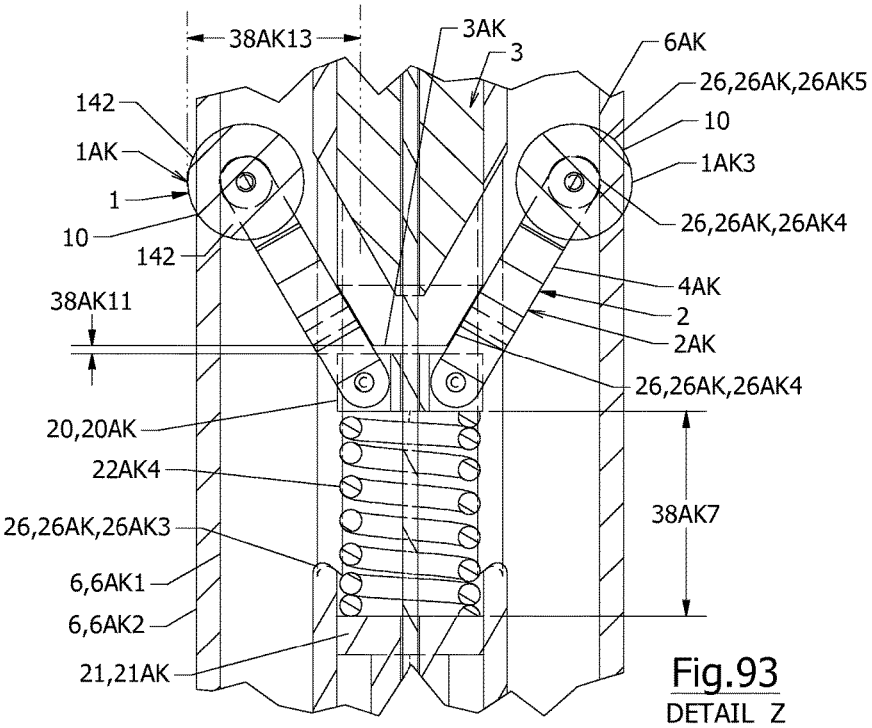

FIGS. 89, 90 and 93 show the plan view with section line I-I, an elevation cross sectional view through line I-I of FIG. 89 with line J and the magnified detail view within line J of FIG. 90, respectively, with dashed lines showing hidden surfaces, for the extended (142) hoisting method (1) embodiment (1AK) laterally (38AK8) upward (38AK7) along (38AK9) a subterranean surface (6AK) to perforate (10) and cut (1AK3) the body of a tubular (53-57,60,76,78, 134) subterranean wall surface (6AK), wherein the apparatus (2) embodiment (2AK) is hoisted and selectively moved (38AK9) between selected depths in the extended (142) configuration.

The spring-like device (19) can be used for dampening actuation (22AK4) that allows small lateral movement between (38AK4 of FIG. 88) and (38AK8) during application of the axial upward hoisting force (33AK3) and during application of the apparatus and/or BHA mass force (38AK6), usable to drag the cutters (5AK) between selected depths (38AK9). The spring dampening movement between (38AK5 of FIGS. 88 and 92) and (38AK9), is associated with the full compression actuation (22AK3) of the spring and the working load actuation (22AK4) dispositions.

As a string, e.g. wireline or slickline, can stretch between surface and a subterranean cutting depth, a spring actuator can be usable to a selectively control forces to dampen adverse shocks that can potentially damage the cutter (5AK) as the apparatus assembly (2) is repeatedly axially pulled upward with the string and downward with the mass of the BHA. During hoisting cutting forces can be greater than those associated with axially downward cutting associated with mass of the BHA (130, 181) due to the laterally upward orientation of the pivot arms and cutters. Accordingly, to reduce the probability of embedding and sticking a cutter in the wall, a gradual furrowing (11) is performed into the surface, through repeated upward and downward apparatus movements (38AK9) between selected depths, until the desired furrow is formed and/or until the cutter perforates (10) the opposite surfaces of a downhole tubular (53-57,60, 76,78,134).

Preferred longitudinal cutting can comprise repeated actuating (22K3 of FIGS. 88 and 92, 22AK4) movement (38AK9) between dispositions (38AK6 of FIGS. 88 and 92) and (38AK7) of an apparatus assembly (2AK) and associated BHA (130, 181) between selected subterranean depths using the string's axial force (33, 33AK1-33AK6) of hoisting to selectively cut the circumference axially along the surface (6AK).

The method (1) can further comprise selectively deactivating the apparatus (2AK) by selectively jarring the cutters (5AK) into the upper end of the longitudinal cut to shear the second shaft (25AK) and/or securing dog (184) to release the tension forces added by moving the second piston (21) axially upward and securing it with the slips (138). Deactivating the apparatus can allow the pistons to fall with the upper end of the longitudinal cut acting as a cam face to urge retraction of the pivot arm carried cutters during selective upward jarring and/or hoisting at the upper end of the longitudinal cut.

Alternatively, the method (1) can further comprise deactivating the apparatus (2AK) by selectively setting conventional slickline timer and/or motion deactivation device to release the tension in the second shaft (25AK) to retract the cutters (5AK); or by using an insulated slickline hoisting string as a second shaft that passes an electric signal to a device, e.g. a solenoid, to release a securing dog or slip like mechanism in the actuator (129) or BHA (130, 184) to release tension between the first and second shafts holding the pistons in an actuated position. Axially downward movement of the pistons can be used to retract the cutter laterally inward and downward as the pivot arm engages a cam face of the housing.

Referring now to FIGS. 91, 92 and 93 illustrating magnified views within lines F, H and J of FIGS. 86, 88 and 90, respectively, for actuation method (1) embodiments (1AK1, 1AK2 and 1AK3). FIG. 91 shows a hoisting retracted (141) arrangement (1AK1) while FIGS. 92 and 93 show activated extended (142) arrangements (1AK2 and 1AK3) for longitudinal cutting (1) when the assembly (2) is hoisted within a well.

FIG. 91 illustrates that the retracted (141) apparatus (2AK) can be hoistable and usable within a plurality of surfaces (6AK, 6AK1) diameters, whereby changing cutter (5AK) diameter and further arranging or disposing the cutter within the housing during hoisting can be usable to hoist within and cut longitudinal perforations or furrows in additional wall surfaces (6AK2). Within various surfaces (6AK, 6AK1), the thickness of the housing (27AK) can be increased to ensure the lateral opening (23AK) receptacle prevents inadvertent cutting of the surfaces.

Alternatively, to ease manufacture or reduce part inventories, a second housing with second lateral openings can be fitted over the existing housing (27AK) and lateral openings to protect both of the surfaces and cutters from inadvertent use. Additionally, the cam face (26AK3) can be adjusted axially upward within the first or a second housing to aid retraction. Alternative arrangements can include conventional roller stem, go-devils, roller boogies, or other rollers within a bottom hole assembly to extend the same distance as the illustrated cutting wheels to prevent substantially cutting a surface (6AK, 6AK1) before activation. Accordingly, the cost of holding an inventory of longitudinal cutter apparatuses (2) can be lowered by using the same assembly within different surfaces (6AK, 6AK1, 6AK2) by adding and subtracting additional housings and/or using different cutter (5AK) diameter suited for, e.g., the smaller wall thicknesses of smaller diameter tubulars.

If incidental cutter impact with the surface is acceptable, the apparatus (2AK) can be hoisted within the well with preferred rotational wheel cutters (5AK) extending from the housing (27AK) body, wherein the wheel cutters tend to rotate the bottom hole assembly off the fulcrum of the cutting edge to frictionally rest on the housing body, thus allowing the apparatus to be hoisted without substantially cutting the surface (6AK, 6AK1) before activation.

FIG. 92 shows activating the apparatus (2AK) by urging the second piston (21AK) axially upward to engage the spring-like device (19) to compress and/or move it (38AK6), with the remaining movement (38AK10) between the first piston (20AK) and the first shaft (3AK) further usable, to urge the pivot arm (4AK) cam face (26AK2) against the first shaft cam face (26AK1) through the lateral opening (23AK), to axially and/or transversely move (38AK12) the carried cutter (5AK) and, thus, cut a longitudinal furrow (11) into the subterranean surface (6AK) when the apparatus (2AK) is hoisted (1AK) until the surface acts as a cam face (26AK4 of FIG. 93) against a portion of the pivot arm to control the cut depth or optionally provide a cam face (26AK5 of FIG. 93) for urging retraction of the cutter at the furrows upper end.

FIG. 93 depicts the spring-like device (19) at a working distance (38AK7), wherein the spring-like device disposes the first piston (20AK) closer (38AK11) to the first shaft (3AK), wherein the pivot arm (4AK) is fully against the cam (26) embodiment (26AK) of the first shaft (3) to move the cutter (5AK) from (38AK12) to (38AK13) to perforate (10) and/or cut the tubular wall circumferential surfaces (6K, 6K1, 6AK2) along their longitudinal axis.

When the longitudinal cut movement (38K9 of FIG. 90) is extended axially upward, the spring-like device can allow compressive movement (38AK6 of FIG. 92) to move (38AK10 of FIG. 92) the first piston (20AK) and partially retract the pivot carried cutter to reduce the propensity for embedding, cutter sticking, and/or unnecessary damage to the cutter (5AK) due to jarring of the apparatus assembly (2AK) into, e.g., a stress hardened portion of the tubular steel or the upper end edge of the longitudinal cut to allow the cut to be gradually deepened with the force of the spring-like device that can move between a fully compressed (38AK6) and a more optimal working position (38AK7).

Various cam face (26) embodiments (26AK, 26AK1 of FIGS. 92 and 26AK2 of FIG. 91) associated with the first shaft (3), housing (27), housing lateral opening (23), and/or pivot arm (4) can be usable at various apparatus (2) cutter dispositions, whereby various apparatus (2) hoisting and tensions between the first (20) and second (21) shafts can urge the pivot arm (4) against at least one of the cam faces (26) during extension or retraction of the cutter (5).

Referring now to FIG. 94, the Figure shows an exploded apparatus assembly (2) view, in an upwardly looking isometric viewpoint, with dashed lines illustrating hidden surfaces and dotted lines representing connections between members, an apparatus assembly (2) embodiment (2AL), and a method (1) embodiment (1AL) for cutting a plurality of axial longitudinal cuts in a subterranean surface.

The Figure depicts a string hoistable apparatus (2AL) using selectively transferred force (33AL) arrangements associated with a first shaft (3AL) member engaged to at least one housing (27AL) member via a mandrel connector (186) in an associated receptacle (187). An actuator (22, 22AL) can comprise a slip part member that slips axially along the second shaft (25AL) in one direction but not the other, and which uses the mass of the BHA (181) or the mass of series (130) of apparatus (2) bottom hole assemblies and/or a conventional actuation device (129) that urges the first piston (20AL) via a second (21AL). The housing can have a plurality of lateral housing openings (23AL) through which a plurality of first pivot arm (4AL) members carrying an associated plurality of first cutter (5) members can be rotated around hinge mandrels (186) within associated receptacles (187) of the pivot arm so as to be disposed through the lateral opening. A cam surface (26AL1-26AL3) on the first shaft and housing can urge the pivot arm carried cutter to be extended laterally outward and upward or retracted laterally inward and downward to urge the pivot arm carried cutter transversely into or transversely away from a subterranean well surface (6AL).

A first piston (20AL) member can be axially disposable within the housing (27AL) to carry and axially laterally operate the pivot arms (4AL) through the lateral housing openings (23AL) via an associated plurality of hinges (41) securing the pivot arm to the first piston with, e.g., mandrel (186) connectors in receptacles (187) of the first piston (20AL).

The second shaft (25AL) member can be secured to the first shaft (20AL) with, e.g., a securing dog mandrel (184) in an associated receptacle (187) of the first shaft (3AL), wherein the second shaft (25AL) is disposable through an axial passage (24AL1) in said housing and axial passage (24AL) through the first piston (20AL) and second piston (21AL) members. The second piston (21AL) can be secured to an actuator (129), another apparatus BHA (130), or a conventional BHA (181) using a mandrel connector in a receptacle, such that the actuator or BHA can be usable for extending and retracting cutters. The second piston (21AL) can be urged into the first piston (20AL) by tension applied to the second shaft (25AL) and, thus, operate the hinge (41) by urging the pivot arm (4AL) against a cam face (26) arrangement to extend the cutter laterally upward or retract it laterally downward out of or into the lateral openings (23AL) of the housing (27AL). An optional spring-like device (19AL) may be placed between the pistons (20AL, 21AL) to cushion shocks and gradually apply lateral force to, e.g., reduce the propensity of sticking the cutter and to extend the life of the cutter (5AL) by dampening shock forces during hoisting.

Selectively hoisting the apparatus (2AL) selectively engages and selectively transfers mechanical hoisting or BHA mass forces (33) coincidentally between apparatus assembly members and the hoisting string or said subterranean wall surface (6AL) to selectively impart movement (38) to at least one member of the apparatus assembly, wherein the apparatus assembly urges the pistons axially along the second shaft within said housing to operate the hinge to axially and laterally dispose the pivot arm carried cutter through the lateral housing opening into or away from said surface of said subterranean well to form at least one axial longitudinal cut (11) axially along a subterranean surface (6) between selected depths within a subterranean well.

The second piston (21AL) can also have cam faces (26AL4) of, e.g. a hexagon that can slide and which can provide circumferential orientation between a plurality of housing (27AL) lateral openings (23AL) to, thus, circumferentially orient an associated plurality of pivot arm (4AL)

carried cutters (5AL) by sliding a second apparatus assembly (2) with the hexagonal cam face arrangement (26AL3) at the lower end of the housing (27AL).

An apparatus (2AL) can be easily assembled by placing the second piston (21AL) through the second shaft passageway (24AL1) at the lower end of the housing (27AL) to secure the piston (21AL) mandrel connector (186) into the receptacle (187) of the upper end of the actuator (129) or BHA (130, 181) so as to circumferentially align the cam faces (26AL3, 26AL4) to the desired orientation of the lateral opening (23AL).

A spring-like (19AL) actuator (22AL) can optionally be placed in the housing to act between the second (21AL) and first (20AL) pistons.

The pivot arms (4AL) can be secured to the first piston (20AL) using mandrel connectors (186) coupled within associated securing receptacles (187) in the piston (20AL), which can then be placed in the housing (20AL). The cutters (5AL) can be secured to the pivot arms (4AL) using a mandrel coupling (186) in receptacles (187) of the pivot arm (4AL) before or after it is placed in the housing (27AL) by extending the arms laterally out of the housing openings (23AL).

The first shaft mandrel (186) connector can then be engaged with the upper end receptacle (187) of the housing to orient the cutter receptacles (159) to the cutters (5AL) so that the cam face (26AL1) of the first piston is aligned with the lateral opening (23AL).

Optionally, if the cam face (26AL2) is used to guide the pivot arms (4AL), a cutter receptacle can be machined in the face (26AL2) to facilitate the cutter (5AL).

Finally the second shaft (25AL) can be inserted through the shaft passageway (24AL) and secured to the first shaft (3AL) using, e.g., a dog (184) within a receptacle (187), to provide a frictional or shearable engagement that can be, e.g., used to hold tension within the second shaft and/or jarred free to deactivate the apparatus (2AL) and allow the pivot arm (4AL) cutters (5AL) to be retracted laterally downward against a cam face (26AL2) usable to fully retract the cutters.

FIG. 95 illustrates an upwardly looking isometric view with dashed lines representing hidden surfaces of the first shaft (3) embodiment (3AM) of an apparatus (2) embodiment (2AM) usable with a method (1) embodiment (1AM) to connect a plurality apparatus bottom hole assemblies (130 of FIGS. 98 to 100) that are usable to transfer axial force to cutter to form a plurality of circumferentially phased perforation (10) or furrow (11) longitudinal cuts into the wall surface (6) of a subterranean well. The first shaft (3) embodiment (3AM) has a receptacle (187) that can be connected to a second shaft mandrel (e.g. 186 of 21AL of FIG. 94) of another apparatus to allow a plurality of axially stacked apparatuses to form an apparatus (2) bottom hole assembly (130 of FIGS. 98 to 100). The first shaft (3AM) can have a receptacle (159) for diametrically opposed cutters or, optionally, a single cutter. The cam face (26) embodiment (26AM) can be aligned to other cutters to provide more than one cutter within a longitudinally cut furrow or can be associated with angularly offset or diametrically opposed (e.g. 2L of FIG. 94) pivot arm (2Q of FIG. 111) carried cutter arrangements operated by a central shaft (e.g. 25 of FIG. 94) disposable through passageway (24AM).

FIG. 96 shows an elevation cross section of an electric driven prior art tubing (60) production packer (76) longitudinal cutter (190) arrangement taught by U.S. Pat. No. 6,478,093 B1.

FIG. 97 depicts an elevation cross section view of FIG. 96, scaled to show a 60.3-mm (2⅜ in.) outside diameter 8.8 kg./m (5.9 ppf) API tubing (60) packer (76) engaged inside of 101.6-mm. (4-in) outside diameter 16.4 kg/m (11-ppf) API casing (55), respectively, to demonstrate that U.S. Pat. No. 6,478,093 B1 does not teach or disclose the transverse dimension (192) necessary to pass a cutter (188) capable of cutting through a tubing (60) production packer (76) secured within a casing (55).

Referring to FIGS. 96 and 97, a prior art cutter (188) pivot arm (174) is moved (189) to transversely extend a saw (190) and electrical motor (191) coupled to the cutter (188) for rotationally cutting through (189) the packer (76).

U.S. Pat. No. 6,478,093 B1 discloses an alternative to a chemically reactive longitudinal cutter comprising the electrically rotated saw cutter, shown in FIG. 96, but is silent to how such a cutter could be fitted into a conventional API well design, e.g. that of FIG. 97, where the tubing diameter could fit within the diameter of a conventional soft drink can ((172) of FIG. 111). Obviously, the proportions associated with the electrical saw, shown in FIG. 96 of U.S. Pat. No. 6,478,093 B1, are significantly larger in diameter than those of FIG. 97, because the cutter (188 of FIG. 97) diameter is necessary to cut through the packer (76 of FIG. 97), which is larger than the inside diameter of the tubing (60 of FIG. 97).

Additionally, U.S. Pat. No. 6,478,093 B1 is silent to practicalities of fitting a longitudinal electrical saw (190) within API tubing (60), which can commonly be smaller in diameter than a soft drink can, wherein the size of the pivot arm (174 of FIG. 31) and electrical motor (191 of FIG. 31) is significant compared to the transverse dimension (192 of FIGS. 97 and 31) of the tubing (60 of FIG. 97). Furthermore, U.S. Pat. No. 6,478,093 B1 is silent to how the transversely oriented motorized cutter (191) and pivot arm ((174) of FIG. 31) could be oriented longitudinally given the necessary space for the practical implementation of the motorized (42) hinge ((178) of FIG. 31).

Accordingly the teachings of U.S. Pat. No. 6,478,093 B1 are not practicably suited for, or adaptable to, small diameter API tubing standards and, hence, could not be adapted to satisfy the needs associated with a single longitudinal cutting apparatus (2) that can be usable across a plurality of API tubing sizes that included diameters smaller than that of a soft drink can.

Referring now to FIGS. 98, 99 and 100, the Figures illustrate a plan view, an elevation view and an isometric view, respectively, of an apparatus (2) in an extended position (142), within a subterranean conduit half-section, showing a method (1) embodiment (1AN) for forming an apparatus (2) bottom hole assembly (130) embodiment (2AN), which can be usable to form a plurality of axial longitudinal cuts in one or more subterranean surfaces.

The apparatus assembly (2AN) can comprise apparatus subassemblies (2AN1, 2AN2 and 2AN3), wherein the upper end first shaft (3AN1) can be engaged to a string rope socket (185) connector (95), while the apparatus subassembly (2AN1) lower end can be engaged to the apparatus subassembly (2AN2) upper end first shaft (3AN2), and the apparatus subassembly (2AN2) lower end can be engaged to the apparatus subassembly (2AN3) upper end first shaft (3AN3) to form an apparatus assembly (2AN) bottom hole assembly (130). The apparatus (2AN) subassemblies (2AN1, 2AN2, 2AN3) can be circumferentially oriented to angularly offset pivot arms (4AN, 4AN1, 4AN2, 4AN3) carried cutters (5AN, 5AN1, 5AN2, 5AN3) to form a plurality of phased longitudinal cuts. A single second shaft (25AN) can pass through an associated shaft passage (24AN) between apparatus (2AN) subassemblies (2AN1, 2AN2, 2AN3) so as to coincidently operate all, while a second piston (21) embodiment (21AN3) can be engagable to further subassemblies or an associated bottom hole assembly member comprising, e.g., an actuator.

Selectively hoisting the apparatus (2AN) bottom hole assembly (130) can selectively actuate (22, 22AN) and transfer hoisting forces (33, 33AN1) and mass forces (33, 33AN2) between the string and apparatus assembly (130) members or subterranean wall surface (6, 6AN) to selectively impart movement to the pistons flexibly arranged with springs (19, 19AN1, 19AN2, 19AN3) axially along the second shaft (25, 25AN), within the housings (27, 27AN, 27AN1, 27AN2, 27AN3), to operate the hinge and axially and laterally dispose the pivot arm (4, 4AN1, 4AN2, 4AN3) carried cutters (5, 5AN1, 5AN2, 5AN3) through associated lateral housing openings (23, 23N1, 23AN2, 23AN3), into or away from one or more surfaces (6, 6AN1, 6AN2, 6AN3) of the subterranean well to form a plurality of longitudinal cuts, axially along a subterranean well surface between selected depths (193).

The apparatus (2AN) can have a transverse dimension (192, 192AN4) that can be hoisted and used within a subterranean surface (6AN1) transverse dimension (192, 192AN1), diameter (Ø 192), surface (6AN2) transverse dimension (192AN2), or, alternatively, the surface (6AN3) transverse dimension (192AN3), if the cutter (5) and pivot arm (4) are retracted into the housing (27).

Referring now to FIGS. 103, 104, 105 and 106 depicting a plan view with line K-K, an elevation cross section view through line K-K of FIG. 103, a plan view with line L-L and an elevation cross sectional view through line L-L of FIG. 105, respectively, illustrating an apparatus (2) embodiment (2AO) in a retracted (141) apparatus hoisting method (1AO1) arrangement and in an extended (142) hoisting cutter method (1AO2) arrangement within an embodiment (1AO) of the method (1) for selective hoisting (38AO3) and longitudinally cutting of a subterranean surface (6, 6AO) within a visually ample inside diameter tolerance between the apparatus and tubing (60).

FIGS. 107, 108, 109 and 110 show a plan view with line M-M, an elevation cross section view through line M-M of FIG. 107, a plan view with line N-N and an elevation cross sectional view through line N-N of FIG. 109, respectively, depicting an apparatus (2) embodiment (2AP) in a retracted (141) apparatus hoisting method (1AP1) arrangement and in an extended (142) hoisting cutter method (1AP2) arrangement within the method (1) embodiment (1AP) for selectively hoisting (38AP3) and longitudinally cutting of a subterranean surface (6, 6AP) within a relatively small inside diameter tolerance between the apparatus and tubing (60).

Referring now to FIGS. 103 to 110, the Figures show exemplary proportions for placing a 44.45 mm. (1.75 in.) diameter apparatus (2, 2AO, 2AP) within 88.9 mm. (3.5 in.) outside diameter and 76-mm. (2.992-in.) inside diameter API tubing (60 of FIGS. 103 to 106) and 60.325 mm. (2.375 in.) outside diameter 50.7-mm. (1.995-in.) inside diameter API tubing (60 of FIGS. 107 to 110).

A first shaft (3) member (3AO, 3AP) can be engaged to at least a housing (27) member (27AO, 27AP) with at least a first lateral housing opening (23, 23AO, 23AP) through which at least a first pivot arm (4) member (4AO, 4AP) carrying at least a first cutter (5) member (5AO, 5AP) is disposed through. The activation method (1AO, 1AP) can comprise moving from the deployment hoisting arrangement (1AO1, 1AP1) to the cutting hoisting arrangement (1AO2, 1AP2) by urging the piston (20) member (20AO, 20AP) with the second piston (21) member (21AO, 21AP) and using the hinge (41) to rotate the pivot arm to extend (142) it laterally (38AO2, 38AP2) upward or retract (141) it laterally (38AO2, 38AP2) downward against cam faces (26) of the first shaft (26AO, 26AP), the housing, its lateral opening or the subterranean surface (6), which can be used to urge the pivot arm carried cutter (5AO, 5AP) transversely into or transversely away from and axially upward or downward along a subterranean well surface.

The first piston (20) member (20AO, 20AP) is axially disposable within the housing and along the second shaft (25) member (25AO, 25AP) to carry and axially laterally operate the pivot arm (4AO, 4AP) through the lateral housing (27AO, 27AP) opening (230, 23AP) via the hinge (41) arranged between said first piston and said pivot arm.

An actuator (22) member (22AO, 22AP) part can comprise a slip (138) part of the second piston (21) member (21AO, 21AP) coupled to at least a second shaft (25) member for transferring force (33) from the string (33AO2, 33AP2) through slipping (22AO, 33AP, 33AO3, 33AP3) of the second piston (21AO, 21AP) to the first piston (20AO, 20AP) and said pivot arm (4AO, 4AP) carried cutter (50, 5AP). Once hoisted (33AO1, 33AP1) to a selected depth, the apparatus (2) can selectively use jarring hoisting (33AO2, 33AP2) and the mass of the second piston (21AO, 21AP), together with the mass of any engaged BHA, to operate slips (138), which slide in one direction and not the other to move (38) the pistons the distance (38AO1, 38AP1) necessary to actuate (22AO1, 22AP1) the pivot arm (4AO, 4AP) cam face against the first shaft cam face (26AO, 26AP) and laterally dispose (38AO2, 38AP2) the carried cutter (5AO, 5AP) to longitudinally cut (38AO3, 38AP3) the surface (6AO, 6AP) when the apparatus (2) is hoisted (33) in an extended (1AO2, 1AP2) arrangement.

The apparatus (2AO, 2AP) deactivation method (1AO, 2AP) can comprise moving from an actuated hoisting arrangement (1AO2, 1AP2) to a deployment hoisting arrangement (1AO1, 1AP1) by jarring against the distal end of the longitudinal cutting movement (38, 38AO3, 38AP3) to break the slips (138) or break, or shear, the second shaft (25AO, 25AP) and release the actuator (22AO, 22AP) slips (138) tension force, between the second piston (21AO, 21AP) and mandrel (186) secured upper end of the second shaft, to allow the pistons (20AO, 20AP, 21AO, 21AP) to slide downward with the mass force of gravity and axial passage (24) member (24AO, 24AP) feature through the housing and pistons. Subsequently, the apparatus (2AO, 2AP) can be retrieved from the well for repair, replacement and/or re-use on the same or a different subterranean surface.

Below the uppermost rope socket (185) the second shaft (25AO, 25AP) can be secured at an upper end with a mandrel (186) and securing slips (138) that can be used on the upper-most apparatus (2AO, 2AP) of a plurality of apparatuses (2) and removed from the rest. The lower end slips (138) can be used on the lower-most second piston (21AO, 21AP) of a plurality of apparatuses (2) and removed from the rest. Accordingly, a bottom hole assembly of apparatuses with a single second shaft (25AO, 25AP) passing through the passageway (24AO, 24AP) of all apparatuses and anchored only at the top and bottom of the plurality of apparatuses (2) can be used to allow all members between the two anchor points to be disposed along the single second shaft (25AO, 25AP) and be moved (38AO1, 38AP1) and actuated (22AO1, 22AP1) to laterally extend (38AO2, 38AP2) all of the cutters (5AO, 5AP) concurrently.

A stacked plurality of apparatuses can be coupled by connecting the upper end of the first shaft (3AO, 3AP) of a second apparatus (2) assembly to the lower end of the second piston (21AO, 21AP) of the first apparatus (2) assembly, wherein the uppermost receptacle of the uppermost first shaft (3AO, 3AP) can be coupled to the lower end of a rope socket (185) and the lowermost end of the lowermost second piston (21AO, 21AP) can be coupled to the upper end of any remaining portion of the BHA comprising, e.g., sinker bar and/or rollers used to deploy the BHA into a well.

The apparatus (2AP) can also comprise using an insulated slickline actuator (22AP2) to transfer electrical energy to a lower end of the apparatus (2) or BHA to extend (142) and/or retract (141) to a cutting method (1AP2) or apparatus deployment method (1AP1) arrangement. The method (1AP1, 1AP2) can use electricity to operate, e.g., motors, pumps, solenoids or any other electrical suitably sized devices, such as a firing head used to actuate a chemical reaction or explosives to move (38, 38AP1, 38AP2) apparatus members which can be hoisted (38AP3) to form a longitudinal cut by dragging the cutter (5AP) axially along the circumference of the tubular surface (6AP).

The use of an apparatus (2) with an individual cut track or plurality of aligned cutters and tracks can be useable to produce a single or plurality of longitudinal cuts selectively oriented to, e.g., the higher side of the well conduit (e.g. 60) bore given that the mass of the apparatus will orient to the lower side with gravity to point one or more aligned or angularly offset cutter approximately upward. Additionally, using a single or a plurality of longitudinal slot, track or furrow cuts can be usable to provide a suitable actuation (22, 22AO1, 22AP1) movement (38, 38AO1, 38AP1) for cutting within tight tolerances (1AO, 1AP), whereas the use of opposing pivot arms and cutters can reduce the movement (38AO1, 38AP1) necessary to produce the lateral cutter movement (38AO2, 38AP2) and, hence, can be less practical within tight tolerances where actuation distances are advantageous between the apparatus (2) and tubing.

Deployment (1AO1, 1AP1) and cutting (1AO2, 1AP2) method arrangements can adjust retracted (141) and extension (142) of apparatus (2) members using, e.g., a spacer (199) piston member to adjust the effective axial lengths or disposition of members during use. The presence (1AO) or absence (1AP) of an additional piston or spring used as a spacer (199) can be used to maintain the size of various other member parts to minimise the inventory of parts necessary for different tubing sizes (60 of FIGS. 103 to 106 and 60 of FIGS. 107 to 38) and, thus, provides significant benefit over other prior art.

Referring now to FIG. 111 illustrating an exploded apparatus assembly (2) view from an downwardly looking isometric viewpoint with dashed lines illustrating hidden surfaces and dotted lines showing connections between members and the apparatus assembly (2) embodiment (2AQ) and method (1) embodiment (1AQ) with a transverse dimension (192AQ1) useable within dimensions smaller than the transverse dimension (192AQ2) of a soft drink can (172).

Selective hoisting (33) can selectively transfer forces (33AQ1 to 33AQ5) between a rope socket (185) and members of the apparatus assembly (2AQ) and the hoisting string or the subterranean wall surface (6AQ) using an actuator (22AQ1) to selectively apply force (33AQ3) to hold tension within the second shaft (25) and impart force (33AQ4) and associated movement to the second piston (21AQ) to urge (33AQ4) the first piston (20AQ) and operate the hinge (41) to rotate and transversely dispose the pivot arm (4, 4AQ) cam face (26AQ3) against the first shaft (3AQ) cam face (26AQ1) and/or housing (27AQ1) part (27AQ2) cam face (26AQ2) to axially and transversely dispose the carried cutter (5AQ) so that it can engage and cut (10, 11) into or disengage from the subterranean surface (6AQ).

An actuator (22AQ1) can comprise a prior art or conventional actuating device (129) or the actuator (22AQ1) can comprise the mass of the second piston (21AQ) and mass of the remaining portion of the BHA engaged to its lower end. The actuator (22AQ1) can oppose the upper end actuator (22AQ2), which can be a slip (138) actuator, arranged to urge member movement between the actuators (22AQ1, 22AQ2) along the second shaft (25AQ).

The selectable hoisting force (33AQ1) and mass force (33AQ2) of the apparatus (2AQ), including any remaining selectable BHA mass at its lower end, can be selectively transferred to actuating forces (33AQ3, 33AQ4) along the second shaft (25AQ) between the second piston (21AQ) and slip (138) secured to the first shaft (3AQ) to extend the cutters or, alternatively, the hoisting (33AQ1) and mass (33AQ2) can be selectively transferred along the second shaft (25AQ) to deactivating forces (33AQ4, 33AQ5) that can retract the cutters (5AQ1-5AQ4) engaged to the pivot arms (4AQ). Removing the second piston (21AQ) actuating force (33AQ3) and/or adding sufficient deactivating force (33AQ5) can allow the mass force (33AQ4) of the first piston (20AQ) to impart downward motion to the pivot arm (4AQ) via its hinge (41) engagement to retract the pivot arm against the cam face (26AQ3) of the housing (27AQ1) to retract the cutter (5).

The apparatus (2) embodiment (2AQ) provides the significant benefit of being easily machined and assembled.

For example, the housing can initially comprise a solid bar that is bored longitudinally with two conventional drill bits of different diameters and, starting from the upper end of the housing (27AQ1), the lateral opening (23AQ) can be easily cut using a conventional mill or circular saw with the cam face (26AQ4) shaped with a conventional grinder.

A separate housing part (27AQ2) can have a cam face (26AQ2) and can be a moulded forging, for ease of construction, since it bears only cam forces and not the mass of the BHA or associated jarring tensile forces of hoisting. Alternatively, the housing part (27AQ2) and first piston (21AQ) can be cut from a plate and shaped with a router mill, grinders and/or with welded parts.

The first shaft (3AQ) and second piston (21AQ) can be constructed from bar stock using a lathe with conventional drill bits used to provide a central passageway (24AQ), concentric receptacles (187) and transverse receptacles (187).

Mandrels (186) and receptacles (187) can be commonly available couplings or fasteners comprising, e.g. screws and threads, or pins with c-ring securing means in or through associated receptacles (187).

Cutters (5) can be drilled, ground and sharpened plates (5AQ4) or conventionally available plumber-style cutting wheels (5Q1 to 5AQ3) suitably sized and selected for the subterranean surface (6AQ) metal being cut.

Pivot arms (4AQ) can be cut from bar or plate stock and shaped with a router type mill, whereby receptacles (187) can be drilled to fit the hinge (41) mandrel (186) and cutter (5AQ1 to 5AQ4) mandrels (186). The complexity of manufacture, maintenance and operation can be reduced by arranging the pivot arm cam face (26AQ3) and cutter receptacle to enclose the cutter (5) to protect other cam faces (26AQ1, 26AQ2) when the cam face (26AQ3) engages said other cam faces.

Central passageways (24AQ) can be sized to accommodate using a piece of slickline wire for the second shaft (25AQ). Associated slips (138) can be any suitable slip, e.g. a malleable material or serrated brittle segments, disposable around the central passageway (24AQ) to grip or anchor the second shaft (25AQ) in one or both axial directions using, e.g., the hoisting and mass force bearing transversely oriented mandrels (186) secured through the transverse receptacles (187) of the first shaft (3AQ) and housing (27AQ1, 27AQ2).

The slips (138) can be used as an actuator (22AQ2) for activating and deactivating the apparatus (2AQ), wherein jarring of the BHA can be used to both slip and initiate or shear out of and dislodge the grip on the second shaft (25AQ) if, e.g., a rigid serrated non-slip type is used to grip and cut the second shaft so that it ultimately shears. As is the practice, metal can be constructed to a relatively precise specification to withstand operational forces and selectively shear at a predetermined value.

Assembling the apparatus (2AQ) can comprise engaging a cutter (5AQ1, 5AQ2, 5AQ3 or 5AQ4) to the pivot arm (4AQ) using a mandrel within the upper receptacle (187) of the pivot arm and, then, engaging the (4AQ) lower receptacle (187) of the pivot arm to the first piston (20AQ) hinge (41) receptacle (187) using a mandrel (186) coupling. Continued assembly can include disposing the second piston (21AQ) and then the first piston (20AQ), with the attached pivot arm (4AQ) and cutter, into the main housing (27AQ1) part. The second shaft (25AQ) can then be threaded through the central passageway (24AQ) of the pistons (20AQ, 21AQ) and housing.

Assembly of the apparatus (2AQ) can further comprise disposing and engaging the first shaft (3AQ) lower mandrel (186) within the upper receptacle (187) of the housing (27AQ1) and housing part (27AQ2), whereby disposing the second shaft (25AQ) through the first shaft (3AQ) passageway (24AQ) into the securing slips (138), inserted into the upper receptacle (187) of the first shaft (3AQ), engaged via axially transverse mandrels (186) and associated axially transverse receptacles (187) through the housing (27AQ1, 27AQ2) into the first shaft (3AQ) against the slips (138), which can be used to secure the second shaft (25AQ) to the first shaft (3AQ) and housing (27AQ1, 27AQ2). The circumferential orientation of the lateral opening (23AQ) can be varied by aligning the housing's lateral opening (23AQ) axially transverse receptacles to a particular axially transverse receptacle in the first shaft (3AQ) before engaging the axially transverse mandrels within the associated transverse receptacles.

Assembly can further comprise engaging the lower end of a rope socket (185) mandrel (186) into the upper receptacle (187) of the first shaft (3AQ). The lower end mandrel (186) of the second piston (25AQ) can be engaged to upper receptacle (187) of additional first shafts (3AQ) associated with additional member (4AQ, 5AQ, 20AQ, 21AQ, 25AQ) assemblies (2AQ) to form a bottom assembly below the rope socket (185). Additional BHA members, e.g. spang jars, hydraulic jars, knuckle joints, stem, roller stem, sinker bars and/or any other appropriate devices can also be engaged to the second piston (21AQ) to further form an apparatus (2AQ) assembly.

Any suitable pivot arm carried cutter (5) size (e.g. 5AQ1-5AQ3) or type (e.g. 5AQ1-5AQ3 and 5AQ4) can be usable to make a longitudinal cut within any embodiment of the present invention, whereby cutters that limit the risk of adversely embedding and sticking within the surface (6AQ) during hoisting of the cutter are preferable. If wheel type cutters are used, their thickness, blade angle and diameter can be selectively chosen to minimize such risk and control the longitudinal cut depth within the surface (6AQ).

Accordingly, the apparatus assembly (2AQ) provides the significant benefits of hoisting force operation (1AQ) with simple construction and easy assembly, wherein the longitudinal cutting apparatus (2) can also comprise a plurality of stacked assemblies using common parts that are easily manufactured due an elegantly simple solution method (1) that can be easily maintained at a relatively low cost compared to less elegant complex and more costly solutions comprising conventional and prior art longitudinal downhole cutters.

FIG. 112 depicts an elevation view of a knife-like cutter (5) embodiment (5AR) usable in an apparatus member assembly (2) embodiment (2AR) and method (1) embodiment (1AR), representing any other embodiment within the present invention that is usable to cut a longitudinal slot (10) or groove (11) into subterranean wall surfaces (6) or surface (6), wherein the cutting shape can be arranged with, e.g. a curved blade and/or a width and angle of the edge and body of the blade, usable to reduce the risk of adversely embedding and sticking within the surface (6) during hoisting. While the cutter (5AR) can comprise an autonomous member, it can also comprise an integral part of a pivot arm that can be formed by sharpening an appropriate portion of the pivot arm that is not associated with a cam face.

FIG. 32 shows a cross section of a prior art super abrasive (15) filament (18) cutter (125) arrangement that can be usable within the present invention to reduce the risk of adversely embedding and sticking within the surface during hoisting and longitudinal cutting of the subterranean surface.

Referring now to FIG. 113, the Figure illustrates an elevation view of a cross sectional slice through an apparatus (2) embodiment (2AS) usable with a method (1) embodiment (1AS) to cut a longitudinal slot coincidental with the axis of a subterranean well bore surface using an abrasive filament cutter (5AS) arranged as a band between two sheaves (200). The apparatus (2AS) can be actuated and deactivated according to the methods of the present invention. As the apparatus (2AS) is hoisted in the well, the abrasive band cutter (5AS) can rotate about the sheaves (200) to gradually impact into and abrade the surface (6AS) as the apparatus is forcefully hoisted axially.

The abrasive surface of the cutting filament band can be arranged to face the surface (6) with a smoother filament band surface feed over the grooves of the sheave (200), wherein the filament band groove can enclose the smooth portion and expose the abrasive portion of the cutting band. The pivot arm (4AS) can have a receptacle (187) for the cutting filament band to prevent engagement with the angled cam faces that orient the pivot arm (4AS) against the surface (6) to urge cutting, while limiting excessive impaction during rotation of the filament cutting band to, thus, reduce the risk of adversely embedding and sticking within the surface (6) during hoisting.

FIG. 114 depicts an elevation view of a prior art slickline anti-blow-up or brake tool (173), manufactured by Huntings International, with a quarter section removed to show an internal cross-section of its components, which can provide a similar function to the brake tool taught by Clapp, et al., in US 2013/0092372 A1. The depicted slickline brake (173) is a rugged downhole tool capable of withstanding large forces, while fitting within well passageway diameters smaller than a soft drink can ((172), shown in FIG. 111), wherein it can be actuated when the lower end of the BHA is pushed upward suddenly, or blown upward, as a result of fluid flow within a well. While the illustrated brake tool (173) is described with emphasis and can be visually comparable to the present invention, other conventional tools, like wireline downhole hangers and packers, can have a similar visual appearance and/or parts, wherein their lessons are generally contrary to the present invention and none are used for longitudinal cutting.

An anti-blow-up or braking tool (173) is generally connected to the slickline, via a threaded (95) or rotated keyed connector, above the fishing neck (182) of the tool (173).

The brake (174) is actuated when fluid forces push the BHA (181), connected to the lower end of the piston (180), axially upward.

Conventional practice and prior art is silent as to how a conventional slickline actuator could push the BHA upward, to selectively activate the brake, while retaining its robust nature and transverse dimension.

Additionally, sharpening the pivot arms of the depicted slickline brake tool (173) to form a cutter would, in effect, form an anchor shaped double hook arrangement that, like a ship's anchor or fishing hook, can cause the tool to become imbedded and stuck within a subterranean well surface when tension is applied to the string. Conventional practice is to use a non-slip and non-embedding surface to prevent penetration of the pivot arm into a subterranean well surface. Accordingly, sharpening the pivot arm is contrary to the purpose and design inherent to an anti-blow-up or braking tool (173).

Combining the lessons of the cutting wheel, as described in U.S. Pat. No. 6,478,093 B1, with the pivot arm (174) is not necessarily practical because a cutting wheel of sufficient diameter to cut a tubular wall or packer would in fact also cut the cam face (175) used to extend the pivot arm, and the prior art is silent as to how such an arrangement could be selectively activated or deactivated laterally.

In the absence of fluid flow, it not obvious how the pivot arms (174) could be selectively extended and retracted to urge a sharpened pivot arm or cutting wheel into a surface, while preventing the unwanted sticking or impaling of the cutter into the cam and/or surface. The prior art is silent as to how, in the absence of fluid flow, such a tool (173) could be actuated using, e.g., the mechanical axial forces of slickline and/or a slickline actuator. A slickline brake (173) is activated by unexpected fluid flow. Accordingly, prior art is also silent as to how a cutting wheel of sufficient diameter might be practicably attached to the pivot arm piston (179) and selectively actuated by, e.g., a conventional slickline BHA (181) piston (180), through the housing (177) lateral window (183), without cutting the deployment cam face (175). Additionally, e.g., an inclusion of conventionally practiced electrical means could adversely affect either the strength or robust nature of the tool by reducing metal wall thicknesses or adversely affecting the transverse diameter of the tool to prevent the tool from being hoisted and/or operated within well passages that are smaller than a soft drink can.

The purpose of hangers and brakes (173) are to prevent the string and BHA from being moved or blown axially by fluid pressure acting against the hanger or BHA. Fluids may be produced against a wireline placed hanger, which can be secured to a subterranean wall surface, but fluids are not generally produced in significant volumes during wireline tool string interventions because of the propensity to urge the tool string axially upward. The prior art is silent as to a conventional explosive or hydrostatic chamber arrangement, which can be usable to selectively activate and deactivate a hanger or anti-blow-up or brake tool (173).

Applied forces generate equal and opposing forces to move members in an assembly.

The prior art is silent to what a slickline actuator would act against to selectively lift the weight of a BHA, which is laden with sinker bars using gravity to deploy and activate a braking tool (173), or how such a lifting force might be released to deactivate a braking tool (173). Prior art is also silent as to how axial mechanical forces, imparted by the hoisting string's attachment to the BHA (181), could be made to act contrary to the intended function of the anti-blow-up or brake tool (173), or how a series of stacked brakes (173) could be adapted and selectively activated and deactivated to provide longitudinal cuts along the axial length of a surface when the brake is forcefully dislodged from its brake position.

Methods for actuating the lower end of the anti-blow-up or brake tool (173) to selectively extend a pivot arm carried, non-imbedding cutter into a subterranean surface are not obvious because such methods are not conventionally practiced nor taught by prior art. For example, prior art teaches activation and securing of a hanger or brake arm to a surface using an explosive charge or fluid flow, but the prior art does not teach how a pivot arm arrangement can be selectively hoisted, via dragging of the tool across a surface, to form an axially longitudinal cut, without becoming embedded. In addition, the prior does not teach how such an arrangement can be both selectively activated and selectively deactivated, to extend and retract laterally upward and laterally downward, using only the axial force of a conventional solid wire slickline arrangement.

Conventional practice and prior art is also silent as to how the limited longitudinal cuts, involving mechanical splitting of, e.g., a tubing coupling or production packer, can be extended to form longer axial longitudinal cut lengths within passageway diameters, which are smaller than a soft drink can, using only the axial forces applicable through string tension and apparatus mass velocity and/or acceleration and gravity to selectively operate a longitudinal cutter, between selected depths along a subterranean well surface.

Accordingly, the present invention provides the benefit of an elegant simplicity compared to more complex solutions requiring, e.g., electrical motors, gears, grit cutters, explosives, chemicals and/or sophisticated devices that are not naturally hoistable or sufficiently robust within a liquid subterranean environment passageway smaller than the diameter of a soft drink can. Prior art teachings for short longitudinal cuts in a subterranean well surface cannot be easily transferred to a hoisted cutting arrangement suited for longer longitudinal cuts. The present invention can include the use various components (174-183) of a brake tool (173), within an arrangement of an embodiment of the present invention, to provide a simpler solution to the conventional alternatives of explosive and chemical cutters, which can be applicable to short, axially longitudinal cuts involving the splitting of couplings and which is significantly simpler than using digital computers, with electricity and rotary cutters, that are difficult to fit within well diameters that can be smaller than a soft drink can.

Embodiments of the present invention use long longitudinal cuts to significantly improve wall destruction by destructing the longitudinal strength of a conduit within a well bore. Embodiments include using one or more longitudinal cuts to allow tubulars to be more easily pulled from a well; or alternatively, the embodiments include the use of longitudinal cuts to push into and imbed within other longitudinally cut and split tubulars, and/or to transform the tubulars into spaghetti-like strands that can be removed from, or more easily crushed and pushed further into, a well bore.

Figures 115, 116, 117, 118, 119, 120, 121, 122:
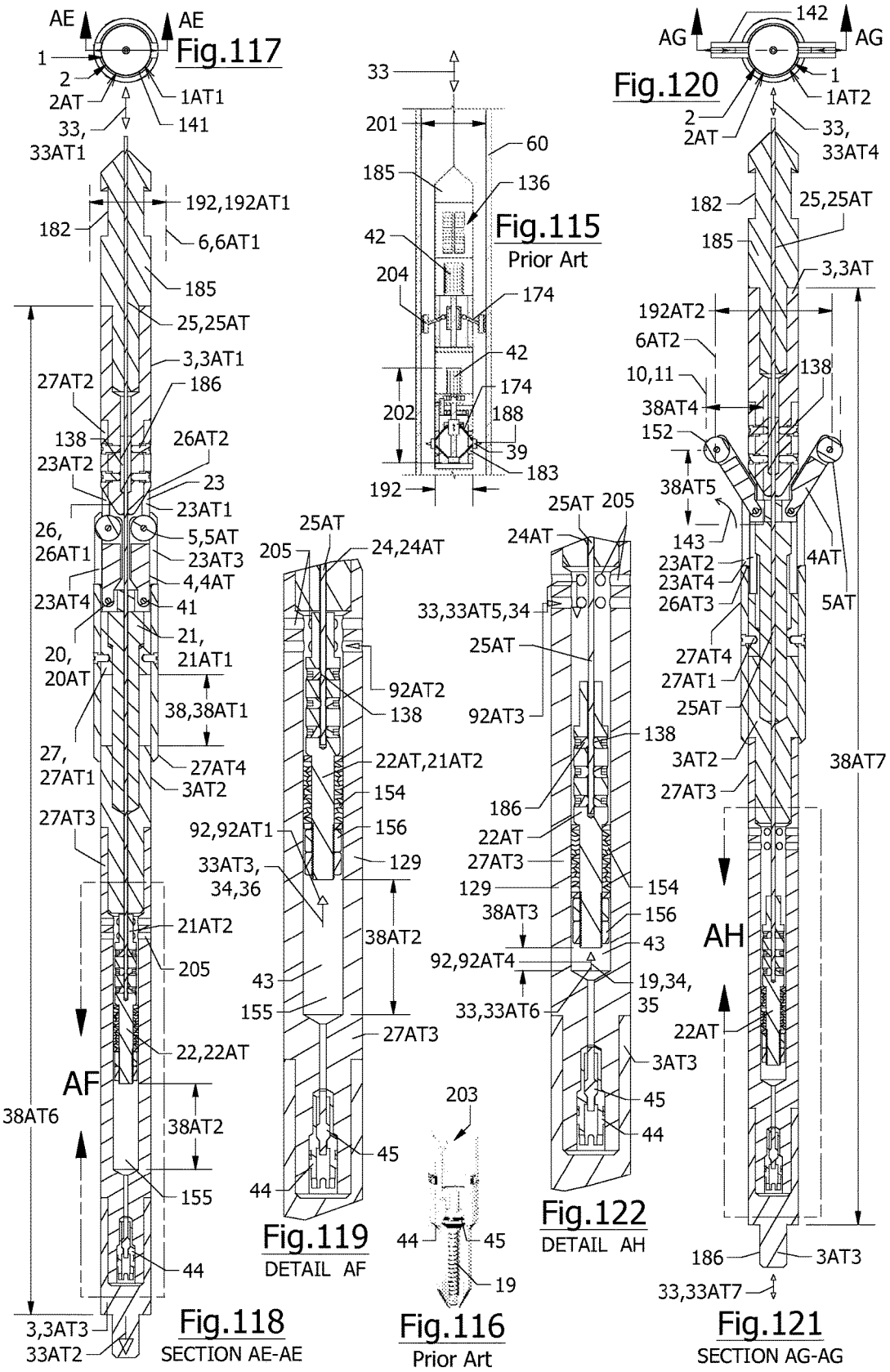
Fig.115 Prior Art
Fig.116 Prior Art

FIG. 115 depicts a slice through a prior art, axially transverse, tubing cutter that is disclosed in US 2010/0258289 A1, and which teaches an electrical slickline axially transverse rotated (39) cutter (136) that is silent to the practical scaling of parts to provide sufficient metal thickness, to be suitably rotatable within, e.g., tubing diameters (192AQ2 of FIG. 111) smaller than a soft drink can (172 of FIG. 111). US 2010/0258289 A1 is also silent to the use of hoisting during cutting operations, wherein the tool (136) uses motors (42) to drive an anchor (204) for preventing hoisting during operation of an axially transverse cutter (188), which is usable with pivot arms (174) through a prior art lateral opening (183) in the housing (177).

Visually comparing the scaled illustration of U.S. Pat. No. 7,575,056 B2 in FIG. 31 to diagrammatic view of US 2010/0258289 A1 indicates that rotating the assembly dimension (202) is impractical. Visually comparing US 2010/0258289 A1 diagrammatic view to the proportions of scaled FIGS. 117 to 122 indicates that US 2010/0258289 A1 is silent to the practicably of providing member metal thickness of sufficient strength to operate its pivot arm (174) motorised (42) cutter (188) arrangement as a longitudinal cutter. The available diameter (201) must be split between the housing (177) walls, the motor's (42) shaft, two cutters of sufficient length to cut the tubing (60) and the pivot arm (174), which must all fit within the housing's (177) transverse dimension (192). A small diameter (e.g. 25 of FIGS. 117 to 122) motor shaft and screw are silent to the rotating torque required to extend and kinetically drag the cutter through the tubing wall, while providing a larger portion of the diameter (201) to the shaft and screw can reduce the thickness and resistance of the pivot arms (174) to bending, as the cutters are forced into the tubing wall. Accordingly, teachings of an anchored (204) apparatus are contrary to longitudinal cutting and the transverse dimension (201) of the tubing (60) would need to be significantly larger to laterally extend a cutter (188) with a motor (42) that provides limited utility during longitudinal cutting.

If the anchors (204) and motors (42) were removed and the cutter (188) was replaced with a longitudinally oriented knife, which is hoisted with a rope socket, US 2010/0258289 A1 is silent as to how a robust tool, which is suitable to the forces of hoisting and jarring downhole, could be fashioned to extend and retract the pivot arms within the transverse dimension (192Q2 of FIG. 111) of a soft drink can (172 of FIG. 111), using only the applied hoisting force (33). For longitudinal cutting, the electrical supply and complexity of rotating the screw, taught by US 2010/0258289 A1, to laterally extend the cutter is over complicated. In contrast, the present invention can be actuated using hoisting forces, an electrical solenoid type initiation of mechanical forces, or, alternatively, using conventional explosive means.

With regard to cutting transversely to a well axis with a filament-like cutter, US 2010/0258289 and U.S. Pat. No. 7,575,056 B2 teach methods that can represent significant operational challenges within a dirty, high temperature and high pressure fluid subterranean environment that can significantly increase the cost of using and maintaining such cutters. In contrast, a filament-like cutter, similar in diameter to, e.g., ((25) of FIGS. 117 to 122) can allow other members to have sufficient metal thickness and strength to better rotate and laterally extend the filament-like cutter, from a reel or central passage (24 of FIGS. 117 to 122) in a rotatable shaft, to furrow cut surfaces that are significantly offset from the tubing diameter (201).

FIG. 116 shows an isometric view, with a quarter section removed, of a prior art back pressure valve (203) conventionally usable within wellheads. The device (203) is a one way valve (44) that uses a choke (45) seat held by a spring (19) and/or pressure within a void of a wellhead arrangement. The device (203) is an example of one type of valve (44) that could be suitably sized to work within an actuator (22) of the present invention.

FIGS. 117, 118 and 119 show a plan view with line AE-AE, an elevation cross section view through line AE-AE of FIG. 117 with line AF and a magnified detailed view within line AF of FIG. 118, respectively, illustrating a hydrostatic actuator (22AT) method (1) embodiment (1AT1) for an apparatus (2) embodiment (2AT) in a retracted (141) arrangement with a transverse dimension (192) sized (192AT1) for passage through API specification tubing without engaging the cutter (5AT) against radial inward upset surfaces (6AT1) associated with said tubing, wherein the apparatus can also be sized for laterally extension (142) of the pivot arms (4AT) to a transverse dimension (192AT2 of FIG. 121) usable to cultivate a surface (6AT2 of FIG. 121) of a bore usable to place an API specification casing such that member part material thicknesses are sufficient cultivate (1AT) a surface (6AT2 of FIG. 121).

A retracted (141) state can comprise a separated (38AT1) housing (27AT1) and third shaft (3AT2) arrangement with two diametrically opposed cutters, which can be substantially withdrawn into first lateral openings (23AT1, 23AT2) and fully withdrawn into second lateral openings (23AT3, 23AT4), whereby the apparatus (2AT) can be hoisted (33AT1) between depths in the subterranean well without substantially cutting subterranean surfaces (6AT1) therein.

An optional second housing (27AT4), with second lateral openings (23AT3, 23AT4) can be engaged to the first housing (27AT1) having first lateral openings (23AT1, 23AT2) that can be arranged to enclose the gap (38AT1) and prevent debris from being caught between the first housing (27AT1) and shaft (3AT2). Additional housings can have additional lateral openings (23AT3, 23AT4) that can form a receptacle around cutters (5AT) to prevent their incidental contact with a subterranean surface (6); or alternatively, the first housing's (27AT1) thickness can be increased to enclose cutters. Axial disposition of the lateral openings (23AT3, 23AT4) can be arranged with cam faces (26AT1, 26AT2 shown in FIG. 118 and (26AT3) shown in FIG. 121) to urge the pivot arm (4AT) into a fully retracted disposition, within one of more of the housings (27AT1, 27AT4), to further avoid incidental cutting or damage to subterranean surfaces (6) or cutters (5AT) during retracted (141) hoisting.

FIGS. 120, 121 and 122 show a plan view with line AG-AG, an elevation cross section view through line AG-AG of FIG. 120 with line AH, and a magnified detailed view within line AH of FIG. 121, respectively, illustrating an actuation method (1) embodiment (1AT2) for an apparatus (2) embodiment (2AT) in an extended (142) arrangement.

In an extended (142) state, actuated by closing the gap ((38AT1), shown in FIG. 118) between the housing (27AT1) and third shaft (3AT2), the arrangement can laterally extend (152) two diametrically opposed cutters from the lateral openings (23AT4, 23AT2) to substantially cut through (10) or cut a trench (11) into a subterranean surface (6AT2), between selected hoisting (33AT4) depths in the subterranean well, by transfer hoisting forces (33AT4) to the diametrically opposed and laterally upward extending cutters (5AT), into the surface (6AT2), to perforate (10) or furrow (11) cut therethrough or therein.

Referring now to FIGS. 117 to 119 and FIGS. 120 to 122, the Figures show an actuator (22, 22AT) retracted (141) method (1) embodiment (1AT1) and extended (142) method (1) embodiment (1AT2) using a hydrostatic chamber (155) actuator (22AT) that can provide a spring-like (19) effect on the laterally extended (152) pivot arm (4AT) carried cutter (5AT), and which can be disposed to cut through, and longitudinally along, a plurality of subterranean surfaces (6AT1, 6AT2). A shaft (3) embodiment (3AT) can comprise arranged and engaged shafts (3AT1, 3AT2 and 3AT3) that can be usable with a second shaft (25AT) and pistons (20AT, 21AT1, 21AT2) to selectively activate and deactivate the apparatus (2AT).

Once the assembly of the apparatus (2AT) is complete at the surface, the third (3AT3) shaft (3) can be removed to access the valve (44) comprising, e.g., a back pressure valve (203 of FIG. 116) and hydrostatic pressure chamber (155) that can be selectively filled with a fluid volume (43) comprising, e.g., air or nitrogen, to selectively set a pressure (92AT1) within the chamber to provide force (33AT3) to overcome normal atmospheric pressure (92AT2) at the surface and move (38AT2) the third (21AT2) piston (21) member to a retracted (141) disposition. Replacing the fourth shaft (3AT3), and any further BHA members engaged to its lower mandrel (186) end, can then be carried out prior to hoisting the apparatus (2) within the well. Filling the hydrostatic chamber (155) has the effect of removing any tension from the second shaft (25AT) so that the mass of the lower BHA, e.g. stem or sinker bar members, which is engaged to the fourth shaft (3AT3), hangs from the housing (27AT1) during retracted hoisting.

Selective hoisting (33AT1) can be used to dispose the apparatus (2AT) within the well at a desired subterranean depth, associated with a well fluid hydrostatic pressure (92AT3) that is matched to the pre-charge pressure (92AT1) injected into the hydrostatic pressure chamber (155). The well's hydrostatic pressure (92AT3) can pass through pressure port (205) to activate the actuator (22AT) to laterally dispose (152) the cutters (5AT). Selectively arranging the pre-charge pressure (92AT1) to selectively coincide with the hydrostatic fluid pressure (92AT3), at a selected depth, can apply fluid energy (34) force (33AT5) to the third piston (21AT2) and compress the pre-charge fluid volume until an offsetting piston pressure (92AT4) force (33AT6) is achieved. The change of pressure from (92AT2) to (92AT3) moves (38AT3) the actuator's (22AT) third piston (21AT2) and slip (138) engaged second shaft (25AT).

Movement between (38AT2) and (38AT3) closes the gap (38AT1) between the housing (27AT1) and third shaft (3AT2) to urge the second piston (21AT1) and first piston (20AT), wherein the movement operates the hinged (41) pivot arm (4AT) and the carried cutter laterally (38AT4) upward (38AT5) to engage and longitudinally cut (10, 11) a subterranean surface (6AT2), when hoisted (33AT4) between selected depths. The apparatus can move between axial lengths (38AT6) and (38AT7) using force (33AT2) in a deactivated retracted (141) arrangement and force (33AT7) in an activated extended (142) arrangement, dependent upon the selectively applicable energy forces (33AT1 to 33AT7) applicable to tension in the string and subterranean hydrostatic pressures, as various depths are selectively controlled by hoisting the string.

The actuator (22AT) can be activated below a selected depth with hydrostatic pressure (92AT3) and deactivated above the selected depth dependent upon the subterranean hydrostatic fluid pressure (92AT3) and a pre-charge pressure (92AT1). Various factors, like the chemical fluid energies (36) associated with temperature expansion of the fluid in the hydrostatic chamber (155), can be accounted for. As the fluid volume (43) within the hydrostatic chamber (155) can be compressible and expandable, the fluid volume can provide a spring-like (19) activation (33AT5) and deactivation (33AT6) force, below a selected depth, that is associated with the hydrostatic pressure (92AT3), trapped pressure (92AT4) and/or reactive force of the hoisted (33AT4) cutter (5AT) and pivot arm (4AT) as passed through the pistons (20AT, 21AT1), second shaft (25AT) and third shaft (3AT2).

Accordingly, forces (33AT1 to 33AT7) can be selectively transferred, between at least one of the apparatus assembly's (2AT) members and the hoisting string or said subterranean wall surface (6AT2), by using the actuator (22AT) to selectively impart movement (38AT1 to 38AT1 to 38AT7) to at least one member of apparatus assembly. This movement of the at least one member of the apparatus can urge the pistons (20AT, 21AT1, 21AT2) axially along a second shaft (25AT), within a housing (27AT1-27AT3), to operate a hinge (41) to axially (38AT5) and laterally (38AT4) dispose diametrically opposed pivot arm (4AT) carried cutters (5AT) through lateral housing openings (23AT1-23AT4), into or away from a subterranean surface (6T1-6AT2), which can be used to form a plurality of axial longitudinal cuts (10, 11), formed axially along the subterranean surface when hoisting (33AT2) the apparatus between selected depths.

An apparatus (2AT) can comprise circumferentially disposed cutter (5AT) members rotated about the apparatus's axis relative to each other to form a plurality of circumferentially phased longitudinal cuts. The plurality of pivot arm members (4AT), carrying an associated plurality of cutters (5AT), are disposable through associated lateral openings (23AT1-23AT4) in the housing (27AT1-27AT4) by using a hinged (41) member with a first piston (20AT). The plurality of members can be circumferentially oriented and arranged to provide an angularly offset and/or diametrically opposed plurality of phased longitudinal cuts, which can be formed axially along the subterranean surface when the apparatus assembly is hoisted between selected depths in a well.

Between the rope socket (185) and actuator (22AT), the apparatus can further comprise coupling the upper end of at least one second member assembly, which can comprise (3AT1, 4AT, 5AT, 20AT, 21AT1, 23AT, 27AT1-27AT2), to the lower end of the shown member assembly, which can comprise (3AT1, 4AT, 5AT, 20AT, 21AT1, 23AT, 27AT1-27AT2), to form a plurality of member bottom hole assemblies with a common second shaft (25AT) between the upper-most first shaft (3AT1) and the lower-most actuator (22AT). The stacked plurality of assemblies can be commonly actuated and usable to form a plurality of longitudinal cuts that can be coincidentally aligned or circumferentially offset to provide an aligned, angularly offset or diametrically opposed arrangement of cutters to form an apparatus (2AT) bottom hole assembly (130 of FIGS. 98 to 100), which can be usable to place a plurality of cutters in the same longitudinal cut track and/or to form a circumferential plurality of phased longitudinal cuts when the stacked apparatus bottom hole assembly is hoisted between selected depths in a well.

Longitudinal cuts can perforate (10) between opposite surfaces of a wall or form a furrow-shaped cut (11) in a surface. A severing perforating (10) cut through a tubular wall's inner and outer diameter subterranean surfaces can be used to split the tubular and form a circumferentially expandable or collapsible split tubular wall cross-section, along the axis of the tubular.

The method (1AT) can further comprise the step of axially disposing a longitudinally and transversely severed tubular wall cross-section within a bore of the well using axial movement and/or helical twisting to move and transversely expand or collapse the tubular wall cross section to, e.g., place a tubular within a bore of the well during its retrieval from the upper end or compaction into the lower end of the well. The step of transversely cutting one or more tubular walls to axially dispose an expanded or collapsed tubular wall within a well bore, or about a circumference of another tubular in a well, can also comprise the step of disposing one or more longitudinally cut tubular walls into or around another to concentrically embed multiple tubulars within the same longitudinal well length.

An apparatus (2AT) can use axial jarring force (33T1, 33AT4), which can be imparted by, e.g., movement of a second position (2AT1) within the housing (27AT1) if, e.g., the tool becomes stuck against a diameter or radius change in a subterranean well surface.

A hydrostatic actuator (22AT) can provide a natural spring-like (19) dampening effect by using further expansion and compression of the fluid volume (43). Alternatively, the actuator (22AT) can be replaced by or coupled with any suitable actuating mechanism (129) integrated into the apparatus as a member part or assembly member to act forcibly between at least two apparatus members, between at least one apparatus member and the string and/or between at least one apparatus member and a subterranean surface (6AT).

Actuators (22T, 129) can use spring-like (19) energy, hydraulic fluid energy (34), electrical energy (35) applied through, e.g., an insulated slickline second shaft (25AT), and/or the chemical energy of, e.g., an explosion initiated through the insulated slickline or by a timer, depth meter and/or motion meter, to selectively provide force (33) and associated member movement (38) to affect longitudinal cutting. The method (1AT1, 1AT2) can further comprise the step of passing an insulated slickline, passing through the central passage (24, 24AT) of the apparatus (2AT), to hoist (33AT1, 33AT4) and operate assembly member devices.

Accordingly, as demonstrated, embodiments of the present invention thereby provide apparatus and methods that enable any adaptation of a conventional apparatus, according to the embodiments of the present invention, or the use of invented apparatus described herein, to perform primary and/or secondary cultivation that can form separate wall regions associated with a plurality of planes separated by furrows scraped into a wall's surface, wherein cultivation can comprise primary or secondary tillage-like cultivation and/or secondary scraper-like cultivation. After forming the furrows, a spreadable substance can be applied to a wall surface or can be used to grout a substance into the furrows formed in the wall surface. Primary tillage cultivation can comprise deeper ploughing or cutting into a well to produce a furrow or rough wall surface finish, whereas secondary tillage can comprise less forceful scraping of a wall surface to produce a smoother wall surface finish, like that required to make a seal with, e.g., an inflatable packer. Harrowing a wall surface can combine both primary and secondary tillage methods and/or apparatus into a single operation.

The demonstrated embodiments can be used within diverse pressure, temperature and stratigraphic forces that can be vastly different from one well to the next and which have formed over hundreds of millions of years. Consequently, the art and practice of the well construction and production industry is to rely both upon empirical measurements, via sensors and/or transponders, to gather data for theoretical equations that can be used for forming an apparatus for subsequent use and/or the actuating or operating of a downhole apparatus that is exposed to subterranean substances, pressures and temperatures. Various embodiments may first perform empirical measurements of the downhole environment to configure various actuators, which can, e.g., be activated and deactivated according to the temperatures and pressures within a downhole environment or, e.g., using the time spent within a prescribed set of well conditions.

While various embodiments of the present invention have been described with emphasis, it should be understood that within the scope of the appended claims, the present invention might be practiced other than as specifically described herein.

Reference numerals have been incorporated in the claims purely to assist understanding during prosecution.

The embodiments of the invention in which an exclusive property or privilege is claimed are defined as follows:

1. A method (1) of cultivating a surface (6) of a wall of a subterranean well bore, a conduit or a cable by scraping and furrowing said surface, said method comprising the steps of:

cultivating said surface of said wall using at least one apparatus (2) member assembly selectively operated and hoisted by a string across subterranean depths to selectively urge at least one substantial furrow (11) into a plane of said surface of said wall during one or more arcuate scraping engagements to separate said plane into a plurality of planes having separate surface regions (9), wherein said at least one apparatus member assembly comprises an above subterranean surface hoistable shaft (3) member carrying a flexible arrangement of an arcuate engagement linkage (4) member having a shape, a movement-path, or combinations thereof, of an arc flexibly extendable and retractable between said hoistable shaft and said surface of said wall; and extending and retracting, arcuately, said flexible arrangement of said arcuate engagement linkage (4) member laterally from said shaft to carry, arcuately align, and transferring spring (19) force, gravity force, mechanical force (33), fluid force (34), electrical force (35), chemical reactive force (36), or combinations thereof (37) from said string, an actuator member (22) of said at least one apparatus member assembly, fluids in said subterranean well bore, or combinations thereof, through said at least one apparatus member assembly, to move said one or more arcuate scraping engagements and transfer kinetic drag force to at least one cutter and scraper (5) member during said one or more arcuate scraping engagements: along said surface of said wall and longitudinal to said well axis to form and use said at least one substantial furrow, across said surface of said wall and transverse to said well axis using a filament-like said arcuate engagement linkage member to form and use said at least one substantial furrow, or along and across said surface of said wall and longitudinal and transverse to said well axis to form and use a lattice of said at least one substantial furrows, wherein said one or more arcuate scraping engagements urges said at least one substantial furrow into said plane to form said plurality of planes to prepare said separate surface regions for subsequent use by an ancillary apparatus (7) or a spreadable substance (8) engageable thereto.

2. The method according to claim 1, further comprising the step of using at least a second said at least one apparatus (2) member assembly to operate said at least one cutter and scraper (5) member to further scrape said surface (6) of said wall, said at least one substantial furrow (11), said separate surface regions (9), or combinations thereof, for subsequent use by said ancillary apparatus (7) or said spreadable substance (8) engaged thereto.

3. The method according to claim 1, further comprising the step of using said flexible arrangement during said one or more arcuate scraping engagements to apply said transferred kinetic drag force to form said at least one substantial furrow (11) across a dichotomy of said planes of said surface (6) of: said subterranean well bore, said conduit, said cable, or combinations thereof, to further form said plurality of planes.

4. The method according to claim 1, further comprising the step of further forming said lattice of said at least one substantial furrow with at least one overlapping second scraping engagement or at least one crossing second scraping engagement to: increase an amplitude of a deepest concave protrusion of said at least one substantial furrow (11) into said plane of said surface (6) of said wall, perforate (10) through a surface (6) of an opposite plane of said wall to further separate said separate surface regions, engage a different said surface (6) of a different said wall that is obstructed by said surface (6) of said wall, or combinations thereof.

5. The method according to claim 4, further comprising the step of using said perforation (10) through the surface of the opposite plane of said wall to: axially sever said wall, circumferentially split said wall, or combinations thereof, to provide for subsequent separation or collapse of the transverse cross section of said wall of the subterranean conduit or subterranean cable.

6. The method according to claim 1, further comprising the step of operating said apparatus (2) to reduce an amplitude of at least one portion of a convex protrusion extending from a deepest concave end of said at least one substantial furrow (11) by cutting at least one portion of said convex protrusion, scraping and removing debris circumferentially disposed between the deepest concave end of said at least one substantial furrow, or combinations thereof.

7. The method according to claim 1, further comprising the step of joining said plurality of planes into a continuous plane with at least one overlapping second scraping engagement or at least one crossing second scraping engagement by: scraping said plurality of planes to urge a removal of the convex protrusion from the deepest concave end of said at least one substantial furrow (11) until said plurality of planes meet and form said continuous plane at a point of said deepest concave end, or scraping grout (13) into and filling said deepest concave protrusion of said at least one substantial furrow (11) into said surface of said wall to bridge the at least one substantial furrow therebetween to form said continuous plane at said surface (6) of said wall.

8. The method according to claim 1, further comprising the step of using a mechanism of said actuator (22) member to communicate with and selectively activate or selectively deactivate at least one other member of said at least one apparatus member assembly, wherein said actuator member is selectively arranged to be interoperable with said at least one other member to selectively and continuously or intermittently dispose said one or more arcuate scraping engagements against said surface to selectively transfer said kinetic drag force.

9. The method according to claim 1, further comprising the step of empirically measuring the downhole parameters of: said subterranean well bore, said surface of said wall, the disposition of said at least one other member, or combinations thereof, with a measurement (97) member selectively arranged to initiate operation of said actuator (22) member.

10. The method according to claim 9, further comprising the step of using: at least one of three dimensions, a time, a temperature, a movement, communication signals, or combinations thereof, empirically measured within said subterranean well by said measurement member, to initiate operation of said actuator (22) member.

11. A method of forming and arranging an apparatus (2) member assembly to cultivate (1) a surface (6) of a wall of a subterranean well bore, a conduit or a cable by scraping at least one substantial furrow therein, said method comprising the steps of:

forming, providing and selectively arranging said apparatus member assembly with an above subterranean surface string hoistable shaft (3) member for carrying a flexible arrangement of an arcuate engagement linkage (4) that is arcuately extendable and retractable laterally and carries a draggable at least one cutter and scraper member (5) and with a member engagement mechanism (129) that is selectively: fixable, slideable, rotatable, shearable, or combinations thereof, wherein the member engagement mechanism (129) is usable to axially move (38) or rotationally move (39) said one or more arcuate scraping engagements to selectively transfer said kinetic drag force;

forming and arranging said arcuate engagement linkage with at least one of said member engagement mechanisms (129) comprising: a rigid (30) part flexibly operable via a pivotal part, a flexible (31) part, or combinations thereof, wherein the at least one of said member engagement mechanisms (129) is usable during said axial movement (38) or said rotational movement (39) of said one or more arcuate scraping engagements to flexibly and laterally transfer kinetic drag force from said above subterranean surface string hoistable shaft member through said arcuate engagement linkage having an arcuate shape or an arcuate engagement of said flexible arrangement and an alignment of said draggable at least one cutter and scraper member during one or more arcuate scraping engagements: along said surface of said wall and longitudinal to said well axis to form and use said at least one substantial furrow, across said surface of said wall and transverse to said well axis using a filament-like arcuate engagement linkage to form and use said at least one substantial furrow, along and across said surface of said wall longitudinal and transverse to said well axis to form and use a lattice of said at least one substantial furrow, and arranging said apparatus member assembly for selectively hoisting said apparatus member assembly across subterranean depths to selectively operate said one or more arcuate scraping engagements and urge said at least one substantial furrow (11) into a plane of said surface of said well to separate said plane into a plurality of planes comprising separate surface regions (9) usable by an ancillary apparatus (7) or a spreadable substance (8) engagable thereto.

12. The method according to claim 11, further comprising the step of providing an actuator (22) member arranged to axially move or rotationally move said one or more arcuate scraping engagements and transfer said kinetic drag force, wherein said actuator uses: spring (19) force, gravitational force, mechanical force (33), hydraulic fluid force (34), electrical force (35), chemical reaction force (36), or combinations thereof (37), selectively applied by said actuator member through a member engagement mechanism (129) of said actuator member.

13. The method according to claim 12, further comprising the step of forming and arranging said actuator (22) member to transfer said kinetic drag force at empirically measurable downhole conditions to selectively operate said apparatus within said downhole conditions.

14. The method according to claim 11, further comprising the step of forming and arranging a housing (27) with at least one axial passage (24), a lateral opening (23), or combinations thereof, wherein said at least one axial passage (24) or a lateral opening (23) is usable to dispose at least one other apparatus assembly member therethrough.

15. The method according to claim 11, further comprising the step of forming and arranging said apparatus to use at least one overlapping second scraping engagement and a side of said at least one substantial furrow to proximally guide and focus said at least one overlapping second scraping engagement at a deepest concave end of said at least one substantial furrow to increase an amplitude of a penetration said at least one substantial furrow into said plane of said surface.

16. The method according to claim 11, further comprising the step of forming and arranging a first shaft member with said filament-like (18) arcuate engagement linkage (4) carrying said draggable at least one cutter and scraper (5) member, wherein said filament-like (18) arcuate engagement linkage (4) is moved by an actuator (22) member to flexibly drag said draggable at least one cutter and scraper member (5) and to apply said kinetic drag force to form said at least one substantial furrow across said plane, across said plurality of planes or across a dichotomy of separate surface planes of: said subterranean well bores, said conduits, said cables, or combinations thereof, to form said plurality of planes.

17. The method according to claim 16, further comprising the step of forming and arranging said filament-like arcuate engagement linkage (4) and said draggable at least one cutter and scraper (5) member in a coiled reel arrangement usable to spool said filament-like arcuate engagement linkage (4) and said draggable at least one cutter and scraper (5) member laterally.

18. The method according to claim 11, further comprising the step of forming and arranging said apparatus member assembly with a first shaft member (3) comprising a housing (27), wherein the housing comprises at least one second shaft member comprising at least one piston (20) and at least one axial passageway (24) through said first shaft member and said at least one second shaft member, wherein said at least one axial passageway is usable for passage of at least one third shaft member that is usable with an actuator (22) to urge said at least one piston and at least one associated pivot arm of said arcuate engagement linkage (4) member through a lateral opening (23) in said housing via a hinged (41) bascule-like arrangement between said housing, said piston and said at least one associated pivot arm, and wherein a cam face of said at least one associated pivot arm is extended (142) or retracted (141) laterally and upward or downward to slide against at least one associated cam face (26) of at least one of said first, second, or third shaft members, said at least one axial passageway, said lateral opening, said housing or said surface (6) of said wall to arcuately urge said draggable at least one cutter and scraper member laterally into said plane of said surface of said wall or laterally away from said plane, and axially upward or axially downward to transfer said kinetic drag force from said selective hoisting to said one or more arcuate scraping engagements, along said surface of said wall and aligned longitudinally to said well axis.

19. The method according to claim 11, further comprising the step of forming and arranging a cable hoistable string apparatus in compliance with American Petroleum Institute (API) specifications, wherein said cable hoistable string apparatus comprises a transverse dimension sized for passage through tubing conforming to said API specification and associated radially inward upsets of said tubing, wherein a transverse dimension of said arcuate engagement linkage carrying said at least one draggable cutter and scraper member is sizable for lateral extension and lateral retraction through said at least one substantial furrow to and from a larger diameter of said surface of said wall of a bore usable to place casing conforming to said API specifications.

20. The method according to claim 11, further comprising the step of forming and arranging said cutter and scraping member as a mainshare (167), a foreshare (168), a mouldboard (169), a coulter (170), or combinations thereof, carried by a cut regulator (171) arcuate engagement linkage usable to plough (166) and form said at least one substantial furrow.

21. An apparatus (2) for cultivating (1) a surface (6) of a wall of a subterranean well bore, a conduit or a cable by scraping at least one substantial furrow therein, said apparatus comprising:

at least one above subterranean surface string hoistable shaft (3) member comprising at least one housing (27) with at least one axial passage (24), a lateral opening (23), or combinations thereof, usable to communicate and move a fluid or a mechanical arcuate engagement linkage cutter and scraper member therethrough (28) or thereabout (29), wherein said at least one above subterranean surface string hoistable shaft (3) member carries a flexible arrangement of a arcuately extendable and retractable arcuate engagement linkage (4) member having a shape, a movement-path, or combinations thereof, of an arc flexibly extendable and retractable between said hoistable shaft and said surface of said wall to align and carry a draggable at least one cutter and scraper member (5); and said arcuate engagement linkage member arranged to laterally transfer kinetic drag force and arcuately extend, retract, engage and align said draggable at least one cutter and scraper member (5) during one or more arcuate scraping engagements: along said surface and longitudinal to said well axis using a bascule-like linkage or a filament-like linkage to form and use said at least one substantial furrow, across said surface and transverse to said well axis using said filament-like linkage to form and use said at least one substantial furrow, along and across said surface and longitudinal and transverse to said well axis to form and use a lattice of said at least one substantial furrows, wherein selectively hoisting of said one or more arcuate scraping engagements selectively urges said at least one substantial furrow (11) into a plane of said surface of said wall to separate said plane into a plurality of planes comprising separate surface regions (9) usable by an ancillary apparatus (7) or a spreadable substance (8) engaged thereto.

22. The apparatus according to claim 21, wherein said arcuate engagement linkage member further comprises a rigid (30) part flexibly operable by a pivotal part, a flexible (31) part, or combinations thereof, arranged to form said flexible arrangement.

23. The apparatus according to claim 22, wherein said pivotal part or said flexible part comprises an elastic material (32), a bendable material (18), a hinge (41), or combinations thereof.

24. The apparatus according to claim 22, wherein said pivotal part or said flexible part further comprises a bow or coiled filament (18), a bow or coiled spring (19), or combinations thereof.

25. The apparatus according to claim 21, further comprising a member engagement mechanism (129) that is selectively fixable, slideable, rotatable, shearable, or combinations thereof, wherein said member engagement mechanism (129) is usable to axially move (38) or rotationally move (39) said one or more arcuate scraping engagements and selectively transfer said kinetic drag force through said arcuate engagement linkage.

26. The apparatus according to claim 25, further comprising an actuator (22) member arranged to axially move or rotationally move said one or more arcuate scraping engagements and transfer said kinetic drag force using: spring (19) force, gravity force, mechanical force (33), hydraulic fluid force (34), electrical force (35), chemical reaction force (36), or combinations thereof (37), selectively applied by an engagement mechanism of said actuator member.

27. The apparatus according to claim 26, wherein said actuator (22) member further comprises a solenoid, a motor (42) or a pump (40) component selectively arranged to move said one or more arcuate scraping engagements and transfer said kinetic drag force.

28. The apparatus according to claim 27, wherein said actuator (22) member is further arranged to form a vibrating (46) member usable to vibrate said one or more arcuate scraping engagements to further move said one or more arcuate scraping engagements and transfer said kinetic drag force.

29. The apparatus according to claim 27, wherein said at least one above subterranean surface string hoistable shaft is further adapted for passing a hoisting string, a fluid, or another said shaft through said at least one axial passageway (24) to operate said apparatus from a lower end thereof.

30. The apparatus according to claim 25, wherein said member engagement mechanism (129) further comprises a rotary coupling, a mandrel and receptacle coupling, a threaded coupling, a pinned coupling, a frictional coupling, or combinations thereof, wherein said couplings are usable to selectively control transfer of said kinetic drag force from said at least one above subterranean surface string hoistable shaft (3) or an actuator (22) to said one or more arcuate scraping engagements.

31. The apparatus according to claim 25, wherein said member engagement mechanism (129) is further arranged to selectively use gravitational force and a mass of at least one member of said apparatus to impart said movement.

32. The apparatus according to claim 25, wherein said engagement mechanism (129) is further arranged to use selective changes in velocity or acceleration of hoisting mechanical force (33) relative to a mass momentum of at least one member of said apparatus to impart said movement.

33. The apparatus according to claim 32, wherein said member engagement mechanism (129) is further arranged to be operable via a jarring force and associated said axial movement (38) imparted by said mass momentum of said at least one member of said apparatus against a tension of a hoisting string or a diameter or planar change in a subterranean surface of said wall.

34. The apparatus according to claim 25, wherein said member engagement mechanism (129) further comprises a pressurized piston, a shear pin, a spring, a slip, or combinations thereof, for selectively operating said apparatus within said downhole conditions according to empirically measurable downhole conditions.

35. The apparatus according to claim 21, wherein a transverse dimension (192) of said apparatus and a lateral extension (142) and retraction (141) of said arcuate engagement linkage are arranged to be hoistable, extendable and retractable within diameters of a plurality of said surfaces (6) associated with said subterranean well bores, said conduits or said cables.

36. The apparatus according to claim 35, wherein said transverse dimension of a cable string hoistable said apparatus is further sized for passage through tubing and radially inward upsets associated with said tubing when said arcuate engagement linkage is in said retracted disposition, wherein said tubing complies with American Petroleum Institute (API) specifications, and wherein a transverse dimension of said mechanical arcuate engagement linkage cutter and scraper member is sizable for said lateral extension (142) through said at least one substantial furrow to a larger diameter of said surface of said wall of a bore usable to place casing disposed about said tubing and conforming to said API specifications.

37. The apparatus according to claim 36, further comprising a fluid valve (44), a nozzle (16), a fluid choke (45), a basket (17), or combinations thereof, usable to communicate a fluid to extend said mechanical arcuate engagement linkage cutter and scraper member to operate said one or more arcuate scraping engagements and transfer said kinetic energy.

38. The apparatus according to claim 21, further comprising a plurality of said arcuate engagement linkage members arranged to operate a plurality of said draggable at least one cutter and scraper members in a diametrically opposed orientation, an axially offset orientation, a rotationally phased orientation, or combinations thereof.

39. The apparatus according to claim 21, wherein said arcuate engagement linkage or cutter and scraper member is arranged to substantially penetrate said surface to cut a furrow (11) in said plane of said surface of said wall or to perforate (10) a furrow through an opposite plane of an opposite surface of said wall.

40. The apparatus according to claim 39, wherein said arcuate engagement linkage or said draggable at least one cutter and scraper member is arranged to use a side of said at least one substantial furrow to proximally guide and focus at least one overlapping second scraping engagement at a deepest concave end of said at least one substantial furrow to increase an amplitude of a penetration of said at least one substantial furrow into said plane of said surface.

41. The apparatus according to claim 39, wherein said arcuate engagement linkage or said draggable at least one cutter and scraper member is further arranged to be disposed past said opposite surface of said wall to substantially penetrate and cut a furrow (11) in at least one second plane of at least one second surface or to perforate (10) a furrow through at least one second opposite plane of at least one second opposite surface of at least one second wall.

42. The apparatus according to claim 21, wherein said at least one cutter and scraper member comprises a cutter profile having an integral or autonomous edge (14), an abrasive material (15), or combinations thereof, draggable across said surface of said wall.

43. The apparatus according to claim 21, further comprising a disposable fibre (47), a plastic (48), or combinations thereof (49), arcuate engagement linkage (4) member part detachable from said apparatus for disposal within said subterranean well bore.

44. An apparatus (2) for cultivating (1) a surface (6) of a wall of a subterranean well bore, a conduit or a cable by scraping at least one furrow therein, said apparatus comprising:

at least one above subterranean surface string hoistable shaft (3) member carrying a flexible arrangement of an arcuately extendable and retractable arcuate engagement linkage (4) member having a shape, a movement-path, or combinations thereof, of an arc flexibly extendable and retractable between said hoistable shaft and said surface of said wall to align and carry at least one cutter and scraper member (5); and said arcuate engagement linkage member arranged to laterally transfer kinetic drag force and arcuately extend, retract, engage and align said at least one cutter and scraper member (5) during one or more arcuate scraping engagements: along said surface and longitudinal to said well axis using a bascule-like linkage or a filament-like linkage to form and use said at least one furrow, across said surface and transverse to said well axis using said filament-like linkage to form and use said at least one furrow, along and across said surface and longitudinal and transverse to said well axis to form and use a lattice of said at least one furrows, wherein selectively hoisting of said one or more arcuate scraping engagements selectively urges said at least one furrow (11) into a plane of said surface of said wall to separate said plane into a plurality of planes comprising separate surface regions (9) usable by an ancillary apparatus (7) or a spreadable substance (8) engaged thereto, and wherein said arcuate engagement linkage (4) member comprises a part comprising a disposable fibre (47), a plastic (48), or combinations thereof (49), and wherein said part is detachable from said apparatus for disposal within said subterranean well bore.

* * * * *